US009233546B2

(12) United States Patent
Oya et al.

(10) Patent No.: US 9,233,546 B2
(45) Date of Patent: Jan. 12, 2016

(54) LIQUID SUPPLY UNIT

(71) Applicant: SEIKO EPSON CORPORATION, Tokyo (JP)

(72) Inventors: Shun Oya, Matsumoto (JP); Tadahiro Mizutani, Shiojiri (JP); Atsushi Kobayashi, Matsumoto (JP); Yoshinao Miyata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/573,128

(22) Filed: Dec. 17, 2014

(65) Prior Publication Data

US 2015/0165776 A1 Jun. 18, 2015

(30) Foreign Application Priority Data

| | | |
|---|---|---|
| Dec. 18, 2013 | (JP) | 2013-260964 |
| Dec. 26, 2013 | (JP) | 2013-270007 |
| Dec. 27, 2013 | (JP) | 2013-272477 |
| Jan. 30, 2014 | (JP) | 2014-015767 |
| Feb. 3, 2014 | (JP) | 2014-018365 |
| Feb. 19, 2014 | (JP) | 2014-029769 |
| Feb. 21, 2014 | (JP) | 2014-031192 |
| Feb. 26, 2014 | (JP) | 2014-034847 |
| Feb. 28, 2014 | (JP) | 2014-037928 |
| Feb. 28, 2014 | (JP) | 2014-037929 |
| Mar. 7, 2014 | (JP) | 2014-045198 |
| Mar. 20, 2014 | (JP) | 2014-057360 |
| Mar. 25, 2014 | (JP) | 2014-061295 |
| Mar. 25, 2014 | (JP) | 2014-061296 |
| Mar. 25, 2014 | (JP) | 2014-061297 |
| Jun. 9, 2014 | (JP) | 2014-118344 |

(51) Int. Cl.

| | |
|---|---|
| ***B41J 2/175*** | (2006.01) |
| ***B41J 2/14*** | (2006.01) |
| ***B41J 2/17*** | (2006.01) |

(52) U.S. Cl.

CPC ..... *B41J 2/1752* (2013.01); *B41J 2/175* (2013.01); *B41J 2/1714* (2013.01); *B41J 2/1753* (2013.01); *B41J 2/17523* (2013.01); *B41J 2/17526* (2013.01); *B41J 2/17553* (2013.01)

(58) Field of Classification Search

USPC ..... 347/49, 50, 85, 86

See application file for complete search history.

(56) References Cited

U.S. PATENT DOCUMENTS 4,556,012 A * 12/1985 Scrudato ..... 118/268
5,182,581 A * 1/1993 Kashimura et al. ..... 347/87

(Continued)

FOREIGN PATENT DOCUMENTS

JP 07-148936 A 6/1995
JP 09-011500 A 1/1997

(Continued)

*Primary Examiner* — Anh T. N. Vo

(74) *Attorney, Agent, or Firm* — Stroock & Stroock & Lavan LLP

(57) ABSTRACT

A cartridge 4 is mounted on a carriage 8 and has a liquid retaining member 460 placed in a recess 421 of a casing 420. A first side wall 425 constituting the casing 420 includes a first side wall part 425*a* and a second side wall part 425*b* aligned sequentially from a first end wall 423-side in a first direction from a first end wall 423 toward a second end wall 424. The first side wall part 425*a* includes a first side wall area 425*a*1 located on a bottom wall 422-side and extended to be substantially perpendicular to the bottom wall 422, and a second side wall area 425*a*2 arranged to be inclined with respect to the bottom wall 422. The second side wall part 425*b* is extended from the bottom wall 422 to be inclined with respect to the bottom wall 422. This configuration enables the liquid retaining member of containing a liquid such as ink to be compressed in the casing, while allowing for accurate positioning of the cartridge and improving attachment of the cartridge.

11 Claims, 38 Drawing Sheets

(56) References Cited

U.S. PATENT DOCUMENTS

| | | | | |
|---|---|---|---|---|
| 5,488,401 | A * | 1/1996 | Mochizuki et al. | 347/86 |
| 5,552,861 | A * | 9/1996 | Mizude et al. | 399/50 |
| 5,619,239 | A | 4/1997 | Kotaki et al. | |
| 6,000,789 | A * | 12/1999 | Takagi et al. | 347/86 |
| 6,152,555 | A | 11/2000 | Nozawa et al. | |
| 6,170,941 | B1 * | 1/2001 | Hara et al. | 347/86 |
| 6,250,750 | B1 | 6/2001 | Miyazawa et al. | |
| 6,276,780 | B1 | 8/2001 | Carrese et al. | |
| 6,375,315 | B1 | 4/2002 | Steinmetz et al. | |
| 6,439,491 | B1 * | 8/2002 | Liao | 242/378.1 |
| 6,739,708 | B2 | 5/2004 | Studer et al. | |
| 6,776,479 | B2 | 8/2004 | Ardito et al. | |
| 6,899,417 | B1 * | 5/2005 | Shinada et al. | 347/86 |
| 7,066,587 | B2 | 6/2006 | Andersen et al. | |
| 7,178,909 | B2 * | 2/2007 | Yoshiyama et al. | 347/86 |
| 7,258,431 | B2 | 8/2007 | Shinada et al. | |
| 7,300,142 | B1 | 11/2007 | Usui et al. | |
| 7,445,320 | B2 | 11/2008 | Jung et al. | |
| 8,297,738 | B1 | 10/2012 | Kodama et al. | |
| 2002/0118262 | A1 | 8/2002 | Seino et al. | |
| 2002/0158948 | A1 | 10/2002 | Miyazawa et al. | |
| 2004/0246317 | A1 | 12/2004 | Hayashi et al. | |
| 2005/0168549 | A1 | 8/2005 | Shinada et al. | |
| 2006/0066696 | A1 | 3/2006 | Matsumoto et al. | |
| 2006/0290757 | A1 | 12/2006 | Shinada et al. | |
| 2008/0049080 | A1 | 2/2008 | Hayashi et al. | |
| 2008/0049081 | A1 | 2/2008 | Hayashi et al. | |

FOREIGN PATENT DOCUMENTS

| | | | |
|---|---|---|---|
| JP | 10-016249 | A | 1/1998 |
| JP | 10-278290 | A | 10/1998 |
| JP | 10-286972 | A | 10/1998 |
| JP | 2000-033707 | A | 2/2000 |
| JP | 2000-190522 | A | 7/2000 |
| JP | 2001-121715 | A | 5/2001 |
| JP | 2001-253087 | A | 9/2001 |
| JP | 3248831 | B | 11/2001 |
| JP | 2002-292905 | A | 10/2002 |
| JP | 2003-072099 | A | 3/2003 |
| JP | 2004-230704 | A | 8/2004 |
| JP | 2005-028883 | A | 2/2005 |
| JP | 2005-125559 | A | 5/2005 |
| JP | 2006-088650 | A | 4/2006 |
| JP | 2006-175885 | A | 7/2006 |
| JP | 2006-247932 | A | 9/2006 |
| JP | 2006-289770 | A | 10/2006 |
| JP | 2008-074090 | A | 4/2008 |
| JP | 2008-074100 | A | 4/2008 |
| JP | 2013-141804 | A | 7/2013 |
| JP | 2013-158980 | A | 8/2013 |

* cited by examiner

LIQUID SUPPLY UNIT

CROSS-REFERENCE TO RELATED APPLICATIONS

This application claims priorities to Japanese Patent Applications No. (JP) 2013-260964 filed on Dec. 18, 2013, JP 2013-270007 filed on Dec. 26, 2013, JP 2013-272477 filed on Dec. 27, 2013, JP 2014-015767 filed on Jan. 30, 2014, JP 2014-18365 filed on Feb. 3, 2014, JP 2014-29769 filed on Feb. 19, 2014, JP 2014-31192 filed on Feb. 21, 2014, JP 2014-34847 filed on Feb. 26, 2014, JP 2014-37928 filed on Feb. 28, 2014, JP 2014-37929 filed on Feb. 28, 2014, JP 2014-45198 filed on Mar. 7, 2014, JP 2014-57360 filed on Mar. 20, 2014, JP 2014-61295 filed on Mar. 25, 2014, JP 2014-61296 filed on Mar. 25, 2014, JP 2014-61297 filed on Mar. 25, 2014, and JP 2014-118344 filed on Jun. 9, 2014, entire disclosures of which are incorporated herein by reference for all purposes.

BACKGROUND

The present invention relates to a liquid supply unit.

An ink cartridge (also simply called "cartridge") configured to supply ink to a printer as an example of a liquid ejection device has been known conventionally as a liquid supply unit configured to supply a liquid to the liquid ejection device. The cartridge generally has a porous ink retaining member for containing ink placed in a sealed casing and is attached to a carriage of the printer to supply ink through an ink supply port formed on a bottom wall of the casing as described in Japanese Patent Publication (JP 2000-33707A).

SUMMARY

In a cartridge proposed in JP 2000-33707A, the cartridge side face is tapered to the bottom wall of the cartridge casing, so that the ink retaining member is more compressed on the bottom wall side of the casing. This reduces the areas of the pores in the ink retaining member on the bottom wall side of the casing and thereby enhances the capillary force involved in ink migration. This is favorable in terms of the stable ink supply. The tapered side face is, however, also involved in positioning of the cartridge to the carriage. This may cause the cartridge to be lifted up. There is accordingly a room for improvement in positioning of the cartridge along the moving direction of the carriage.

In a cartridge proposed in JP 2008-74100A, on the other hand, the cartridge side face is uniformly made to be perpendicular to the bottom wall according to the shape of ribs provided on the carriage as the cartridge restricting elements. This improves positioning of the cartridge along the moving direction of the carriage. The area of the cartridge abutting against the ribs as the cartridge restricting elements is, however, the entire area of the cartridge in the top-bottom direction. In the course of attachment of the cartridge to the carriage, the cartridge should be positioned along the extending direction of the ribs. There is accordingly a room for improvement of the attachment of the cartridge. There is accordingly a need to allow for accurate positioning of the cartridge and improve the attachment of the cartridge, while enabling the liquid retaining member of containing a liquid such as ink to be compressed in the casing. In a liquid supply unit configured to contain and supply a liquid, a liquid ejection device configured to receive supply of a liquid from the liquid supply unit and a system including the liquid supply unit and the liquid ejection device, there are other needs including downsizing, cost reduction, resource saving, easy manufacture and improvement of usability.

In order to solve at least part of the problems described above, the invention may be implemented by aspects described below.

(1) According to one aspect of the invention, there is provided a liquid supply unit mountable to a liquid ejection device. The liquid supply unit comprises: a bottom wall located on a bottom when the liquid supply unit is mounted to the liquid ejection device; an upper wall opposed to the bottom wall; a first side wall arranged to intersect with the bottom wall and the upper wall; a second side wall arranged to intersect with the bottom wall and the upper wall and opposed to the first side wall; a first end wall arranged to intersect with the bottom wall, the upper wall, the first side wall and the second side wall; a second end wall arranged to intersect with the bottom wall, the upper wall, the first side wall and the second side wall and opposed to the first end wall; and a liquid retaining member placed in a space surrounded by the bottom wall, the upper wall, the first side wall, the second side wall, the first end wall and the second end wall. The first side wall includes a first part and a second part aligned in a first direction from the first end wall toward the second end wall. The first part of the first side wall has an outer surface comprising: a first area located closer to the bottom wall than the upper wall and arranged to be substantially perpendicular to the bottom wall; and a second area located closer to the upper wall than the bottom wall and arranged to be inclined with respect to the bottom wall. The second part of the first side wall is arranged to be inclined with respect to the bottom wall.

In the course of attachment of the liquid supply unit of this aspect to the liquid ejection device, the first area of the first part of the first side wall arranged to be substantially perpendicular to the bottom wall is needed to come into contact with the liquid ejection device, while the second part aligned with the first part in the first direction from the first end wall toward the second end wall is not needed to come into contact with the liquid ejection device. Accordingly the entire area of the first side wall is not needed to come into contact with the liquid ejection device. As a result, the configuration of the liquid supply unit increases the flexibility of the attitude of the liquid supply unit in the course of attachment to the liquid ejection device and improves the attachment of the liquid supply unit. The first area of the first part of the first side wall arranged to be substantially perpendicular to the bottom wall comes into contact with the liquid ejection device. This configuration of the liquid supply unit ensures the accurate positioning of the liquid supply unit. Additionally, both the second area of the first part located on the upper wall side of the first area, which comes into contact with the liquid ejection device, and the second part aligned with the first part in the above first direction are arranged to be inclined with respect to the bottom wall. Such configuration of the liquid supply unit enables the liquid retaining member to be more compressed on the bottom wall side.

(2) In the liquid supply unit of the above aspect, the first part of the first side wall may have the outer surface further comprising a third area located between the first area and the second area. The third area may have a smaller wall thickness than wall thicknesses of the first area and the second area. In the first side wall surrounding part of the liquid retaining member, the first area, the third area and the second area are sequentially connected from the bottom wall side, and the third area is made to have the smaller wall thickness. This increases the capacity of the space in which the liquid retaining member is placed. Even when the shape on the outer wall surface of the first side wall has some irregularity by the sequential connection of the first to the third areas, this configuration ensures the even or nearly even shape on the inner wall surface of the first side wall.

(3) In the liquid supply unit of the above aspect, the second side wall may have an inner wall surface opposed to the first side wall and obliquely formed to compress the liquid retaining member at a constant angle. This configuration enables the liquid retaining member to be more compressed on the bottom wall side, irrespective of the shape on the outer wall surface of the second side wall. The even shape on the inner wall surface of the second side wall irrespective of the shape on the outer wall surface of the second side wall simplifies the shape of the mold.

(4) In the liquid supply unit of the above aspect, the second side wall may have a flat inner wall surface opposed to the first side wall. This configuration provides the even shape on the inner wall surface of the second side wall irrespective of the shape on the outer wall surface of the second side wall, thus simplifying the shape of the mold.

(5) In the liquid supply unit of the above aspect, the bottom wall may be provided with a liquid supply port. In a plan view in a direction from the upper wall toward the bottom wall, the liquid supply port may be located between the second part of the first side wall and the second side wall. In the liquid supply unit of this configuration, the liquid supply port is located away from the first part of the first side wall to be on the center or near the center of the liquid retaining member. This configuration of the liquid supply unit enables the liquid to be supplied from substantially the entire area of the liquid retaining member and reach the liquid supply port.

(6) In the liquid supply unit of the above aspect, the second part may be wider than the first part of the first side wall in the first direction. This configuration has the following advantageous effects. The first part of the first side wall has the first area and the second area and accordingly has a relatively complicated shape. There is accordingly little space to take a measure for enhancing the strength of the liquid supply unit. Unlike the first part having the first area and the second area, the second part is simply needed to be inclined with respect to the bottom wall and has a relatively simple shape. There is accordingly some space to take a measure for enhancing the strength of the liquid supply unit. In the liquid supply unit of this configuration, the larger width of the second part in the simple shape increases the flexibility in taking a measure for enhancing the strength and is advantageous.

(7) In the liquid supply unit of the above aspect, an angle of the second part of the first side wall with respect to the bottom wall may be greater than an angle of the second area of the first part of the first side wall with respect to the bottom wall. This configuration has the following advantageous effects. In the first part, the second area is located closer to the upper wall than the bottom wall and is arranged to be inclined with respect to the bottom wall. The second part is aligned with the first part including the second area in the above first direction and is arranged to be inclined with respect to the bottom wall. If the angle of the second part with respect to the bottom wall is equal to the angle of the second area of the first part with respect to the bottom wall, the periphery of the second part and the periphery of the second area may be misaligned on the upper wall. In the liquid supply unit of this aspect, however, the angle of the second part with respect to the bottom wall is made greater than the angle of the second area with respect to the bottom wall. This reduces the misalignment of the periphery of the second part of the first side wall with the periphery of the second area of the first part on the upper wall. As a result, this configuration of the liquid supply unit provides the simple shape of the second part of the first side wall on the upper wall side, as well as the simple shape of the upper wall.

(8) In the liquid supply unit of the above aspect, the second part of the first side wall may be arranged to have an angle on an upper wall side with respect to the bottom wall equal to an angle of the second area of the first part of the first side wall with respect to the bottom wall and may be formed to be continuous with the second area in the first direction. This configuration of the liquid supply unit suppresses misalignment of the periphery of the second part of the first side wall with the periphery of the second area of the first part on the upper wall. This accordingly provides the simple shape of the first side wall on the upper wall side, as well as the simple shape of the upper wall.

(9) In the liquid supply unit of the above aspect, the first side wall may further have a third part aligned with the first part and the second part in the first direction. The second part may be located between the first part and the third part in the first direction. The third part of the first side wall may have an outer surface comprising a fourth area located closer to the bottom wall than the upper wall and arranged to be substantially perpendicular to the bottom wall. In the liquid supply unit of this aspect, the fourth area of the third part away from the first part across the second part also comes into contact with the liquid ejection device. This configuration allows for more accurate positioning of the liquid supply unit to the liquid ejection device and further stabilizes the attitude of the liquid supply unit after attachment.

(10) The liquid supply unit of the above aspect may be mountable to the liquid ejection device including a head unit having a liquid introducing part and a carriage unit having an electrode. The first end wall may be provided with an engagement element configured to be engageable with the head unit. The second end wall may have a terminal placed thereon to be electrically connectable with the carriage unit. The first part of the first side wall may be arranged to come into contact with the head unit. The fourth area of the third part of the first side wall may be arranged to come into contact with the carriage unit. This configuration allows for more accurate positioning of the liquid supply unit to the liquid ejection device and further stabilizes the attitude of the liquid supply unit after attachment.

(11) According to another aspect of the invention, there is provided a liquid supply unit mountable to a liquid ejection device. The liquid supply unit comprises: a bottom wall located on a bottom when the liquid supply unit is mounted to the liquid ejection device; an upper wall opposed to the bottom wall; a first side wall arranged to intersect with the bottom wall and the upper wall; a second side wall arranged to intersect with the bottom wall and the upper wall and opposed to the first side wall; a first end wall arranged to intersect with the bottom wall, the upper wall, the first side wall and the second side wall; a second end wall arranged to intersect with the bottom wall, the upper wall, the first side wall and the second side wall and opposed to the first end wall; and a liquid retaining member placed in a space surrounded by the bottom wall, the upper wall, the first side wall, the second side wall, the first end wall and the second end wall. The first side wall includes a first part and a second part aligned in a first direction from the first end wall toward the second end wall. The first part is arranged to be substantially perpendicular to the bottom wall. The second part is arranged to be inclined with respect to the bottom wall.

In the course of attachment of the liquid supply unit of this aspect to the liquid ejection device, the first part of the first side wall arranged to be substantially perpendicular to the bottom wall is needed to come into contact with the liquid ejection device, while the second part aligned with the first part in the first direction from the first end wall toward the second end wall is not needed to come into contact with the liquid ejection device. Accordingly the entire area of the first side wall is not needed to come into contact with the liquid ejection device. As a result, the liquid supply unit of this configuration has the advantageous effects described above, such as improvement of the attachment.

(12) In the liquid supply unit of the above aspect, the first side wall may further have a third part aligned with the first part and the second part in the first direction. The second part may be located between the first part and the third part in the first direction. The third part may be arranged to be substantially perpendicular to the bottom wall. In the liquid supply unit of this aspect, the third part arranged to be substantially perpendicular to the bottom wall also comes into contact with the liquid ejection device. This configuration allows for more accurate positioning of the liquid supply unit to the liquid ejection device and further stabilizes the attitude of the liquid supply unit after attachment.

All the plurality of components included in the aspect of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention may be implemented by any of various other aspects: for example, a liquid ejection device configured to receive supply of a liquid from the liquid supply unit and a system including the liquid supply unit and the liquid ejection device.

DESCRIPTION OF EMBODIMENTS

Some aspects of the invention are described below.

A. Embodiment

A-1. Configuration of Liquid Ejection System 1

Figure 1:
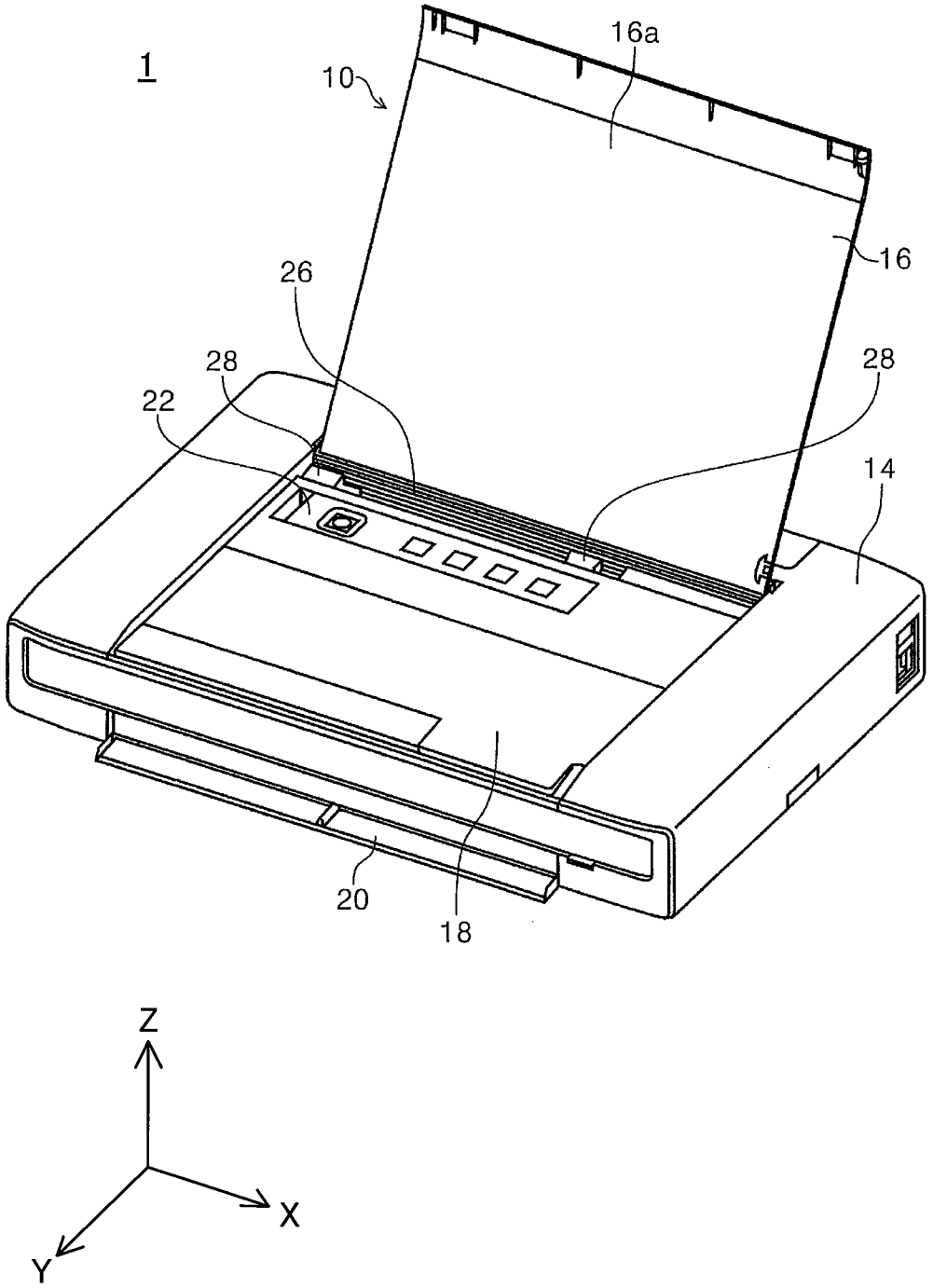
FIG. 1 is a perspective view illustrating the general configuration of a liquid ejection system.
Figure 2:
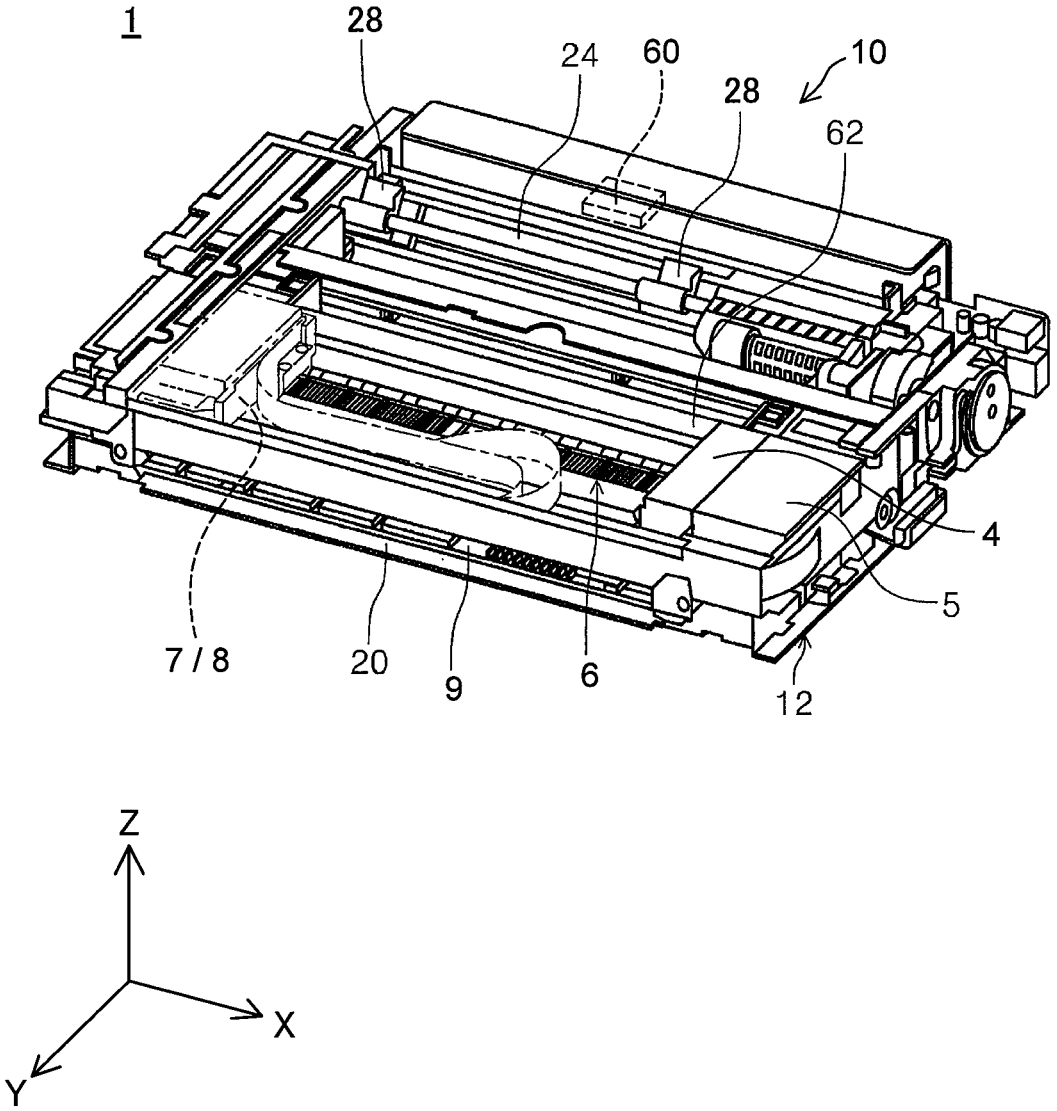
FIG. 2 is a perspective view schematically illustrating the internal configuration of the liquid ejection system.
Figure 6:
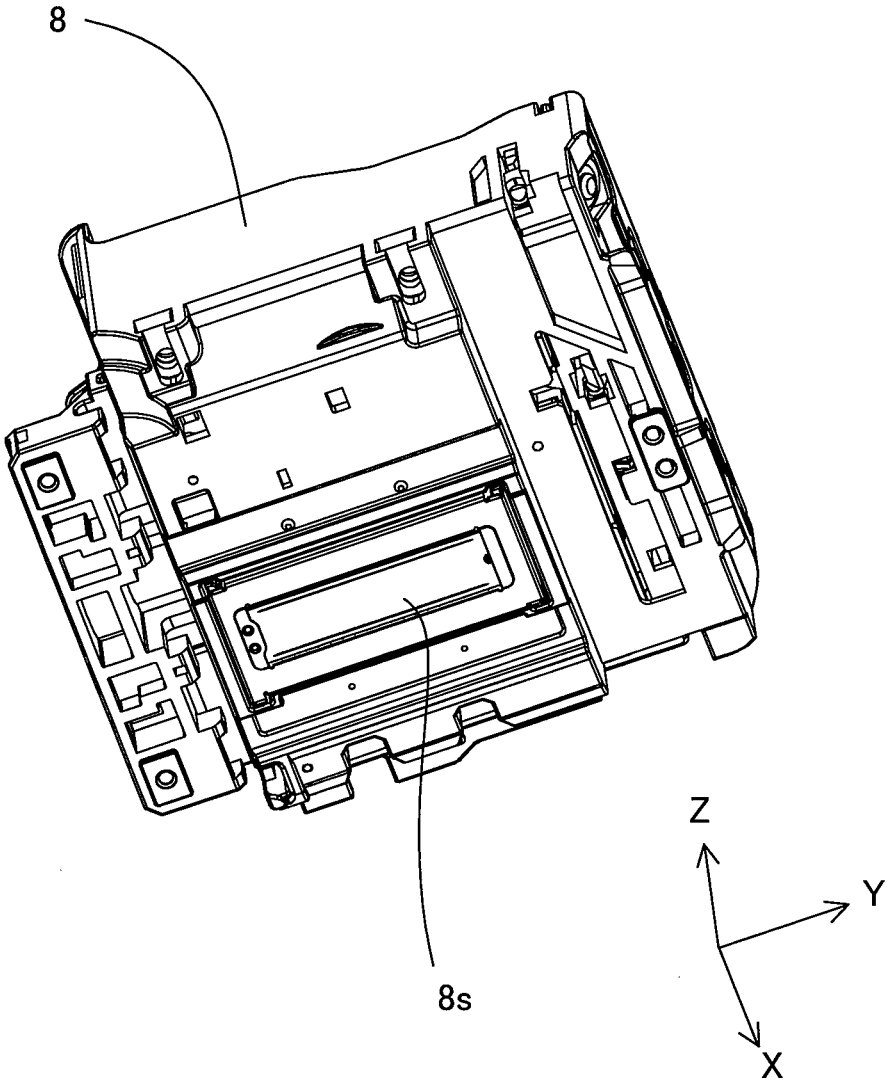
FIG. 6 is a schematic perspective view illustrating the carriage in the non-cartridge attachment state, viewed from the bottom side.

FIG. 1 is a perspective view illustrating the general configuration of a liquid ejection system 1, and FIG. 2 is a perspective view schematically illustrating the internal configuration of the liquid ejection system 1. XYZ axes orthogonal to one another are shown in FIGS. 1 and 2. The X axis denotes an axis along a direction in which a carriage 8 described later moves back and force and is more specifically an axis along a main scan direction of printing accompanied with the back and forth motion of the carriage 8. The Y axis denotes an axis along a feed path direction of paper sheets in the liquid ejection system 1 placed on a horizontal plane such as desk and is more specifically an axis along a sub scan direction of printing accompanied with the back and forth motion of the carriage 8. The Z axis denotes an axis along the top-bottom direction of the liquid ejection system 1 placed on the horizontal plane such as desk. In other illustrations subsequent to FIG. 2, the XYZ axes are shown as needed. The XYZ axes in FIGS. 1 and 2 correspond to the XYZ axes in the other illustrations. The liquid ejection system 1 includes a printer 10 as a liquid ejection device and two different types of cartridges 4 and 5. As shown in FIG. 2, in the liquid ejection system 1 of this embodiment, the cartridges 4 and 5 are attachable to and detachable from a cartridge attachment structure 7 of the printer 10. The cartridge attachment structure 7 has an ejection head 8*s* for ink ejection (FIG. 6). The cartridge attachment structure 7 is mounted on a carriage 8 and is generally integrated with the carriage 8. In the description below, the cartridge 4 is called "first cartridge 4" and the cartridge 5 is called "second cartridge 5". The cartridge attachment structure 7 is also called "head unit". In this case, the carriage 8 without the cartridge attachment structure 7 mounted thereon is called "carriage unit" for the purpose of discrimination.

The first cartridge 4 contains a single color ink, for example, black ink. The second cartridge 5 contains a plurality of different color inks and includes three liquid containing parts according to this embodiment. The second cartridge 5 of this embodiment contains three different color inks, yellow, magenta and cyan.

The number of cartridges and the types of cartridges attached to the cartridge attachment structure 7 are, however, not limited to the configuration of this embodiment. For example, four first cartridges 4 may be provided corresponding to four different color inks, black, cyan, magenta and yellow and may be attached to the cartridge attachment structure 7. In another example, a cartridge containing another or other color inks (for example, light magenta and light cyan) may be attached to the cartridge attachment structure 7. In the application that the multiple first cartridges 4 are attached corresponding to the respective color inks, attachment of the second cartridge 5 may be omitted.

The printer 10 is an inkjet printer. As shown in FIG. 1, the printer 10 includes a housing 14, a paper feeding unit cover 16, a recording unit protective cover 18, a paper output unit cover 20 and an operation unit 22. As shown in FIG. 2, the printer 10 has a device body 12.

As shown in FIG. 1, the housing 14 is arranged to surround the periphery of the device body 12 and forms the appearance of the printer 10. The paper feeding unit cover 16 is provided on an upper surface of the printer 10. The paper feeding unit cover 16 is placed on an upper surface of the housing 14 to be rotatable. The paper feeding unit cover 16 is movable between an open position relative to the housing 14 (FIG. 19 and a closed position (not shown). When the paper feeding unit cover 16 is at the closed position relative to the housing 14, the paper feeding unit cover 16, in combination with the upper surface of the housing 14, forms the upper surface of the printer 10.

When the paper feeding unit cover 16 is at the open position relative to the housing 14, the paper feeding unit cover 16 is inclined with respect to a rear surface side (−Y-direction side) of the printer 10. In this state, a rear surface of the paper feeding unit cover 16 serves as a mounting surface 16*a* on which paper sheets are placed. When the paper feeding unit cover 16 is at the open position relative to the housing 14, a paper slot 26 of a paper feeding unit 24 included in the device body 12 as described later is open up in the printer 10. This accordingly enables the paper feeding unit 24 to feed the paper sheets placed on the mounting surface 16*a* to a paper feed path. The paper feed path denotes a paper moving path in the course of printing. The paper slot 26 has a pair of paper guides 28. The pair of paper guides 28 are arranged to adjust the interval in the width direction (X-axis direction) of the printer 10. The pair of paper guides 28 serve to fasten both ends of a paper sheet in the width direction and specify the position of the paper sheet in the width direction.

When the paper feeding unit cover 16 is at the open position relative to the housing 14, the recording unit protective cover 18 and the operation unit 22 are exposed to be accessible on the upper surface of the printer 10. The recording unit protective cover 18 is movable between an open position relative to the housing 14 (not shown) and a closed position (FIG. 1). When the recording unit protective cover 18 is at the open position relative to the housing 14, a recording unit 6 provided in the device body 12 is made accessible for the user.

The operation unit 22 is provided with a power button and print settings buttons for operating the printer 10. When the paper feeding unit cover 16 is at the open position relative to the housing 14, the operation unit 22 is made accessible for the user and allows the user to operate the printer 10.

Additionally, the paper output unit cover 20 is provided on a front surface of the housing 14. The paper output unit cover 20 is placed on the front surface of the housing 14 to be rotatable. The paper output unit cover 20 is movable between an open position relative to the housing 14 (FIG. 1) and a closed position (not shown). When the paper output unit cover 20 is at the open position relative to the housing 14, a paper sheet after recording discharged from a paper output unit 9 of the device body 12 is guided by the paper output unit cover 20 toward the front side of the printer 10.

As illustrated in FIG. 2, the device body 12 includes the paper feeding unit 24, the recording unit 6, the paper output unit 9 and a controller 60.

The controller 60 is electrically connected with the paper feeding unit 24, the recording unit 6 and the paper output unit 9 and controls the operations of the respective units in response to instructions input from the operation unit 22. The controller 60 also controls the motion of the carriage 8 (motion in the X-axis direction: main scan drive) and the rotation of a feed roller shaft (sub-scan drive) via drive motors (not shown). The carriage 8 has the cartridge attachment structure 7 incorporated in its bottom. The controller 60 also transmits signals to and from circuit substrates included in the cartridges 4 and 5.

The device body 12 also includes a carriage guide rail 62 and a carriage driving unit (not shown) to make the carriage 8 movable along the carriage guide rail 62. The carriage guide rail 62 is extended in the X-axis direction, i.e., the width direction of the device body 12 and is placed in a bearing element 409 (FIG. 3) provided on the bottom side of the carriage 8 to support the carriage 8.

The carriage 8 having the cartridge attachment structure 7 mounted thereon is arranged to move back and forth in the width direction of the device body 12 (X-axis direction, main scan direction) by the carriage driving unit (not shown). The back and forth motion of the carriage 8 in the width direction of the device body 12 causes the cartridge attachment structure 7 to move back and forth in the width direction of the device body 12. The cartridges 4 and 5 are accordingly moved in a moving direction (X-axis direction) by the carriage 8. The type of the printer 10 in which the ejection head 8*s* and the cartridges 4 and 5 are moved by the carriage 8 like this embodiment is called "on-carriage type". In another application, a stationary cartridge attachment structure 7 may be provided at a different position from the carriage 8 to supply inks from the cartridges 4 and 5 attached to the cartridge attachment structure 7 to the ejection head of the carriage 8 via flexible tubes. This type of printer is called "off-carriage type". In this application, the cartridges 4 and 5 are not limited to detachable cartridges but may be stationary ink tanks. The ink tank may be provided with an ink filler port through which ink is injectable from outside.

In the use state of the liquid ejection system 1, the X axis denotes an axis along the main scan direction (left-right direction) in which the carriage 8 moves back and forth; the Y axis denotes an axis along the sub-scan direction (top-bottom direction) in which paper sheets are fed; and the Z axis denotes an axis along the vertical direction (top-bottom direction). Upward in the vertical direction is +Z direction, and downward in the vertical direction is −Z direction. The use state of the liquid ejection system 1 denotes the state of the liquid ejection system 1 placed on a horizontal plane. According to this embodiment, the horizontal plane is a plane parallel to the X axis and the Y axis (XY plane).

A-2. Cartridge Attachment State and Carriage Structure

Figure 3:
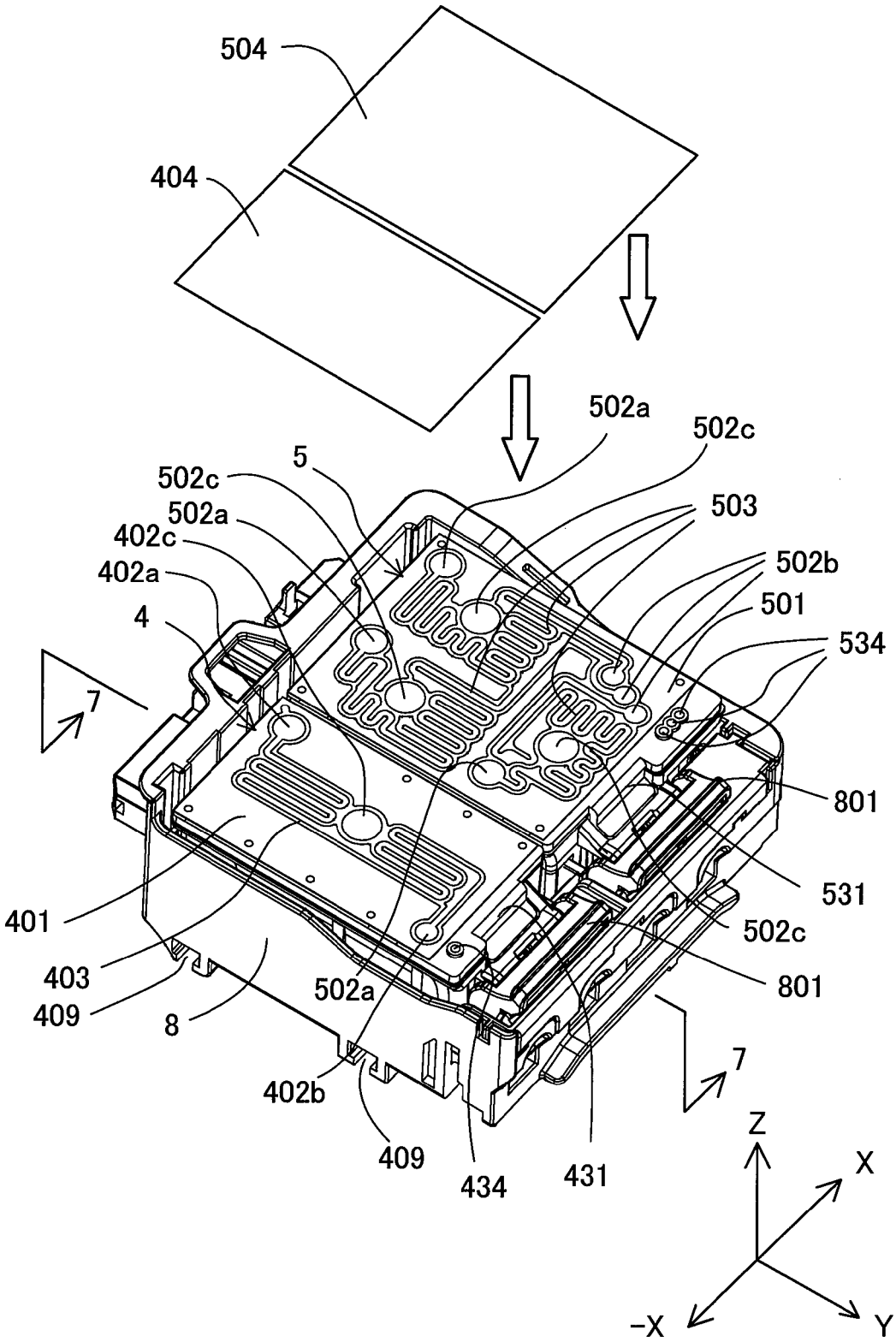
FIG. 3 is a perspective view schematically illustrating the appearance of a carriage in the cartridge attachment state.
Figure 4:
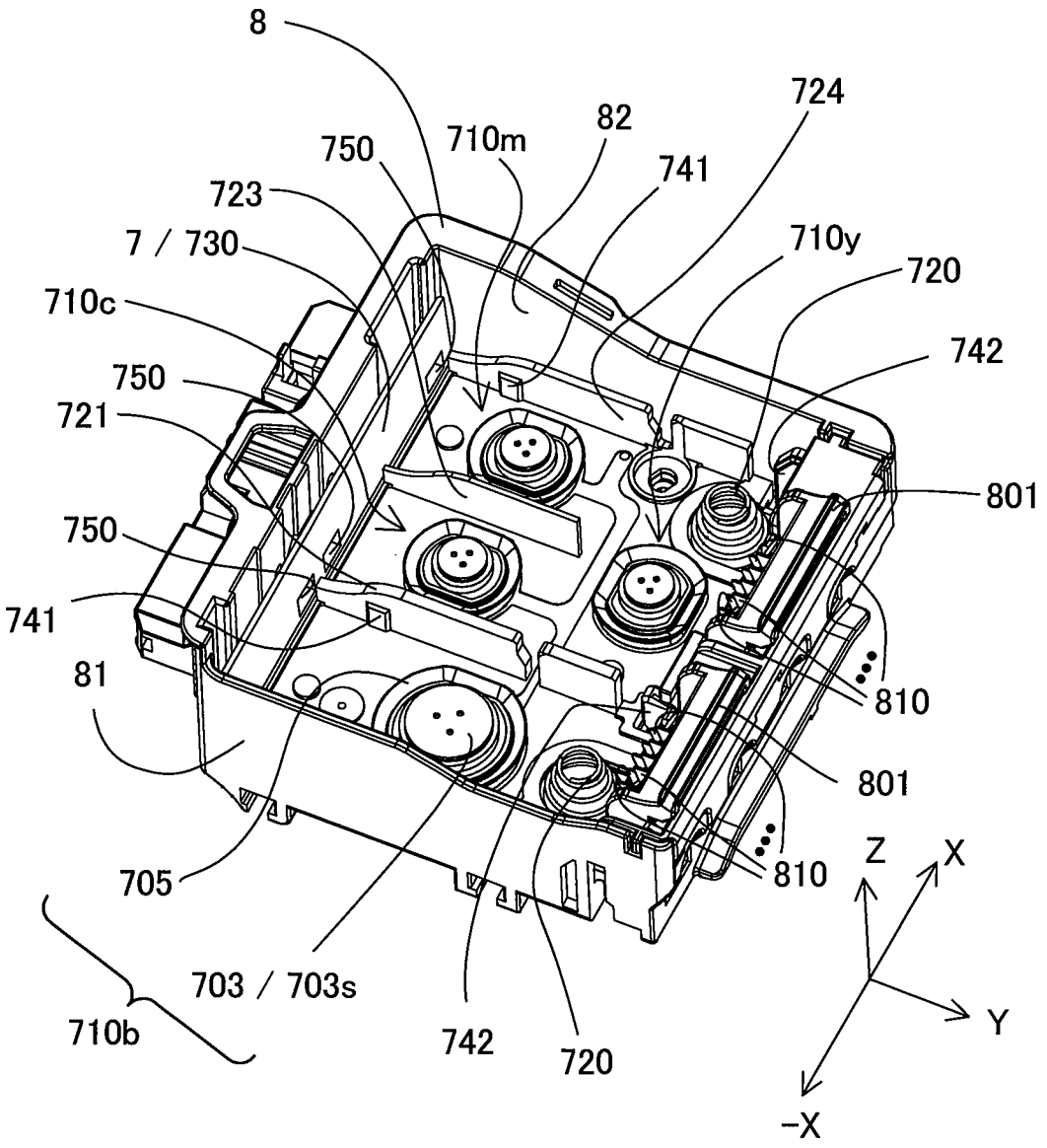
FIG. 4 is a schematic perspective view illustrating the carriage in the non-cartridge attachment state.
Figure 5:
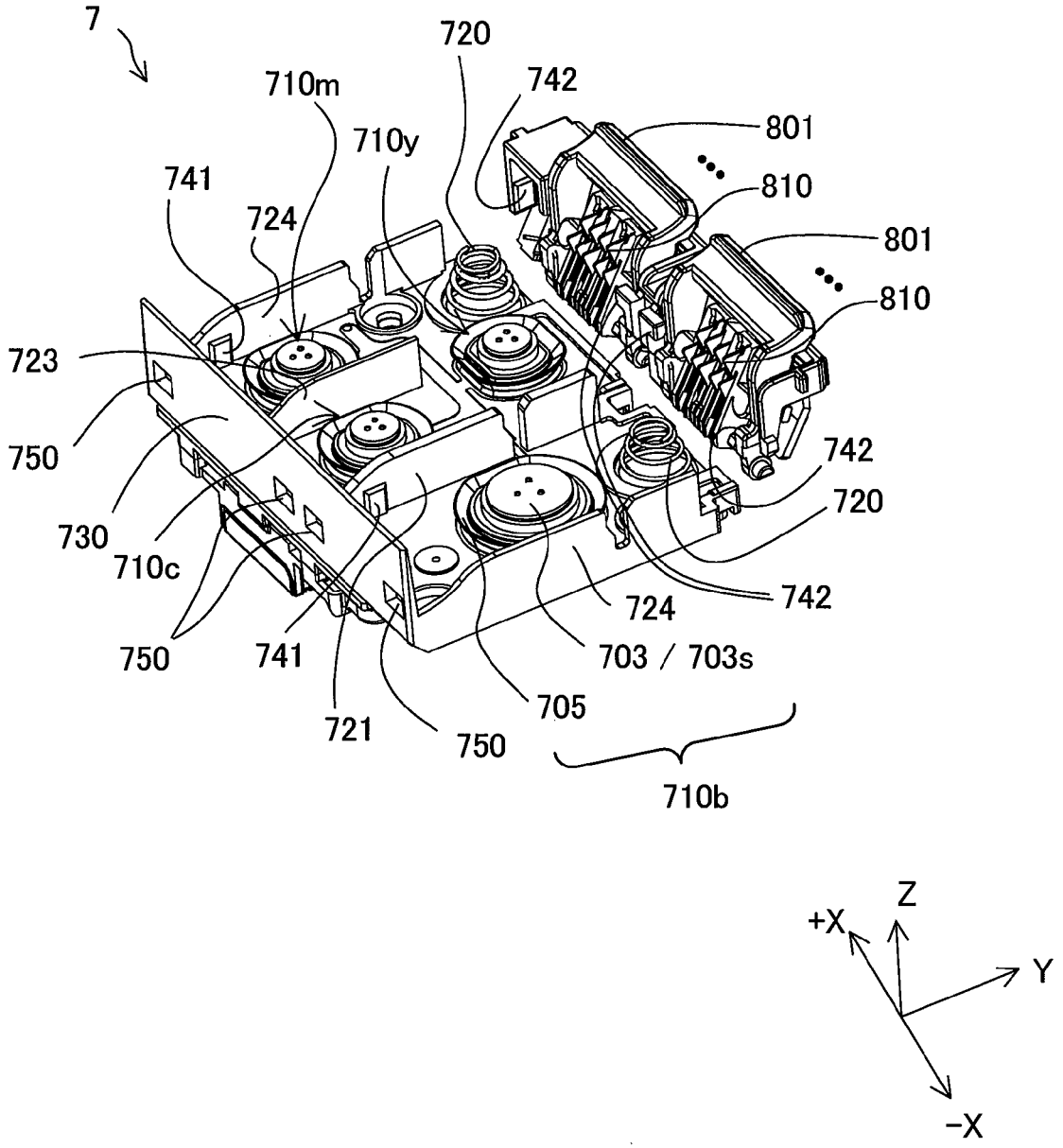
FIG. 5 is a schematic exploded perspective view illustrating a cartridge attachment structure in the non-cartridge attachment state viewed from a direction different from that of FIG. 4.
Figure 7:
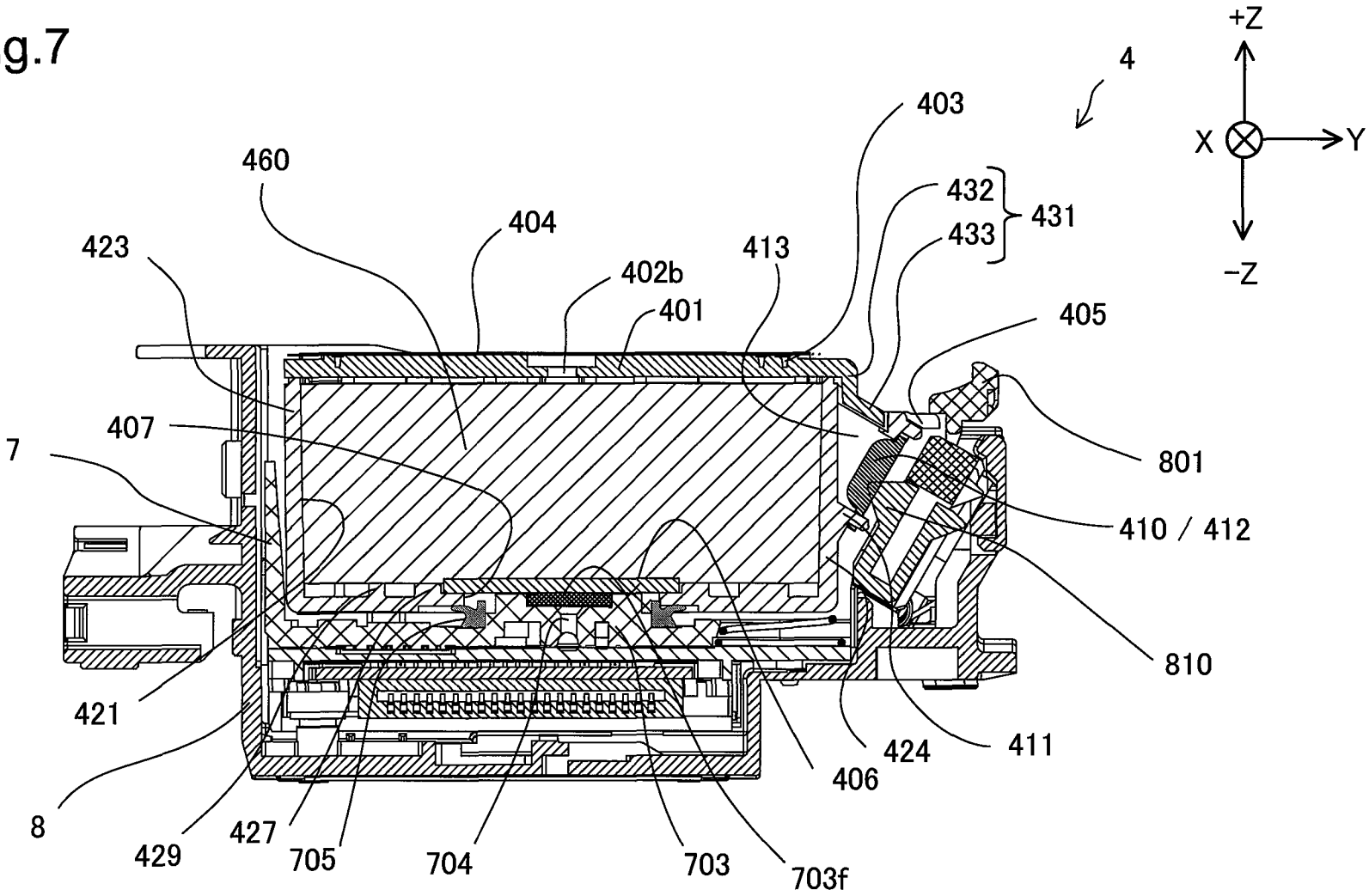
FIG. 7 is a schematic cross sectional view, taken on a line 7-7 in FIG. 3.

FIG. 3 is a perspective view schematically illustrating the appearance of the carriage 8 in the cartridge attachment state. FIG. 4 is a schematic perspective view illustrating the carriage 8 in the non-cartridge attachment state. FIG. 5 is a schematic exploded perspective view illustrating the cartridge attachment structure 7 in the non-cartridge attachment state viewed from a direction different from that of FIG. 4. FIG. 6 is a schematic perspective view illustrating the carriage 8 in the non-cartridge attachment state, viewed from the bottom side. FIG. 7 is a schematic cross sectional view, taken on a line 7-7 in FIG. 3. The cartridge attachment structure 7 is mounted on the bottom of the carriage 8 and is omitted from the illustration of FIG. 3.

As shown in FIG. 3, the cartridges 4 and 5 respectively have covers 401 and 501. The cover 401 has through holes 402*a*, 402*b* and 402*c* formed to pass through the cover 401, an air groove 403 arranged in a serpentine shape from the through hole 402*a* to the through hole 402*b* and an air communication hole 434. The cover 501 has through holes 502*a*, 502*b* and 502*c* formed to pass through the cover 502, air grooves 503 arranged in a serpentine shape from the through hole 502*a* to the through hole 502*b* and air communication holes 534. In the manufacturing process of the cartridge 4, the through hole 402*a* is used as an evacuation hole to suck the air from inside of the cartridge 4 and keep the inside of the cartridge 4 in the reduced pressure. After manufacture of the cartridge 4, the through hole 402*a* is used to supply the air to a liquid retaining member 460 described later through the air groove 403, the through hole 402*b* and the air communication hole 434. In the manufacturing process of the cartridge 4, the through hole 402*c* is used as an ink ejection hole through which ink is injected into inside of the cartridge 4. After manufacture of the cartridge 4, the through hole 402*c* is sealed and closed by a seal member 404. The cartridge 5 is configured to contain the three different color inks, yellow, magenta and cyan as described above and accordingly have the through holes 502*a*, 502*b* and 502*c*, the air grooves 503 and the air communication holes 534 at positions corresponding to respective color ink containing parts described later. The cartridges 4 and 5 respectively have seal members 404 and 504 to be joined with the upper surfaces of the covers 401 and 501 and cover the openings of the above through holes and air grooves.

The cartridge 4 and 5 joined with the seal members 404 and 504 are attached to the carriage 8 via the cartridge attachment structure 7 incorporated in the bottom of the carriage 8, as shown in FIG. 4. In the description hereafter, attachment of the cartridges 4 and 5 to the carriage 8 is considered to be synonymous with attachment of the cartridges 4 and 5 to the cartridge attachment structure 7. In this attachment state, the cartridges 4 and 5 are aligned in the moving direction of the carriage 8 (X-axis direction). In the attachment state, an engagement element 405 described later as an attachment/detaching mechanism included in the cartridge 4 is engaged with a cartridge engagement arm 801 of the carriage 8. The user may apply an external force to the cartridge engagement arm 801 to rotate and displace the cartridge engagement arm 801 and release engagement of the cartridge 4 with the carriage 8. The user can then detach the cartridge 4 from the carriage 8. The cartridge 5 can also be detached from the carriage 8 by the structure and method similar to those described above with respect to the cartridge 4.

As shown in FIG. 4, the carriage 8 has the cartridge attachment structure 7. The cartridge attachment structure 7 includes a liquid introducing part 710*b* for black ink, a liquid introducing part 710*y* for yellow ink, a liquid introducing part 710*m* for magenta ink, a liquid introducing part 710*c* for cyan ink, cone-shaped coil springs 720 and the ejection head 8*s* shown in FIG. 6. The coil springs 720 are placed corresponding to the cartridges 4 and 5. The coil spring 720 is compressed in the cartridge attachment state and is stretched to press up the cartridge 4 or 5 in the state of releasing the engagement of the cartridge engagement arm 801. An elastic member 705 is a member made of, for example, an elastomer and formed in a ring shape and is mounted on an outer wall section of a liquid introducing base 703. The cartridge attachment structure 7 is screwed to the carriage 8.

The respective liquid introducing parts 710 for the respective color inks are provided corresponding to the liquid containing parts of the cartridges 4 and 5 attached to the cartridge attachment structure 7 and have similar structures with some difference in size. The structure of the liquid introducing part 710*b* is described as an example. The liquid introducing part 710*b* includes a liquid introducing base 703, a metal mesh 703*s* and an elastic member 705. The metal mesh 703*s* is provided as a filter made of a metal having corrosion resistance, such as stainless steel and is placed on an upper end of the liquid introducing base 703 to be in surface contact with a supply port-side liquid retaining member 406 of the cartridge 4 described below (FIG. 7). Ink retained in the supply port-side liquid retaining member 406 passes through the metal mesh 703*s* and is supplied to the ejection head 8*s* placed on the rear face of the cartridge attachment structure 7 as shown in FIG. 6. The relationship between the respective liquid introducing parts 710 and the cartridges will be described later.

The cartridge 4 has a circuit substrate 410 on a +Y-direction end, as shown in FIG. 7. This circuit substrate 410 is fixed to a substrate mounting structure 411 inclined with respect to a second end wall 424. Fixation of the circuit substrate 410 to the substrate mounting structure 411 and the location of the circuit substrate 410 will be described later. The circuit substrate 410 provided on the cartridge 4 has terminals 412 described later. In the state of attachment of the cartridge 4 to the carriage 8, contacts of the terminals 412 are electrically in contact with electrodes of an electrode assembly 810 provided on the carriage 8. The cartridge 4 has the engagement element 405 provided on an end of the substrate mounting structure 411 in the Y-axis direction. The engagement element 405 is engaged with the cartridge engagement arm 801 of the carriage 8 in the state of attachment of the cartridge 4 to the carriage 8. The carriage 8 is also called carriage unit including the electrode assembly 810.

FIG. 7 illustrates the state of attachment of the cartridge 4 to the carriage 8. The cartridge 4 has a supply port-side liquid retaining member 406 and a liquid retaining member 460 serving to absorb and retain the liquid. The supply port-side liquid retaining member 406 and the liquid retaining member 460 are arranged to be in contact with each other. The metal mesh 703*s* attached to a ring-shaped end of the liquid introducing base 703 of the liquid introducing part 710*b* provided on the bottom surface of the cartridge attachment structure 7 is in surface contact with the supply port-side liquid retaining member 406. The supply port-side liquid retaining member 406 is lifted up in the +Z direction by the liquid introducing base 703 to press the liquid retaining member 460. This causes the liquid contained in the liquid retaining member 460, i.e., black ink, to be supplied to the ejection head 8*s* of the cartridge attachment structure 7 through the metal mesh 703*s* of the liquid introducing base 703 of the liquid introducing part 710*b* and a suction hole 704. Accordingly, the liquid introducing part 710*b* of the cartridge attachment structure 7 receives a liquid (black ink) introduced from the cartridge 4, and the cartridge attachment structure 7 causes the liquid (black ink) introduced to the liquid introducing part 710*b* to be ejected from the ejection head 8*s*. The cartridge 5 similarly has a circuit substrate 510 and the other relevant components like those of the cartridge 4 and is attached to the carriage 8 as described above.

The cartridge 4 has a liquid supply port 407 covered by the supply port-side liquid retaining member 406. The cartridge attachment structure 7 has the liquid-tight elastic member 705 at the foot of the liquid introducing base 703. This elastic member 705 is in contact with a peripheral concaved area 407*b* (FIG. 11) formed around the periphery of the liquid supply port 407 to seal the liquid supply port 407 and prevent leakage of ink from the liquid supply port 407 in the cartridge attachment state. The liquid supply port 407 is connected with the liquid introducing part 710*b* to supply black ink to the liquid introducing part 710*b* as described later. The structure of attaching the cartridge 4 to the cartridge attachment structure 7 of the carriage 8 will be described later.

The cartridge attachment structure 7 is mounted on the bottom of the carriage 8. As shown in FIGS. 4 and 5, the cartridge attachment structure 7 has an inter-cartridge projection 721 a guide projection 723, and sidewall-side projections 724 extended in the Y-axis direction. In the illustration of FIG. 4, the sidewall-side projection 724 is illustrated inside of a carriage sidewall 82 on the back side of the sheet surface. The carriage 8 also has the sidewall-side projection 724 (not shown) inside of a carriage sidewall 81 on the front side of the sheet surface. Each of the inter-cartridge projection 721 and the sidewall-side projections 724 is extended from an end wall 730 of the cartridge attachment structure 7 toward the cartridge engagement arms 801 and is split in the middle.

The guide projection 723 is extended from the end wall 730 toward the liquid introducing part 710*y* to go between the liquid introducing part 710*m* and the liquid introducing part 710*c*. In other words, this guide projection 723 is formed between the liquid introducing part 710*m* and the liquid introducing part 710*c* adjacent to each other in the X-axis direction to be located between the liquid introducing part 710*y* and a part between the liquid introducing part 710*m* and the liquid introducing part 710*c*. The guide projection 723 has a lower projection height from the bottom surface of the cartridge attachment structure 7 in an area near to the end wall 730 than the projection height between the liquid introducing part 710*m* and the liquid introducing part 710*c*. The cartridge 4 is placed in a mounting area between the sidewall-side projection 724 (not shown) near to the carriage sidewall 81 and the inter-cartridge projection 721 and is attached to the cartridge attachment structure 7 of the carriage 8. The cartridge 5 is placed in a mounting area between the inter-cartridge projection 721 and the sidewall-side projection 724 near to the cartridge sidewall 82 and is attached to the cartridge attachment structure 7 of the carriage 8. The guide projection 723 is placed in a first groove 580 (FIG. 20) of the attached cartridge 5 described later.

The cartridge attachment structure 7 has cartridge first engagement protrusions 741 and cartridge second engagement protrusions 742. The cartridge first engagement protrusions 741 are protruded in a direction along the X axis from the inter-cartridge projection 721 and the sidewall-side projections 724. For example, the cartridge first engagement protrusion 741 protruded in the −X direction from the sidewall-side projection 724 toward the guide projection 723 is located on the end wall 730-side of the electrode assembly 810 in the sidewall-side projection 724 in the mounting area of the cartridge 4 or the cartridge 5 described above. The cartridge first engagement protrusion 741 protruded in the +X direction from the inter-cartridge projection 721 toward the guide projection 723 is located on the end wall 730-side of the electrode assembly 810 in the inter-cartridge projection 721.

These two cartridge first engagement protrusions 741 are arranged to face each other. Due to the perspective direction, the cartridge first engagement protrusion 741 formed on the sidewall-side projection 724 in the mounting area of the cartridge 4 and arranged to face the cartridge first engagement protrusion 741 formed on the inter-cartridge projection 721, as well as the cartridge first engagement protrusion 741 formed on the inter-cartridge projection 721 and arranged to face the cartridge first engagement protrusion 741 formed on the sidewall-side projection 724 in the mounting area of the cartridge 5 are omitted from the illustration of FIGS. 4 and 5.

The cartridge second engagement protrusions 742 are not provided on the cartridge attachment structure 7 but are provided on a mounting base of the electrode assembly 810 provided on the carriage 8. The cartridge second engagement protrusions 742 are protruded in a direction along the X axis in the mounting areas of the cartridges 4 and 5 described above to come into contact with the cartridges 4 and 5 in the +X direction or in the −X direction.

The cartridge first engagement protrusions 741 and the cartridge second engagement protrusions 742 have the positioning function of the attached cartridges in the X-axis direction. The cartridge first engagement protrusions 741 are provided on the cartridge attachment structure 7 and accordingly enhances, for example, the accuracy of the contact in the X-axis direction between the cartridge 4 and the liquid introducing part 710*b* provided on the cartridge attachment structure 7. The cartridge second engagement protrusions 742 are, on the other hand, provided on the mounting base of the electrode assembly 810 and accordingly enhances, for example, the accuracy of the contact in the X-axis direction between the electrode assembly 810 and the terminals 412 of the cartridge 4. The cartridge attachment structure 7 is screwed to the carriage 8, so that there may be an assembly error between the cartridge attachment structure 7 and the carriage 8. The cartridge first engagement protrusions 741 alone have difficulty in enhancing the accuracy of the contact between the terminals 412 of the cartridge 4 and the electrode assembly 810. Additionally using the cartridge second engagement protrusions 742 enhances the accuracy of attachment of the cartridge 4 to the carriage 8.

The cartridge attachment structure 7 also has engagement holes 750 formed in the end wall 730. The two engagement holes 750 are provided for each of the cartridge 4 and the cartridge 5. In the course of attachment of the cartridges 4 and 5, engagement projections 423*t* and 523*t* described later are fit in these engagement holes 750. Attachment and positioning of the cartridges 4 and 5 and the relationship between the guide projection 723 and the cartridge 5 will be described later.

A-3. Structure of Cartridge 4

Figure 8:
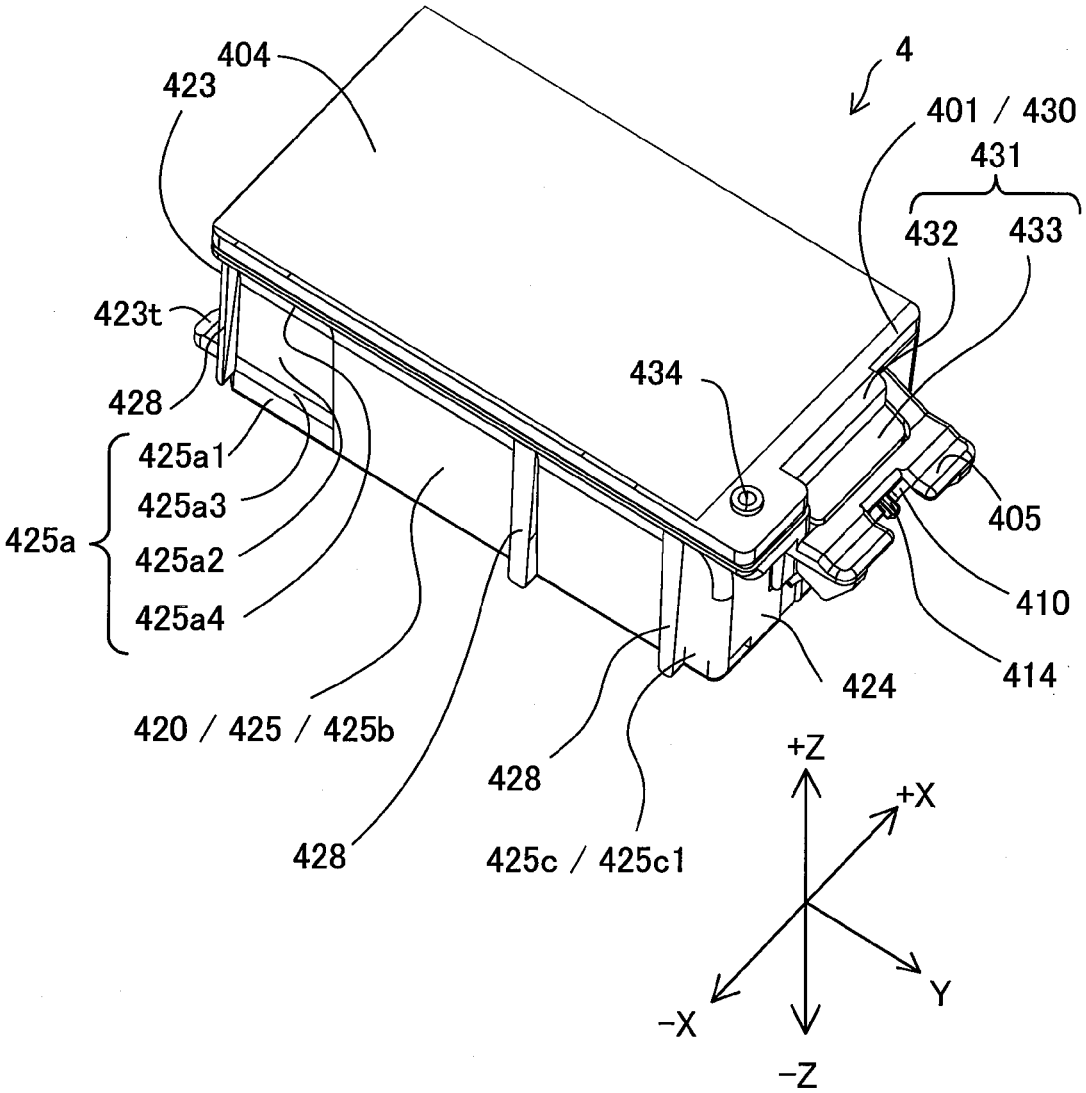
FIG. 8 is an appearance perspective view illustrating a cartridge.
Figure 9:
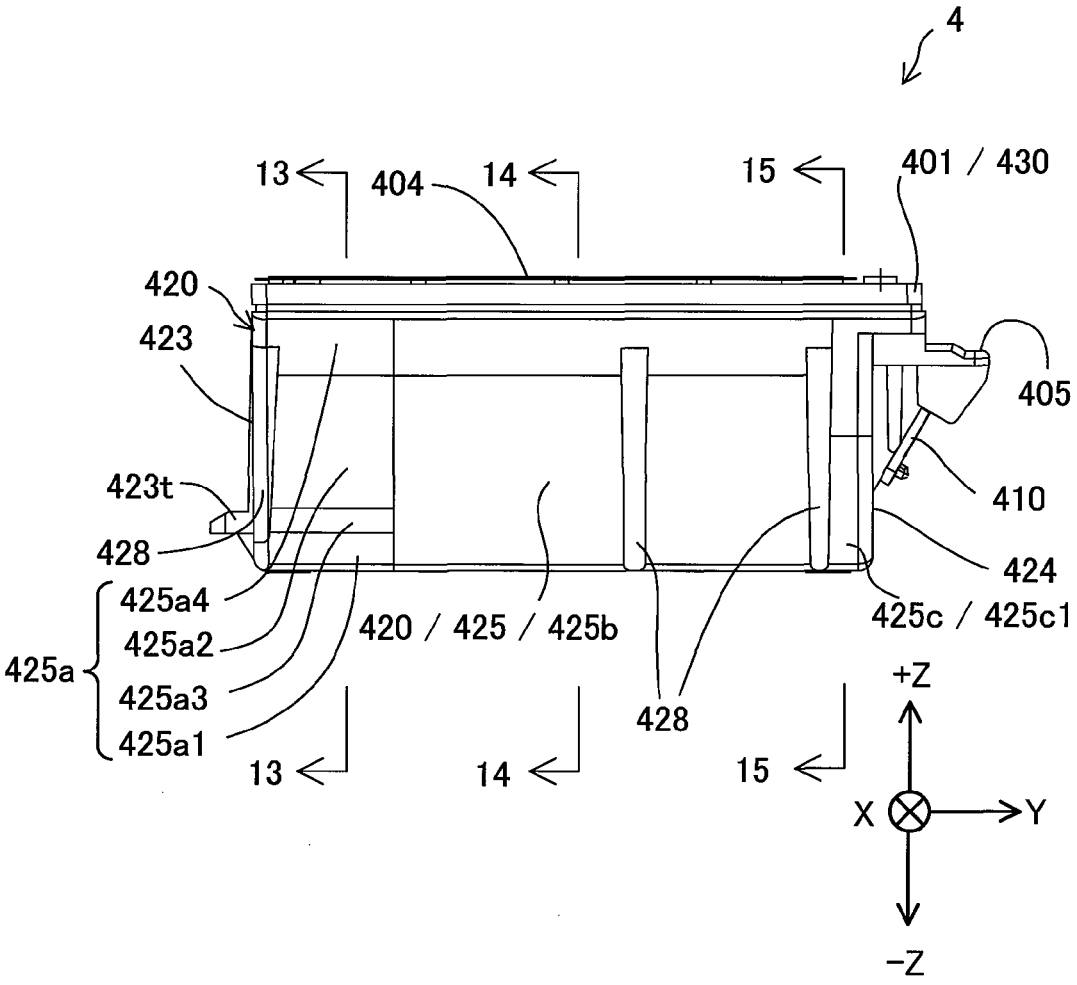
FIG. 9 is a side view illustrating the cartridge of FIG. 8 in an X-axis direction.
Figure 10:
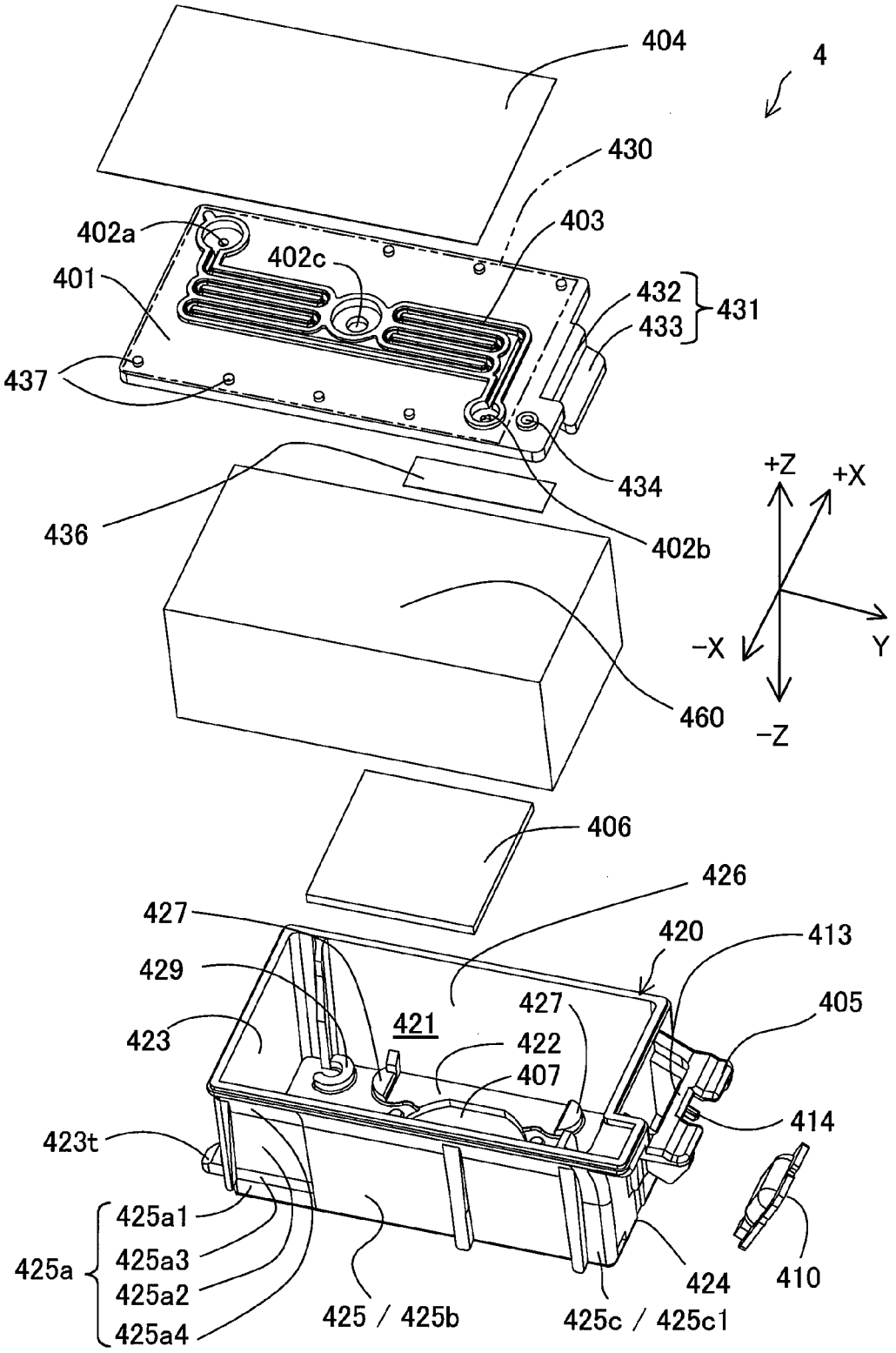
FIG. 10 is an exploded perspective view illustrating the cartridge of FIG. 8.
Figure 11:
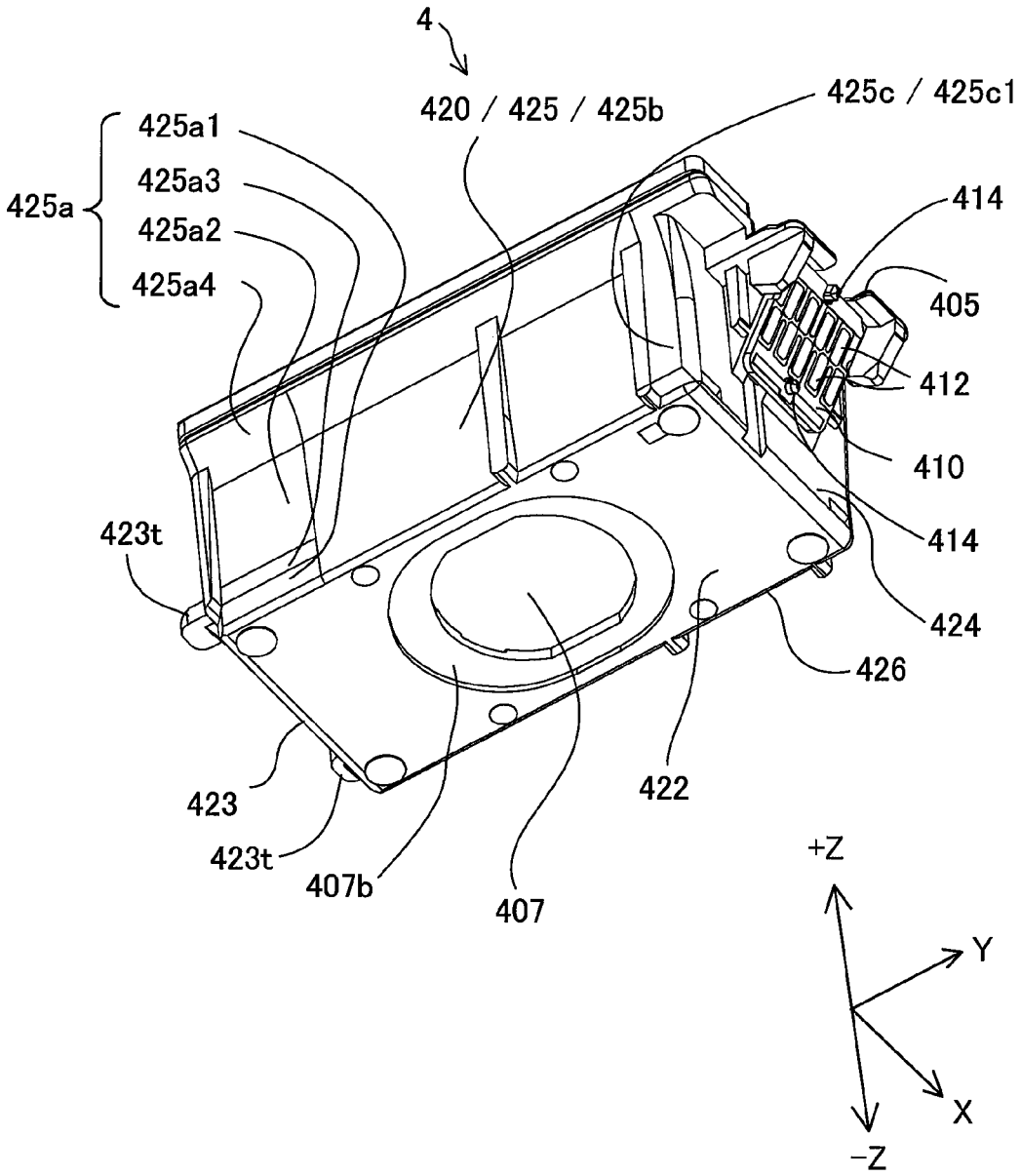
FIG. 11 is an appearance perspective view illustrating the cartridge of FIG. 8 viewed from the bottom side.
Figure 12:
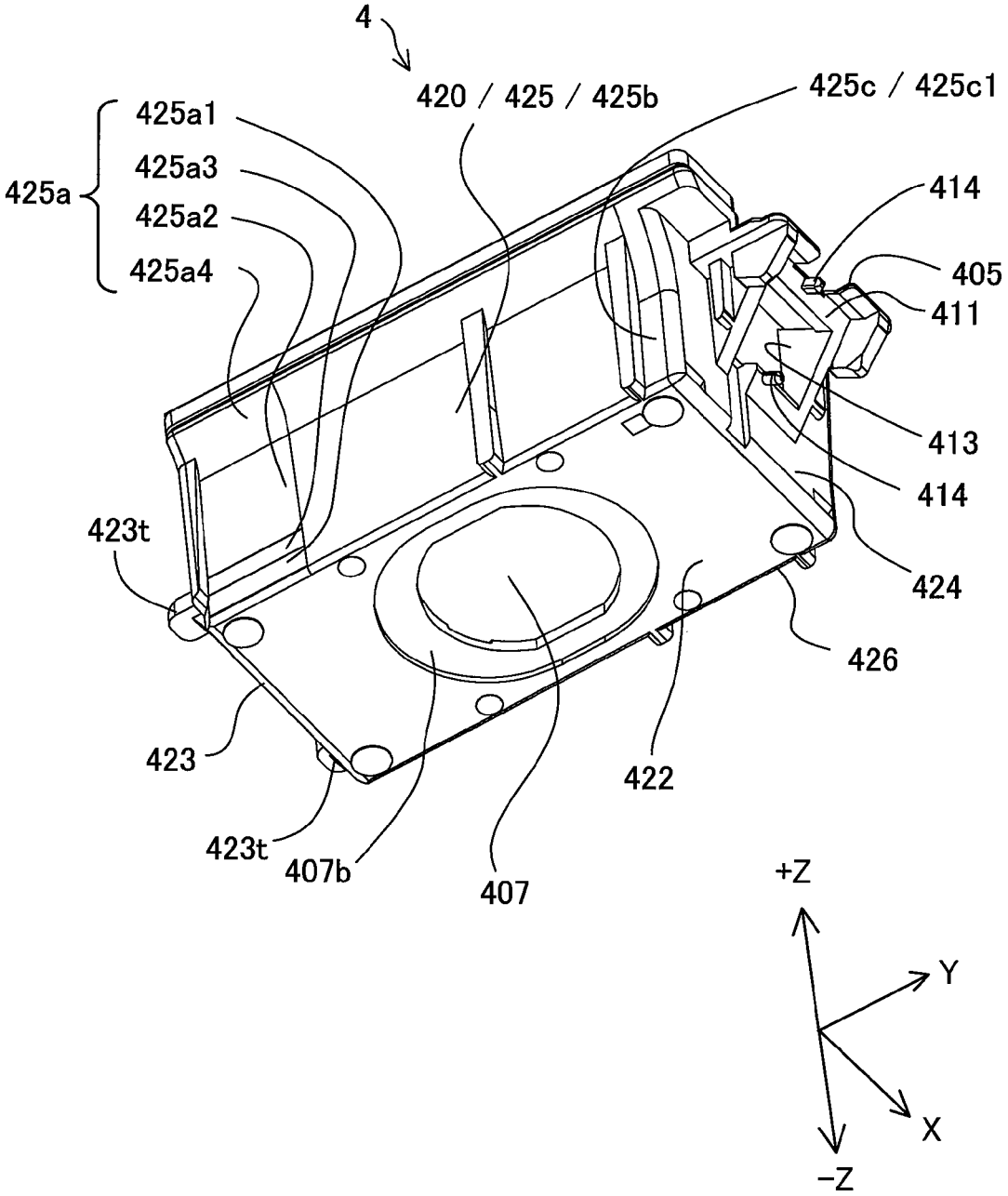
FIG. 12 is an appearance perspective view illustrating the cartridge of FIG. 8 without a circuit substrate viewed from the bottom side.

FIG. 8 is an appearance perspective view illustrating the cartridge 4. FIG. 9 is a side view illustrating the cartridge 4 in the X-axis direction. FIG. 10 is an exploded perspective view illustrating the cartridge 4. FIG. 11 is an appearance perspective view illustrating the cartridge 4 viewed from the bottom side. FIG. 12 is an appearance perspective view illustrating the cartridge 4 without the circuit substrate 410 viewed from the bottom side. As illustrated, the cartridge 4 has a casing 420, the cover 401 and the circuit substrate 410. The cover 401 is fixed to the casing 420 to cover a recess 421 of the casing 420 (FIG. 10). The cartridge 4 also has the supply port-side liquid retaining member 406, the liquid retaining member 460, a cover backside seal member 436 and the seal member 404. The casing 420 and the cover 401 are molded products of a synthetic resin such as polyethylene or polypropylene and are formed by any adequate molding technique such as injection molding.

As shown in FIGS. 8 and 10, the casing 420 includes a bottom wall 422, a first end wall 423, a second end wall 424, a first side wall 425 and a second side wall 426. The outer wall surfaces of the first side wall 425 and the second side wall 426 are reinforced by ribs 428. The bottom wall 422 forms the bottom surface of the casing 420 and has the liquid supply port 407 formed at the center thereof. The bottom wall 422 is opposed to the cover 401 (more specifically a cover member 430 described below). The first end wall 423 rises from the bottom wall 422 to be joined with and intersect with the cover member 430 of the cover 401. The second end wall 424 rises from the bottom wall 422 to be joined with and intersect with the cover member 430 of the cover 401 and is opposed to the first end wall 423. The first side wall 425 rises from the bottom wall 422 between one edge (−X-direction edge in FIG. 10) of the first end wall 423 and one edge (−X-direction edge in FIG. 10) of the second end wall 424 to be joined with and intersect with the cover member 430 of the cover 401. The second side wall 426 rises from the bottom wall 422 between the other edge (+X-direction edge in FIG. 10) of the first end wall 423 and the other edge (+X-direction edge in FIG. 10) of the second end wall 424 to be joined with and intersect with the cover member 430 of the cover 401 and is opposed to the first side wall 425.

This wall configuration may also be expressed as follows. The casing 420 includes the bottom wall 422 located on the bottom in the state that the cartridge 4 is attached to the carriage 8, the cover 401 opposed to the bottom wall 422, the first side wall 425 arranged to intersect with the bottom wall 422 and the cover 401, the second side wall 426 arranged to intersect with the bottom wall 422 and the cover 401 and opposed to the first side wall 425, the first end wall 423 arranged to intersect with the bottom wall 422, the cover 401, the first side wall 425 and the second side wall 426, and the second end wall 424 arranged to intersect with the bottom wall 422, the cover 401, the first side wall 425 and the second side wall 426 and opposed to the first end wall 423. The liquid retaining member 460 and the supply port-side liquid retaining member 406 are placed in the recess 421 surrounded by these walls.

As shown in FIG. 11, the circuit substrate 410 has a plurality of terminals 412 on the substrate surface and is located on the second end wall 424 of the casing 420. The substrate mounting structure 411 is formed on the second end wall 424 as shown in FIG. 12. The substrate mounting structure 411 is arranged to be inclined with respect to the second end wall 424. The circuit substrate 410 has the rear surface fixed to the substrate mounting structure 411 and is inclined with respect to the second end wall 424. As shown in FIG. 11, the terminals 412 are arrayed zigzag in two lines on the circuit substrate 410. When the cartridge 4 is attached to the carriage 8 as described above, the contact portions of the respective terminals 412 are electrically connected with respective electrodes of the electrode assembly 810 provided on the carriage 8 as shown in FIG. 7.

As shown in FIG. 12, the substrate mounting structure 411 has an opening 413 on the outer wall surface side of the second end wall 424. The opening 413 is extended in the Z-axis direction along the outer wall surface of the second end wall 424 from an upper edge side toward a lower edge side of the second end wall 424 (FIG. 10) and is open on the upper edge side and the lower edge side of the second end wall 424. In the state that the cover 401 is fixed to the casing 420, the opening 413 is closed on the upper edge side of the second end wall 424 by an outward extension member 431 of the cover 401 described later as shown in FIG. 8. Projections 414 protruded from the substrate mounting structure 411 are used for fixation of the circuit substrate 410 to the substrate mounting structure 411. The projections 414 are thermally caulked in the state that the projections 414 are extended from the circuit substrate 410 as shown in FIG. 12. This fixes the circuit substrate 410 to the substrate mounting structure 411.

As shown in FIG. 10, the cover 401 has the cover member 430 and the outward extension member 431. The cover member 430 is in a flat plate-like shape and is arranged to cover the recess 421 of the casing 420. The outward extension member 431 is extended outward from the cover member 430 on the second end wall 424-side where the circuit substrate 410 with the terminals 412 is located, and includes a bent extension section 432 and an inclined extension section 433. The bent extension section 432 is bent at approximately 90 degrees to the cover member 430 and is extended to be protruded along a direction from the cover 401 toward the casing 420 (−Z direction in FIG. 10). The inclined extension section 433 continuous with the bent extension section 432 is extended to a location to hang over the terminals 412 of the circuit substrate 410 in the plan view of the cover 401 in the direction from the cover 401 toward the casing 420 (−Z direction in FIG. 10). In the state that the cover 401 is fixed to the casing 420, the outward extension member 431 is hung over the opening 413 to close the opening 413 on the upper edge side of the second end wall 424 as shown in FIG. 12. In the state that the cover 401 is fixed to the casing 420, the inclined extension section 433 of the outward extension member 431 is engaged with the engagement element 405 as shown in FIG. 8. The inclined extension section 433 of the outward extension member 431 is protruded to the outer side of at least the terminals 412 in the lower line of the circuit substrate 410 in a first direction from the first end wall 423 toward the second end wall 424 (+Y direction in FIGS. 7 and 10). In one modification, the inclined extension section 433 may be extended longer than the illustrated state to be protruded to the outer side of all the terminals 412 of the circuit substrate 410.

The cover 401 has the air communication hole 434 and a plurality of seal member receiving elements 437, in addition to the through holes 4021, 402*b* and 402*c* and the air groove 403 described above. The seal member receiving elements 437 are protruded from the upper surface of the cover 401 to substantially the same height as the height of the circumferential walls of the through holes 402*a*, 402*b* and 402*c* and the circumferential wall of the air groove 403 and serve as joint seat elements of the seal member 404.

The air communication hole 434 is provided in a cover member outer periphery formed by extending part of the cover member 430 in the Y-axis direction and is formed to pass through the cover 401 on its cover member outer periphery. The air communication hole 434 is connected with the through hole 402*b* by an air groove (not shown) on the rear surface of the cover 401. This air groove, the cover backside opening of the air communication hole 434 and the cover backside opening of the through hole 402*b* are sealed by the cover backside seal member 436. The recess 421 of the casing 420 closed by the cover 401 is accordingly open to the air through the air communication hole 434 via the through hole 402*a*, the air groove 403 and the through hole 402*b*. This arrangement of open to the air is described in relation to the liquid retaining member 460.

The liquid retaining member 460 is placed in the recess 421 of the casing 420. The bottom wall 422 of the casing 420 has step-like semicircular projections 427 formed on the periphery of the liquid supply port 407, and the supply port-side liquid retaining member 406 is placed on the steps of the semicircular projections 427 (FIG. 7). The liquid supply port 407 is accordingly covered by the supply port-side liquid retaining member 406. The bottom wall 422 also has arc-shaped projections 429 in an open arc shape in the plan view provided in the neighborhood of the respective corners. The liquid retaining member 460 is supported by the upper surfaces of the arc-shaped projections 429 at the respective corners and the semicircular projections 427 and is placed in the casing 420. In the state that the liquid retaining member 460 is placed in this manner, the cover 401 joined with the cover backside seal member 436 and the seal member 404 is welded and fixed to the casing 420 to complete the cartridge 4 shown in FIGS. 7 and 8.

Both the supply port-side liquid retaining member 406 and the liquid retaining member 460 may be made of a porous resin material. The porous resin material herein is not specifically limited but may be any porous resin material having the capacity of retaining the liquid, for example, a foamed material such as polyurethane foam or a fibrous material of bundled polypropylene fibers. The supply port-side liquid retaining member 406 and the liquid retaining member 460 have different characteristics of retaining the liquid. The supply port-side liquid retaining member 406 is made to have a higher pore density or density of pores than the liquid retaining member 460. According to the magnitude relationship of the pore density, the supply port-side liquid retaining member 406 has greater capillary force than the capillary force of the liquid retaining member 460.

This magnitude relationship of the capillarity force between the supply port-side liquid retaining member 406 and the liquid retaining member 460 causes ink contained in the liquid retaining member 460 to flow in the sequence described below. Ink flows from a member having smaller capillary force to a member having greater capillary force. As shown in FIG. 6, when ink contained in the supply port-side liquid retaining member 406 is sucked via the liquid introducing base 703 to be consumed, ink contained in the liquid retaining member 460 laid on the upper surface of the supply port-side liquid retaining member 406 moves to the supply port-side liquid retaining member 406. The driving force of such ink migration is mainly given by the capillary force of the supply port-side liquid retaining member 406. Such ink migration has no difficulty, due to the air communication through the through hole 402*a* formed corresponding to the location where the liquid retaining member 460 is placed, the air groove 403 continuous with the through hole 402*a* and the air communication hole 434.

Placing the supply port-side liquid retaining member 406 and the liquid retaining member 460 having different characteristics in the recess 421 of the casing 420 as described above, in combination with using the metal mesh 703*s* having greater capillary force than the capillarity force of the supply port-side liquid retaining member 406 for the liquid introducing base 703, allows for efficient consumption of ink contained in the liquid retaining member 460. In other words, this reduces the remaining quantity of unused ink in the liquid retaining member 460.

As long as the capillary forces of the supply port-side liquid retaining member 406 and the liquid retaining member 460 are arranged to decrease with an increase in distance from the liquid introducing base 703, the magnitude relationship of the pore density between the respective liquid retaining members 406 and 460 is not limited to the configuration of this embodiment. For example, when the supply port-side liquid retaining member 406 and the liquid retaining member 460 have identical pore densities, the respective liquid retaining members 406 and 460 may be subjected to water repellent treatment or hydrophobic treatment to have the magnitude relationship of the capillary force described above.

The cartridge 4 also has a pair of engagement projections 423*t* at the lower edge of the outer wall surface of the first end wall 423. In the course of attachment of the cartridge 4 to the cartridge attachment structure 7, the engagement projections 423*t* enter the end wall 730 of the cartridge attachment structure 7 (FIG. 4) and are involved in positioning of the cartridge 4.

Figure 13:
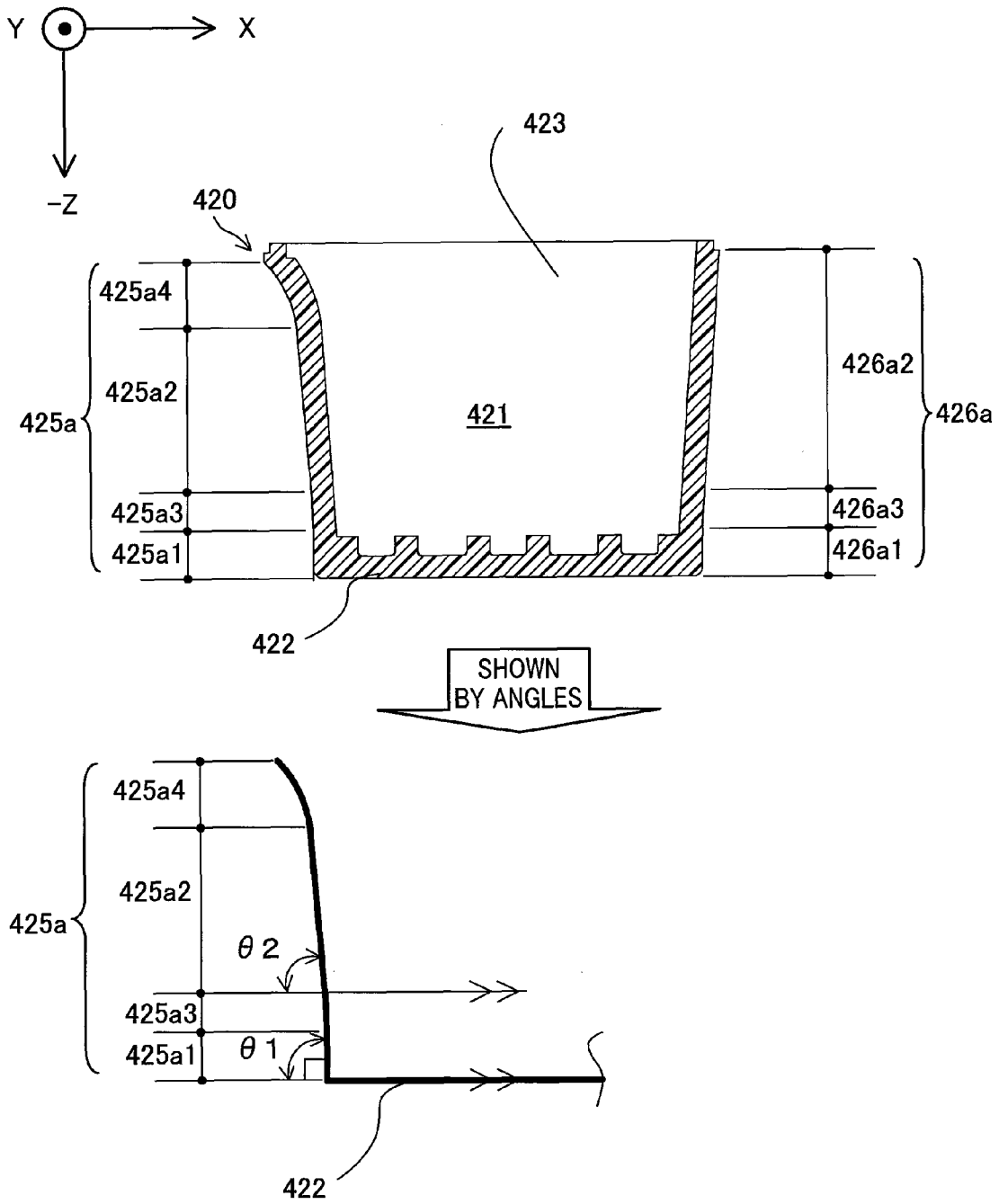
FIG. 13 is a diagram schematically illustrating a cross section and a wall surface angle of a first side wall part of a casing, taken on a line 13-13 in FIG. 9.
Figure 14:
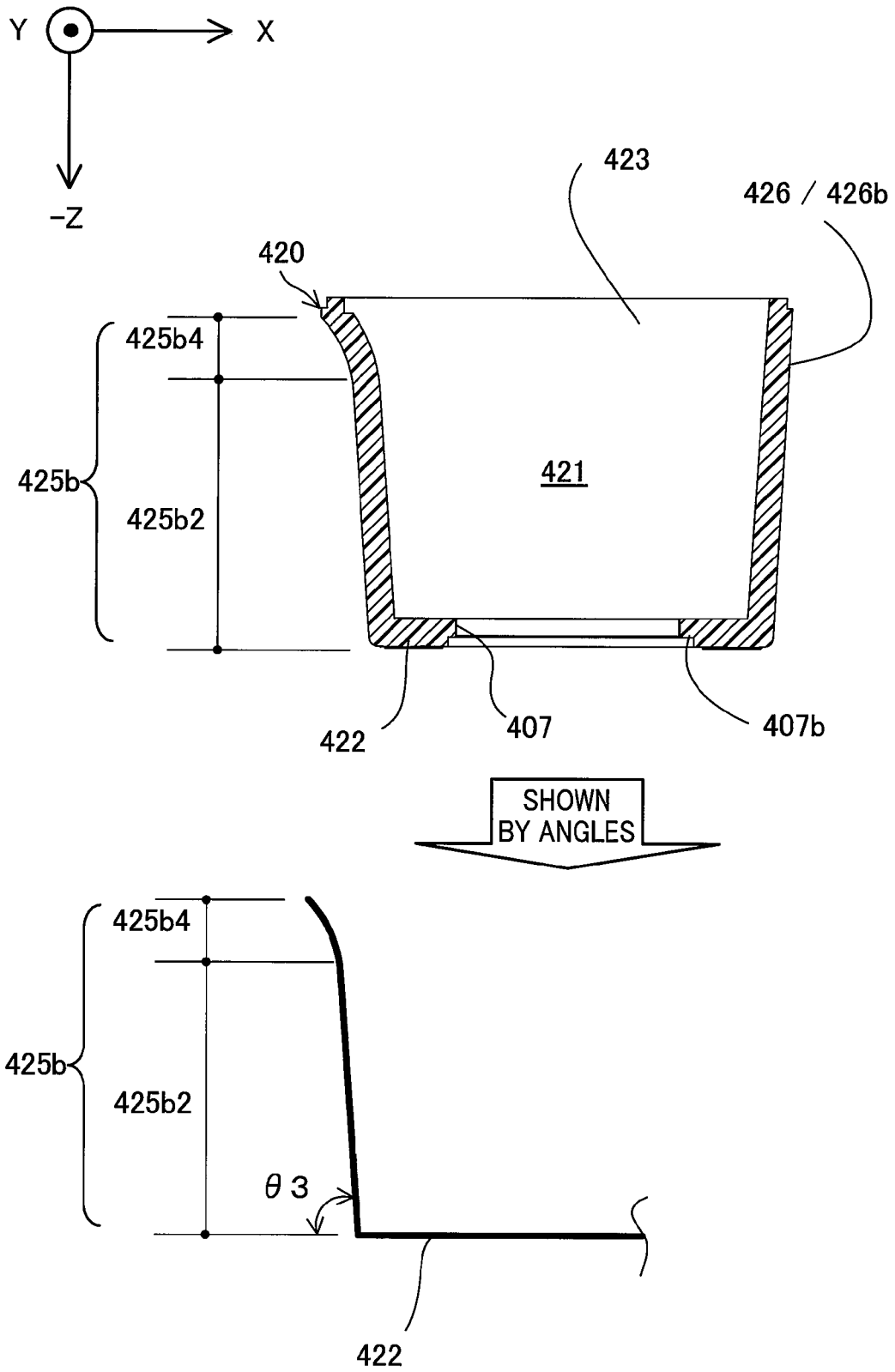
FIG. 14 is a diagram schematically illustrating a cross section and a wall surface angle of a second side wall part of the casing, taken on a line 14-14 in FIG. 9.
Figure 15:
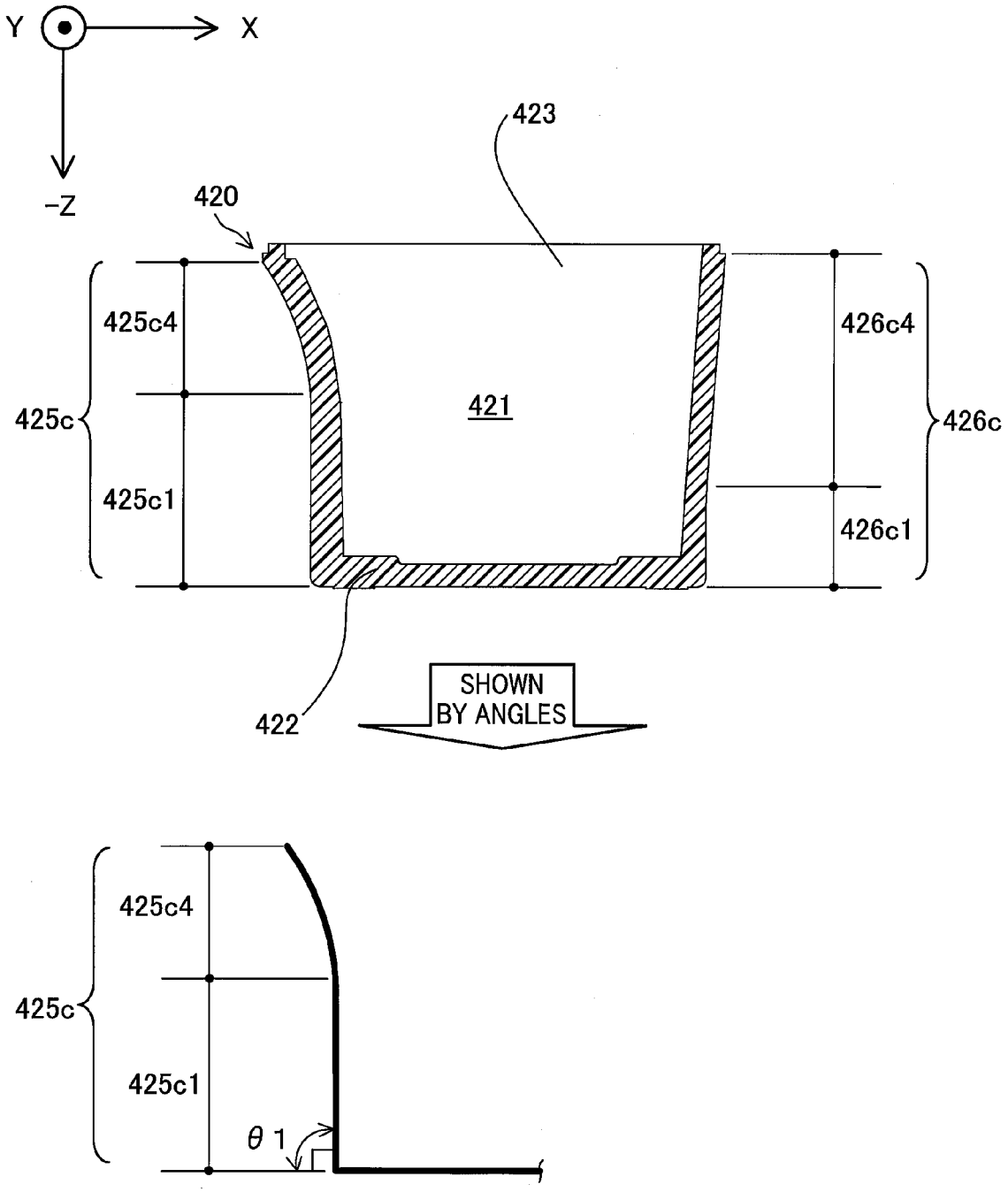
FIG. 15 is a diagram schematically illustrating a cross section and a wall surface angle of a third side wall part of the casing, taken on a line 15-15 in FIG. 9.
Figure 16:
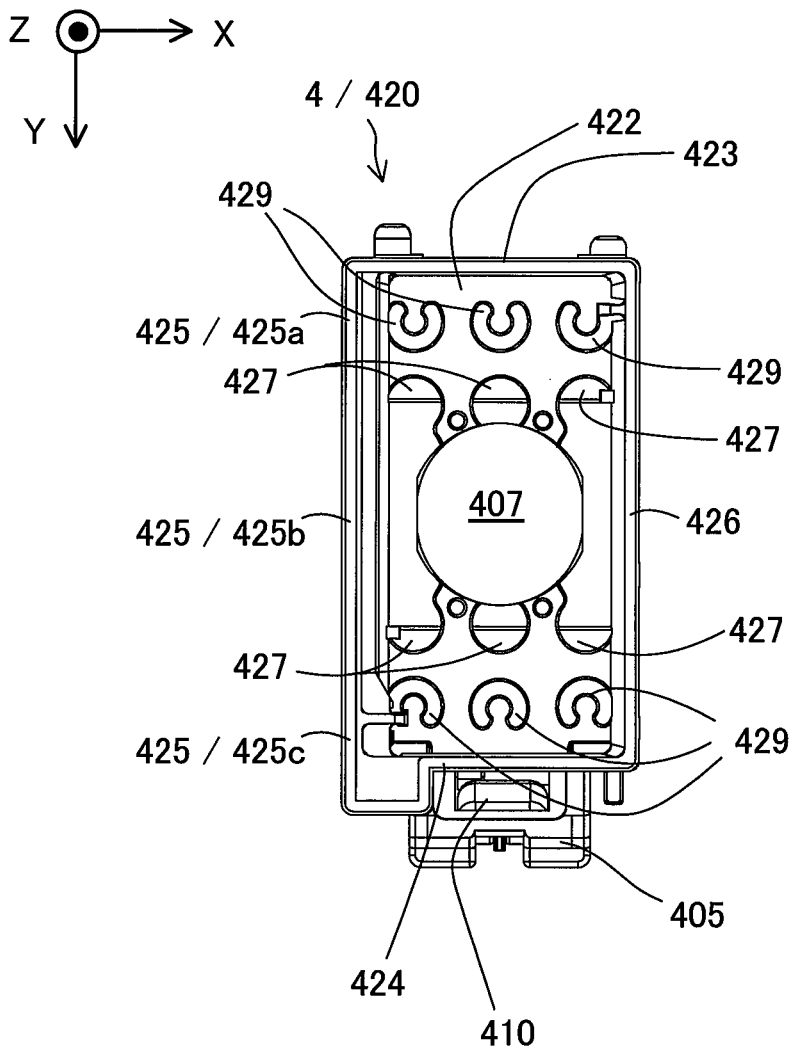
FIG. 16 is a plan view of the casing in a direction from a cover toward a bottom wall.

The following describes the casing configuration involved in positioning of the carriage 8 or more specifically the cartridge attachment structure 7 mounted on the carriage 8. As illustrated in FIGS. 8 to 12, the first side wall 425 of the casing 420 includes a first side wall part 425*a*, a second side wall part 425*b* and a third side wall part 425*c* sequentially aligned from the first end wall 423-side in the first direction from the first end wall 423 toward the second end wall 424 (Y direction). The first side wall part 425*a* occupies about one third of the width of the first side wall 425 in the first direction, and the third side wall part 425*c* occupies the area between the rib 428 and the second end wall 424. The second side wall part 425*b* occupies the remaining area. In other words, the second side wall part 425*b* is wider than the first side wall part 415*a* in the above first direction and is placed between the first side wall part 425*a* and the third side wall part 425*c*. FIG. 13 is a diagram schematically illustrating a cross section and a wall surface angle of the first side wall part 425*a* of the casing 420, taken on a line 13-13 in FIG. 9. FIG. 14 is a diagram schematically illustrating a cross section and a wall surface angle of the second side wall part 425*b* of the casing 420, taken on a line 14-14 in FIG. 9. FIG. 15 is a diagram schematically illustrating a cross section and a wall surface angle of the third side wall part 425*c* of the casing 420, taken on a line 15-15 in FIG. 9. FIG. 16 is a plan view of the casing 420 in a direction from the cover 401 toward the bottom wall 422.

As shown in FIGS. 8 to 12 and FIG. 13, the first side wall part 425*a* includes a first side wall area 425*a*1, a second side wall area 425*a*2, a third side wall area 425*a*3 and a fourth side wall area 425*a*4. The first side wall area 425*a*1 is located on the bottom wall 422-side and is extended to be substantially perpendicular to the bottom wall 422. In other words, the outer surface of the first side wall part 425*a* defined by the first side wall area 425*a*1 is substantially perpendicular to the bottom wall 422. The second side wall area 425*a*2 is extended to be inclined with respect to the bottom wall 422. The third side wall area 425*a*3 is located between the first side wall area 425*a*1 and the second side wall area 425*a*2 and forms a curved surface connecting the first side wall area 425*a*1 with the second side wall area 425*a*2. The fourth side wall area 425*a*4 is located on the cover 401-side, i.e., on the opening side of the casing 420 and forms a curved surface. Forming the curved surface by the third side wall area 425*a*3 smoothly connects the first side wall area 425*a*1 with the second side wall area 425*a*2 without a step. This reduces a potential trouble that the connecting area between the first side wall area 425*a*1 and the second side wall area 425*a*2 is stuck on the sidewall-side projection 724 and interferes with the smooth attachment operation in the course of attachment of the cartridge 4. As shown in FIG. 13, an angle θ1 of the first side wall area 425*a*1 with respect to the bottom wall 422 (approximately 90 degrees) is set to be greater than an angle θ2 of the second side wall area 425*a*2 with respect to the bottom wall 422. The third side wall area 425*a*3 has a smaller wall thickness than the wall thicknesses of the first side wall area 425*a*1 and the second side wall area 425*a*2.

As shown in FIGS. 8 to 12 and FIG. 14, the second side wall part 425*b* is extended from the bottom wall 422 to be inclined with respect to the bottom wall 422 and has it inclined range as a second side wall area 425*b*2. The upper edge of this second side wall area 425*b*2 is continuous with a fourth side wall area 425*b*4 on the opening side of the casing 420. This fourth side wall area 425*b*4 has the same shape as that of the fourth side wall area 425*a*4 of the first side wall part 425*a* and is continuous with the fourth side wall area 425*a*4. The second side wall area 425*b*2 is adjacent to the first side wall area 425*a*1, the second side wall area 425*a*2 and the third side wall area 425*a*3 of the first side wall part 425*a*. As shown in FIG. 14, an angle θ3 of the second side wall area 425*b*2 of the second side wall part 425*b* with respect to the bottom wall 422 is set to be greater than the angle θ2 of the second side wall area 425*a*2 of the first side wall part 425*a* with respect to the bottom wall 422. In combination with the second side wall part 425*b* wider than the first side wall part 425*a* in the Y direction, the liquid supply port 407 is located between the second side wall part 425*b* of the first side wall 425 and the second side wall 426 in the plan view of the casing 420 in the direction from the cover 401 toward the bottom wall 422 as shown in FIG. 16.

As shown in FIGS. 8 to 12 and FIG. 15, the third side wall part 425*c* includes a first side wall area 425*c*1 and a fourth side wall area 425*c*4. The first side wall area 425*c*1 is located on the bottom wall 422-side and is extended to be substantially perpendicular to the bottom wall 422. A region of the fourth side wall area 425*c*4 on the opening side of the casing 420 has the same shape as those of the fourth side wall area 425*a*4 of the first side wall part 425*a* and the fourth side wall area 425*b*4 of the second side wall part 425*b* and is continuous with the fourth side wall areas 425*a*4 and 425*b*4. The first side wall area 425*c*1 is adjacent to the second side wall area 425*b*2 of the second side wall part 425*b*.

The second side wall 426 also includes a first side wall part 426*a*, a second side wall part 426*b* and a third side wall part 426*c* aligned in the first direction from the first end wall 423 toward the second end wall 424 (Y direction). As shown in FIGS. 13 to 15, the first side wall part 426*a* is opposed to the first side wall part 425*a* of the first side wall 425. The second side wall part 426*b* is opposed to the second side wall part 425*b* of the first side wall 425. The third side wall part 426*c* is opposed to the third side wall part 425*c* of the first side wall 425. As shown in FIG. 13, the first side wall part 426*a* includes a first side wall area 426*a*1, a second side wall area 426*a*2 and a third side wall area 426*a*3. The first side wall area 426*a*1 is located on the bottom wall 422-side and is extended to be substantially perpendicular to the bottom wall 422. The first side wall area 426*a*1 and the first side wall area 425*a*1 of the first side wall 425 are positioned back to back across the bottom wall 422. The second side wall area 426*a*2 is extended to the opening of the casing 420 to be inclined at a constant angle with respect to the bottom wall 422. The second side wall area 426*a*2 and the second side wall area 425*a*2 of the first side wall 425 are positioned back to back. The third side wall area 426*a*3 is extended from the first side wall area 426*a*1 to the second side wall area 426*a*2 and forms a curved surface of connecting the first side wall area 426*a*1 with the second side wall area 426*a*2. The third side wall area 426*a*3 and the third side wall area 425*a*3 of the first side wall 425 are positioned back to back. The first side wall part 426*a* has a plane on the inner circumferential wall surface.

As shown in FIG. 14, the second side wall part 426*b* is extended from the bottom wall 422 to be inclined with respect to the bottom wall 422 and is adjacent to the first side wall part 426*a*. As shown in FIG. 15, the third side wall part 426*c* includes a first side wall area 426*c*1 and a fourth side wall area 426*c*4. The first side wall area 426*c*1 is located on the bottom wall 422-side and is extended to be substantially perpendicular to the bottom wall 422. The first side wall area 426*c*1 and the first side wall area 425*c*1 of the first side wall 425 is positioned back to back across the bottom wall 422. The fourth side wall area 426*c*4 is adjacent to the second side wall part 426*b*.

A-4. Structure of Cartridge 5

Figure 17:
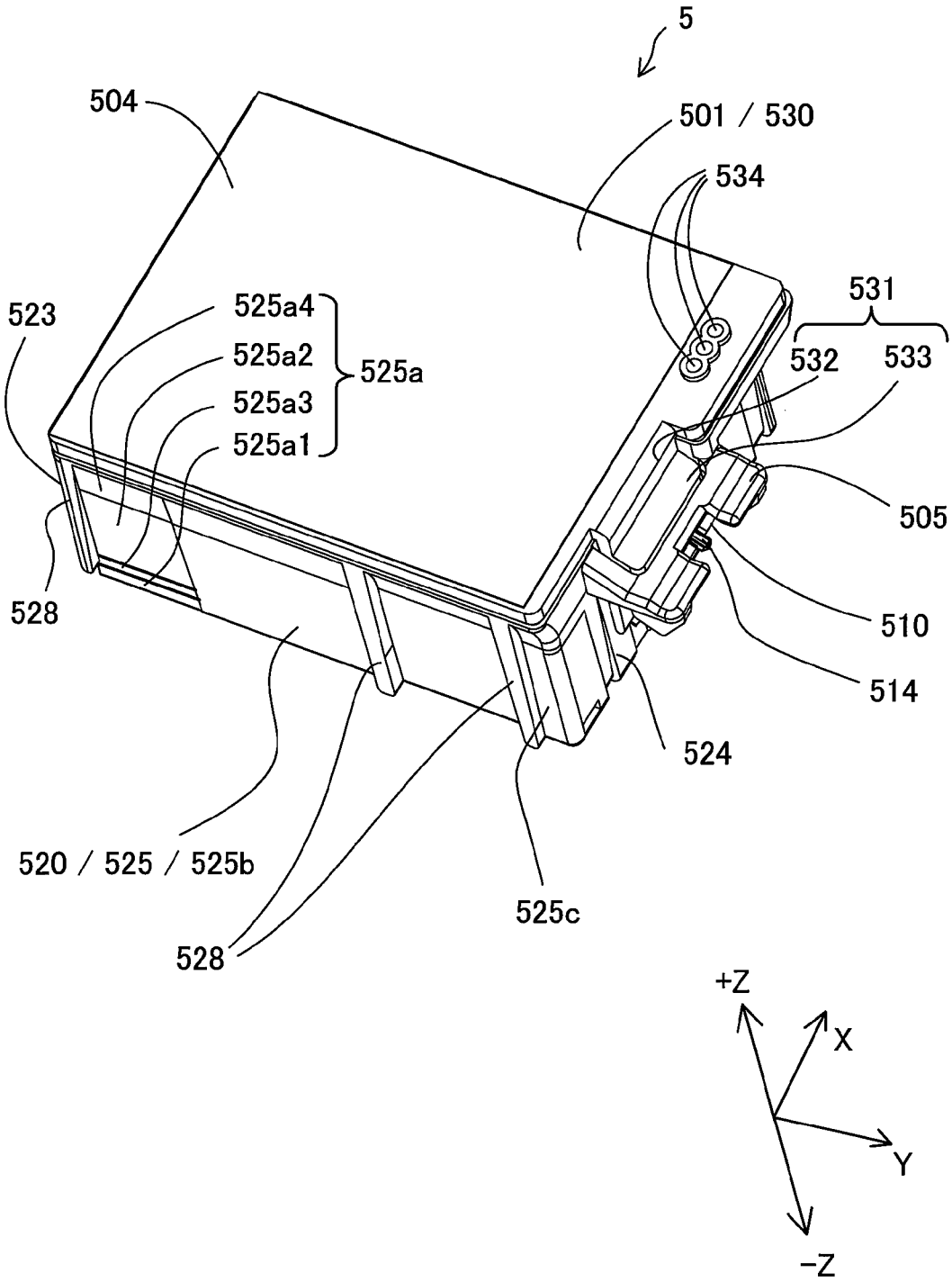
FIG. 17 is an appearance perspective view illustrating another cartridge.
Figure 18:
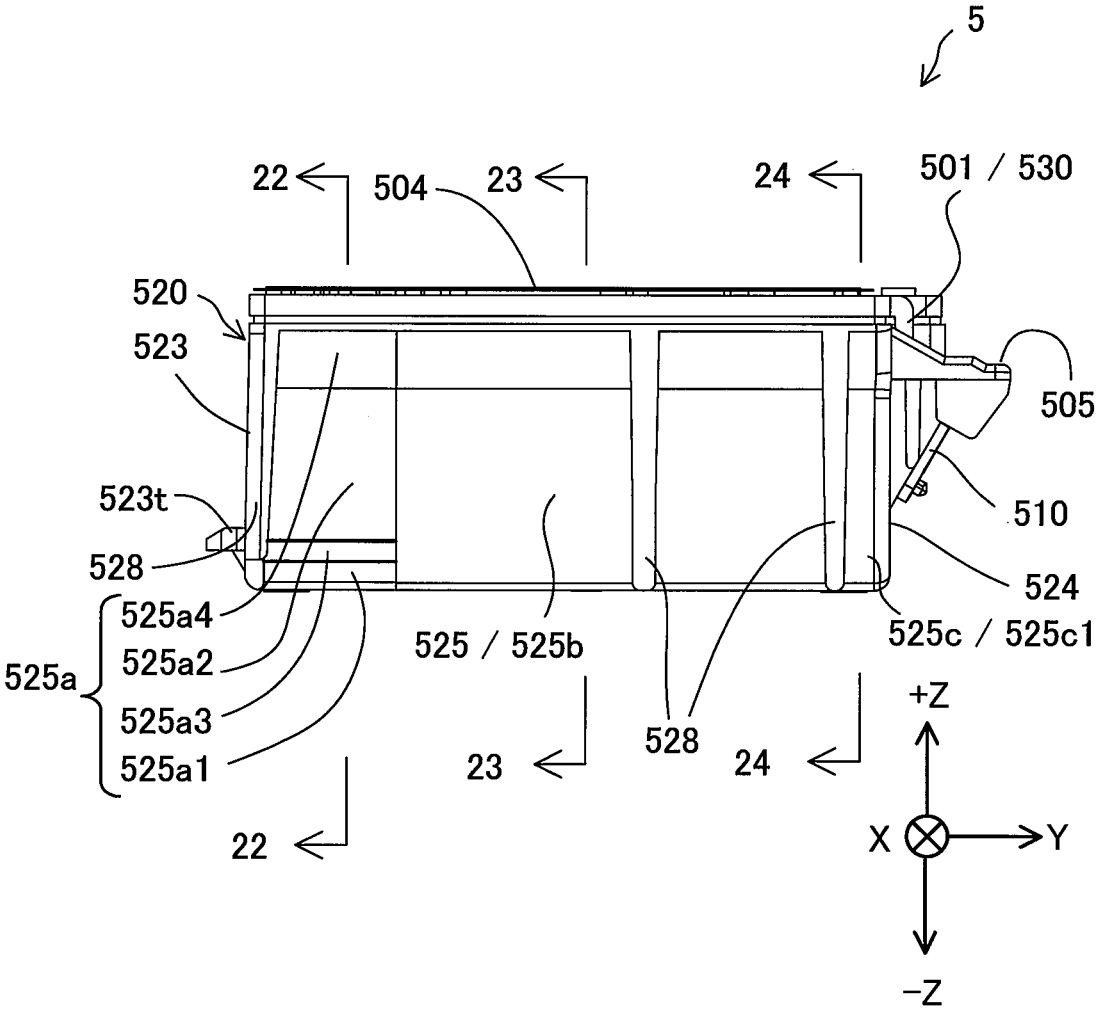
FIG. 18 is a side view illustrating the cartridge of FIG. 17 in the X-axis direction.
Figure 19:
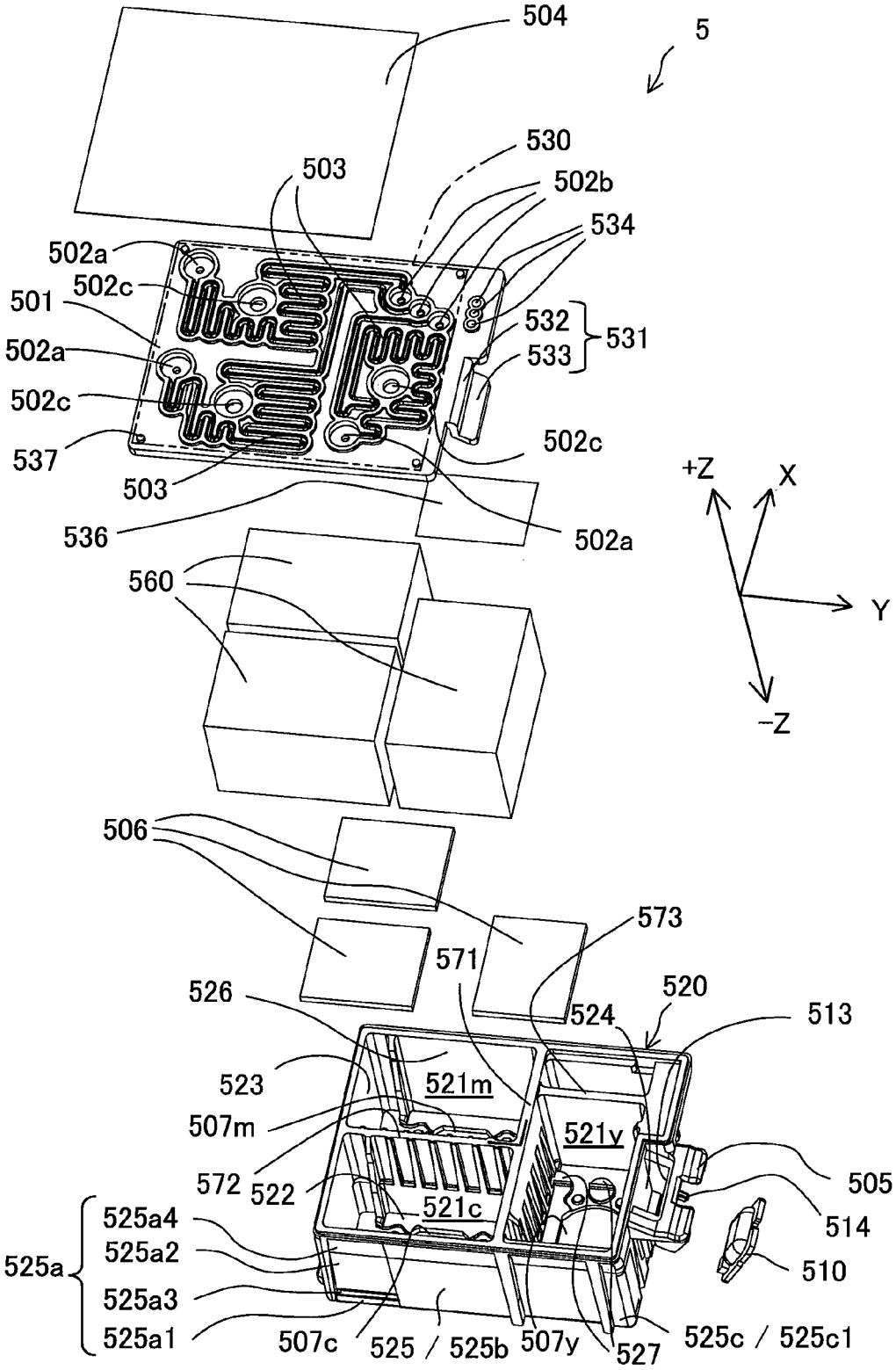
FIG. 19 is an exploded perspective view illustrating the cartridge of FIG. 17.
Figure 20:
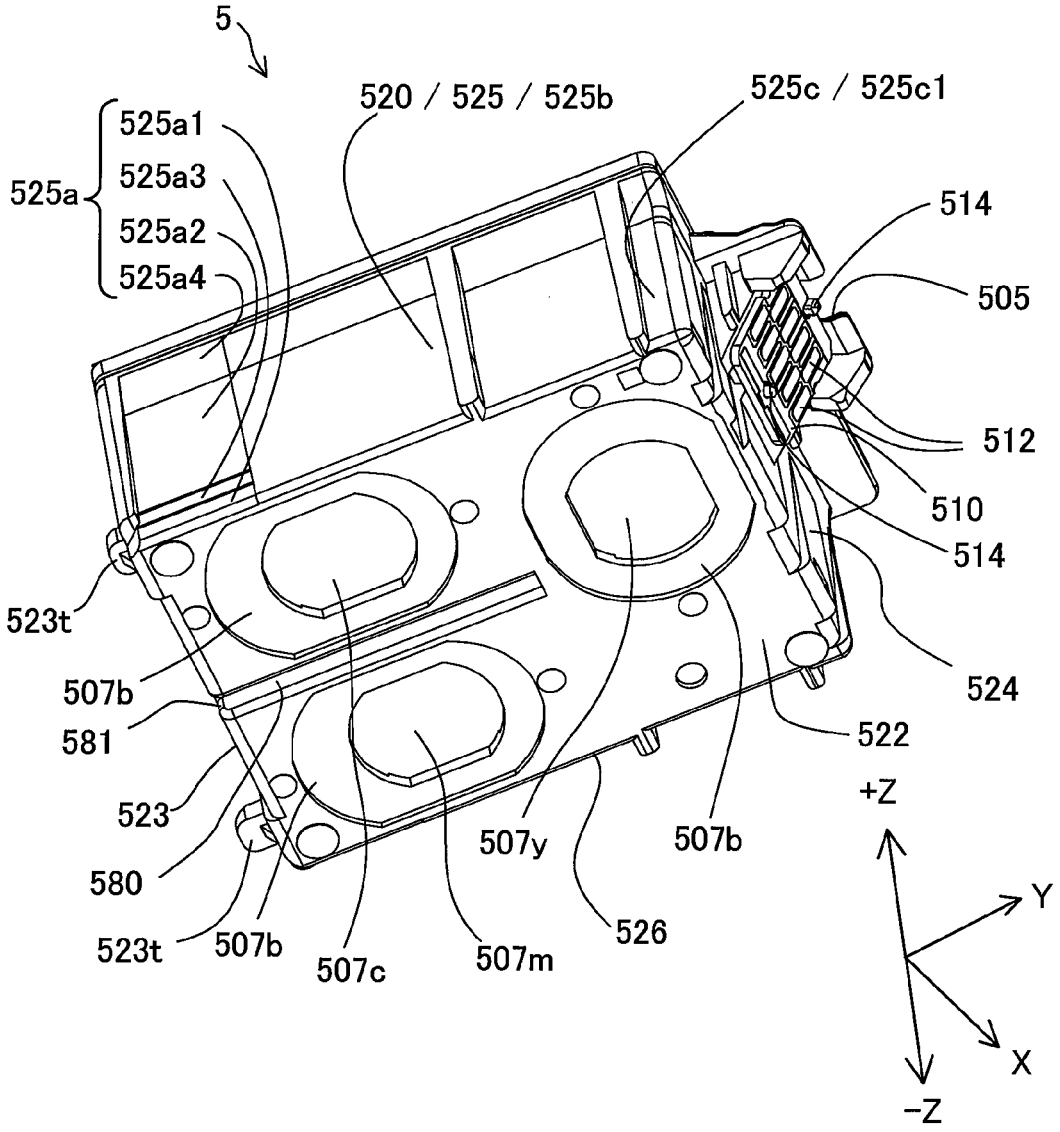
FIG. 20 is an appearance perspective view illustrating the cartridge of FIG. 17 viewed from the bottom side.
Figure 21:
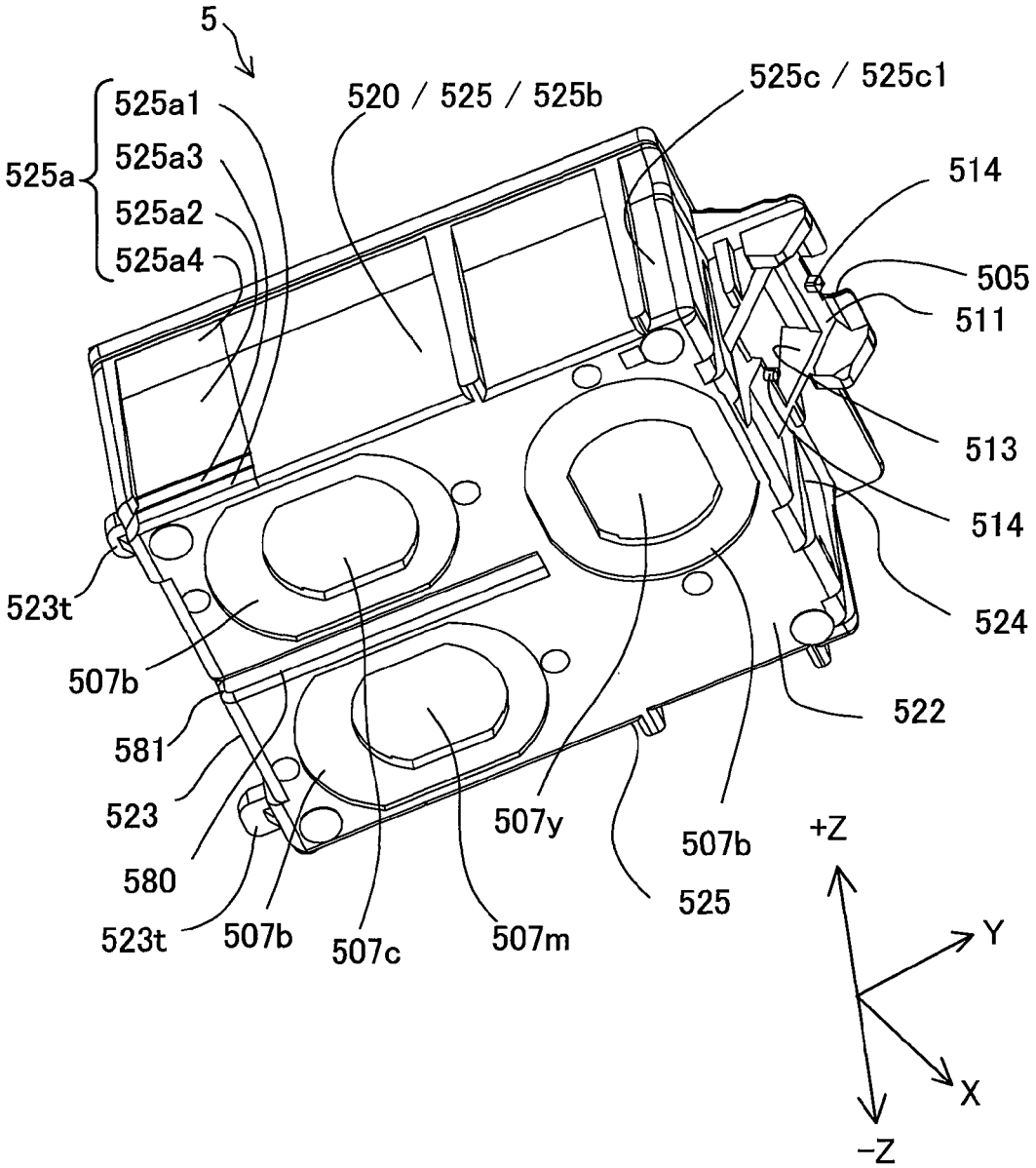
FIG. 21 is an appearance perspective view illustrating the cartridge of FIG. 17 without a circuit substrate viewed from the bottom side.

The cartridge 5 has the different structure from that of the cartridge 4 by containing three different color inks, yellow, magenta and cyan. In the description of the structure of the cartridge 5, the like components to those of the cartridge 4 are expressed by like numerical symbols with the digit at a highest place changed to 5 and are only briefly explained. FIG. 17 is an appearance perspective view illustrating the cartridge 5. FIG. 18 is a side view illustrating the cartridge 5 in the X-axis direction. FIG. 19 is an exploded perspective view illustrating the cartridge 5. FIG. 20 is an appearance perspective view illustrating the cartridge 5 viewed from the bottom side. FIG. 21 is an appearance perspective view illustrating the cartridge 5 without the circuit substrate 510 viewed from the bottom side.

As illustrated, the cartridge 5 has a casing 520, the cover 501 and the circuit substrate 510. The cover 501 is fixed to the casing 520 to cover three recesses 521*m*, 521*c* and 521*y* of the casing 520 (FIG. 19). The casing 520 has a partition wall 571 located between a first side wall 525 and a second side wall 526, a partition wall 572 located between the partition wall 571 and a first end wall 523 and a partition wall 573 located between the partition wall 571 and a second end wall 524. These partition walls 571, 572 and 573 form the recesses 521*m*, 521*c* and 521*y* corresponding to the respective color inks, magenta, cyan and yellow. The cartridge 5 has supply port-side liquid retaining members 506 placed in respective areas defined by semicircular projections 527 provided on the respective peripheries of ink supply ports 507*m*, 507*y* and 507*c* formed in a bottom wall 522 in the respective recesses 521*m*, 521*c* and 521*y*, and also has liquid retaining members 560 placed on the supply port-side liquid retaining members 506.

The partition walls 571, 572 and 573 and the recesses 521*m* 521*c* and 521*y* have the following positional relationship in the state that the cover 501 is joined with the casing 520. The partition wall 571 is located to intersect with the bottom wall 522, the cover 501, the first side wall 525 and the second side wall 526 and to be opposed to the first end wall 523 and the second end wall 524. The partition wall 572 is located to intersect with the bottom wall 522, the cover 501, the first end wall 523 and the partition wall 571 and to be opposed to the first side wall 525 and the second side wall 526. The recess 521*m* communicating with the ink supply port 507*m* is defined by the bottom wall 522, the cover 501, the first end wall 523, the second side wall 526, the partition wall 571 and the partition wall 572. The recess 521*c* communicating with the ink supply port 507*c* is defined by the bottom wall 522, the cover 501, the second end wall 524, the first side wall 525, the partition wall 571 and the partition wall 572. The recess 521*y* communicating with the ink supply port 507*y* is defined by the bottom wall 522, the cover 501, the second end wall 524, the first side wall 525, the partition wall 571 and the partition wall 573. In one modification, the partition wall 573 may be omitted. In this modified application, the recess 521*y* is defined by the bottom wall 522, the cover 501, the second end wall 524 the first side wall 525, the second side wall 526 and the partition wall 571.

As illustrated in FIGS. 20 and 21, the bottom wall 522, the first end wall 523, the second end wall 524, the first side wall 525 and the second side wall 526 of the casing 520 have the similar structures to those of the corresponding walls of the cartridge 4. The cartridge 5 has the circuit substrate 510 located on the second end wall 524-side of the casing 520. As in the structure of the cartridge 4, the circuit substrate 510 is fixed to a substrate mounting structure 511. The circuit substrate 510 has terminals 512 having substantially the similar structure to that of the cartridge 4. Contact portions of the respective terminals 512 are electrically connected with electrodes of the electrode assembly 810 provided on the carriage 8 when the cartridge 5 is attached to the carriage 8 as described above. The substrate mounting structure 511 has the similar structure to that of the cartridge 4. The circuit substrate 510 is fixed to the substrate mounting structure 511 by thermally caulking projections 514 protruded from the substrate mounting structure 511.

As illustrated in FIGS. 17 and 19, the cover 501 has a cover member 530 and an outward extension member 531. The cover member 530 is in a flat plate-like shape and is arranged to cover the recesses 521*m*, 521*c* and 521*y* of the casing 520. The outward extension member 531 is extended outward from the cover member 530 on the second end wall 524-side where the circuit substrate 510 with the terminals 512 is located, and includes a bent extension section 532 and an inclined extension section 533. The structure of these extension sections 532 and 533 is similar to the structure of the cartridge 4. The bent extension section 532 is bent at approximately 90 degrees to the cover member 530 and is extended to be protruded along a direction from the cover 501 toward the casing 520 (−Z direction in FIG. 19). The inclined extension section 533 continuous with the bent extension section 532 is extended to a location to hang over the terminals 512 of the circuit substrate 510 in the plan view of the cover 501 in the direction from the cover 501 toward the casing 520 (−Z direction in FIG. 19). In the state that the cover 501 is fixed to the casing 520, the outward extension member 531 is hung over an opening 513 of the substrate mounting structure 511 to close the opening 513 on the upper edge side of the first end wall 523 as shown in FIG. 21. In the state that the cover 501 is fixed to the casing 520, the outward extension member 531 is engaged with an engagement element 505 as shown in FIG. 17. The outward extension member 531 is protruded to the outer side of at least the terminals 512 in the lower line of the circuit substrate 510 in a first direction from the first end wall 523 toward the second end wall 524 (+Y direction in FIGS. 7 and 19). In one modification, the inclined extension section 533 may be extended longer to be protruded to the outer side of all the terminals 512 of the circuit substrate 510.

As illustrated in FIG. 19, the cover 501 has through holes 502*a*, 502*b* and 502*c*, an air groove 503 arranged between the through hole 502*a* and the through hole 502*b* and an air communication hole 534 provided for each of the recesses 521*m*, 521*c* and 521*y* corresponding to the respective color inks, magenta, cyan and yellow, and seal member receiving elements 537 formed at respective corners of the cover 501. The seal member receiving elements 537 are protruded from the upper surface of the cover 501 to substantially the same height as the height of the circumferential walls of the through holes 502*a*, 502*b* and 502*c* and the circumferential walls of the air grooves 503 and serve as joint seat elements of the seal member 504.

The three air communication holes 534 are aligned in the X-axis direction in the outer periphery of the cover member 530 and are formed to pass through the cover 501. The through hole 502*b* provided for each of the color inks, yellow, magenta and cyan is formed to pass through the cover 501 at the end of the air groove 503 for each color ink and is arranged to be aligned in the Y-axis direction with corresponding one of the air communication holes 534 aligned in the X-axis direction. The air communication hole 534 and the corresponding through hole 502*b* aligned in the Y-axis direction are connected with each other by an air groove (not shown) on the rear surface of the cover 501. This air groove, the cover backside opening of the through hole 502*b* and the cover backside opening of the air communication hole 534 are sealed by a cover backside seal member 536. The recesses 521*m*, 521*c* and 521*y* of the casing 520 closed by the cover 501 are accordingly open to the air through the through holes 502*a*, the air grooves 503, the through holes 502*b* and the air communication holes 534. The through holes 502*a*, 502*b* and 502*c* and the air grooves 503 are sealed on the upper surface side of the cover 501 by the seal member 504. This arrangement of open to the air described above enables ink contained in the porous liquid retaining member 560 placed in the recess 521*m*, 521*c* or 521*y* for each color ink in the casing 520 closed by the cover 501 to be supplied to the supply port-side liquid retaining member 506 and then to the liquid introducing part 710*m*, the liquid introducing part 710*c* or the liquid introducing part 710*y* (FIG. 4) of the carriage 8 via the corresponding ink supply port 507*m*, 507*c* or 507*y*. In other words, the corresponding color inks are respectively supplied through the ink supply port 507*m* of the recess 521*m* to the liquid introducing part 710*m* of the carriage 8, through the ink supply port 507*c* of the recess 521*c* to the liquid introducing part 710*c* and through the ink supply port 507*y* of the recess 521*y* to the liquid introducing part 710*y*. The respective ink supply ports 507*m*, 507*c* and 507*y* have the following positional relationship.

In the plan view of the casing 520 or the cartridge 5 in a direction from the bottom wall 522 with the ink supply ports 507*m*, 507*c* and 507*y* toward the cover 501 (+Z direction), the ink supply port 507*m* is located between the first side wall 525 and the second side wall 526. The ink supply port 507*c* is located between the ink supply port 507*m* and the second side wall 526.

As shown in FIGS. 20 and 21, the cartridge 5 also has a first groove 580 and a second groove 581 on the bottom surface of the bottom wall 522 (outer wall surface on the −Z direction side) where the ink supply ports 507*m*, 507*c* and 507*y* are formed. The first groove 580 is formed between the ink supply port 507*m* corresponding to the liquid introducing part 710*m* for magenta and the ink supply port 507*c* corresponding to the liquid introducing part 710*c* for cyan (FIG. 4) and is extended from between the ink supply port 507*m* and the ink supply port 507*c* toward the ink supply port 507*y*. The first groove 580 is formed in the partition wall 572 as a concave having such a depth that the guide projection 723 (FIG. 4) of the cartridge attachment structure 7 is inserted in the state of attachment of the cartridge 5 to the cartridge attachment structure 7 (FIGS. 22 and 23) and is extended over the length of the partition wall 572, i.e., between the second end wall 524 and the partition wall 571. The definition of "groove" includes not only a dent portion formed on the cartridge 5 but also a slot completely penetrates through the ink cartridge 5.

Figure 22:
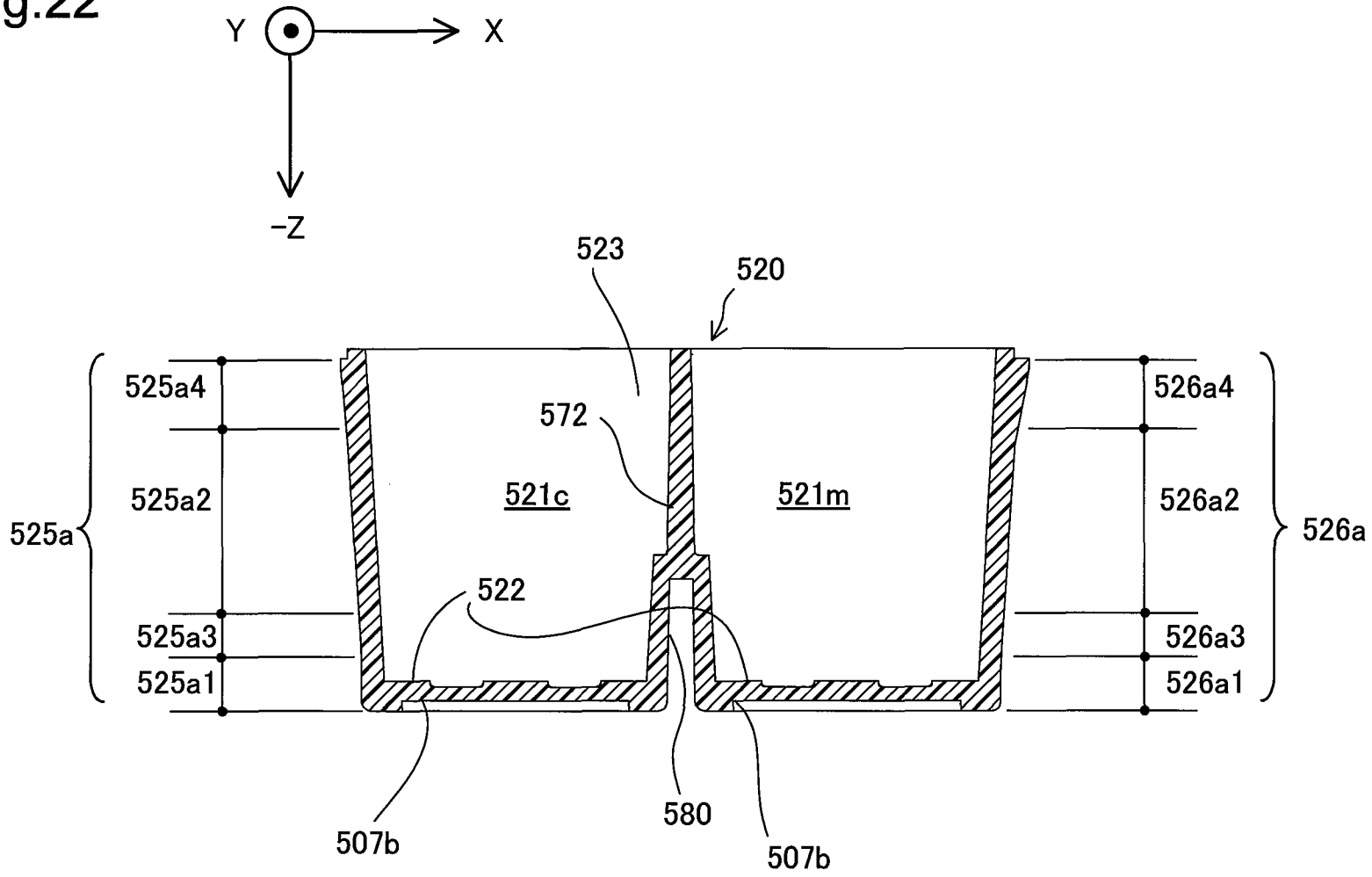
FIG. 22 is a schematic cross sectional view illustrating a cross section of a first side wall part of a casing, taken on a line 22-22 in FIG. 18.
Figure 23:
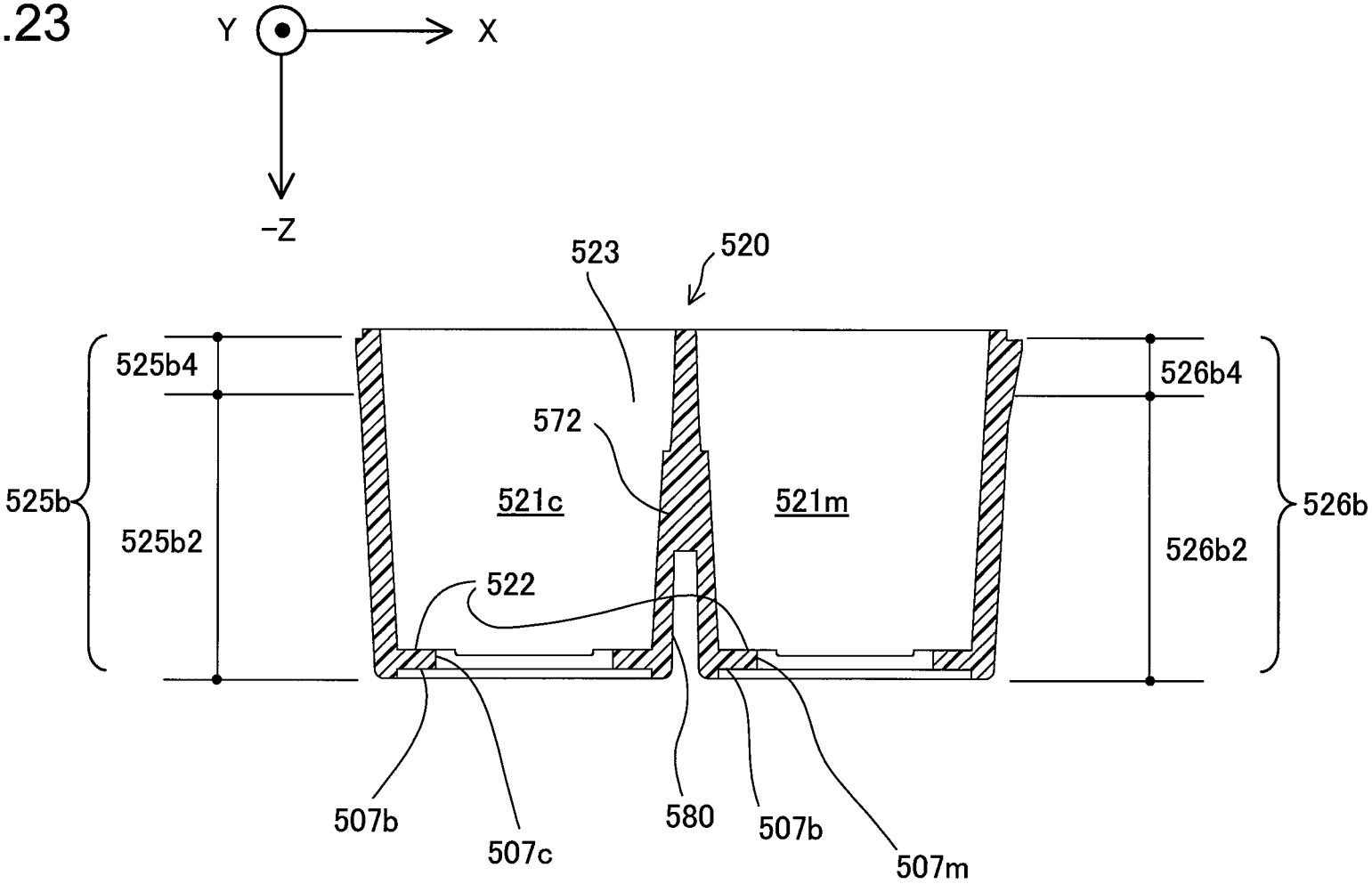
FIG. 23 is a schematic cross sectional view illustrating a cross section of a second side wall part of the casing, taken on a line 23-23 in FIG. 18.
Figure 24:
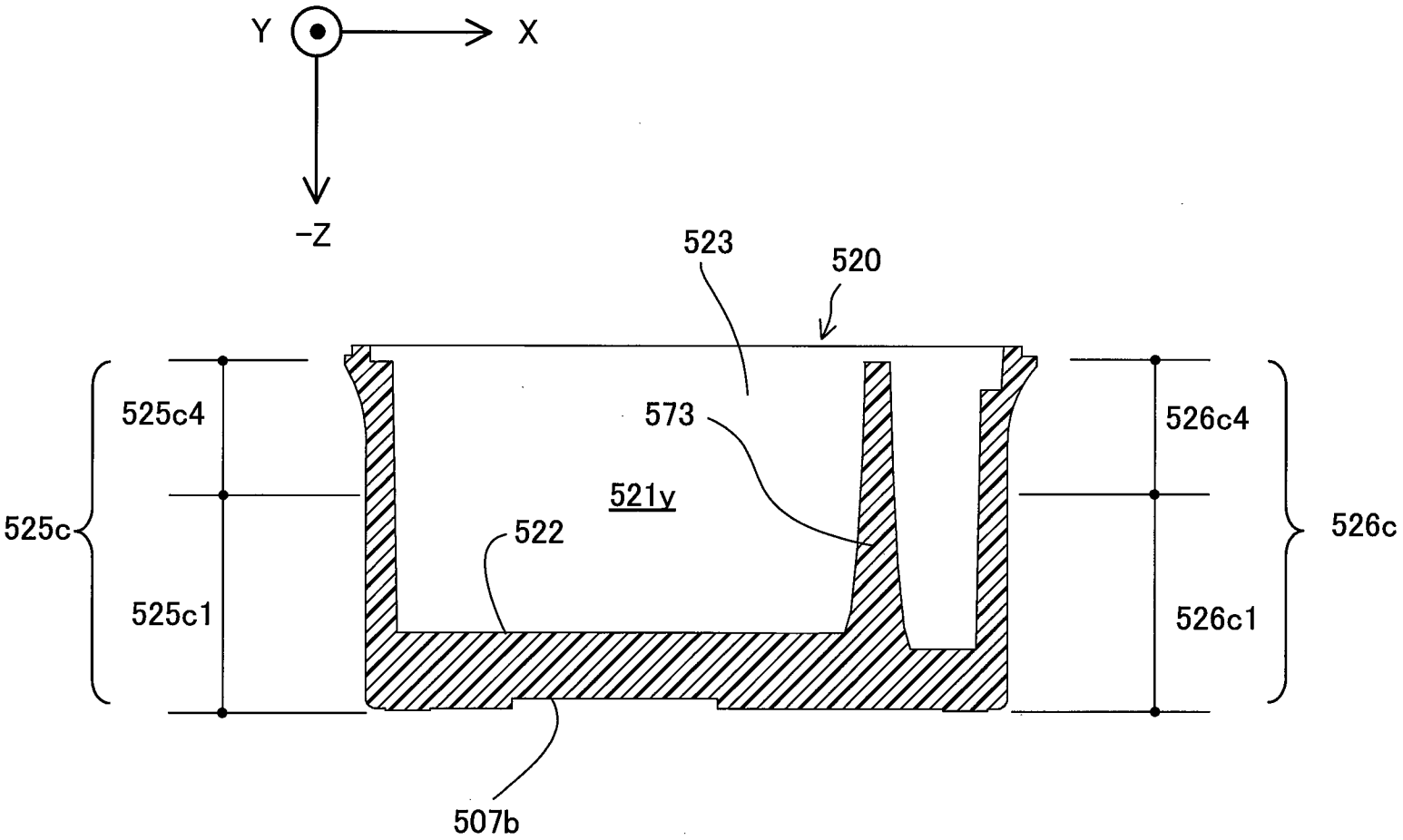
FIG. 24 is a schematic cross sectional view illustrating a cross section of a third side wall part of the casing, taken on a line 24-24 in FIG. 18.

The casing configuration of the cartridge 5 involved in positioning of the cartridge attachment structure 7 mounted on the carriage 8 is substantially similar to the casing configuration of the cartridge 4 described above and is only briefly described. As illustrated in FIGS. 17 to 21, the first side wall 525 of the casing 520 includes a first side wall part 525*a*, a second side wall part 525*b* and a third side wall part 525*c* aligned in the first direction from the first end wall 523 toward the second end wall 524 (Y direction). The widths of these side wall parts 525*a*, 525*b* and 525*c* in the first direction are similar to those of the cartridge 4. FIG. 22 is a schematic cross sectional view illustrating a cross section of the first side wall part 525*a* of the casing 520, taken on a line 22-22 in FIG. 18. FIG. 23 is a schematic cross sectional view illustrating a cross section of the second side wall part 525*b* of the casing 520, taken on a line 23-23 in FIG. 18. FIG. 24 is a schematic cross sectional view illustrating a cross section of the third side wall part 525*c* of the casing 520, taken on a line 24-24 in FIG. 18.

As shown in FIGS. 17 to 21 and 22, the first side wall part 525*a* includes a first side wall area 515*a*1, a second side wall area 525*a*2, a third side wall area 525*a*3 and a fourth side wall area 525*a*4. The first side wall area 525*a*1 is located on the bottom wall 522-side and is extended to be substantially perpendicular to the bottom wall 522. The second side wall area 525*a*2 is inclined with respect to the bottom wall 422 and is extended from the third wall area 525*a*3 to the fourth side wall area 525*a*4. The third side wall area 525*a*3 is extended from the first side wall area 525*a*1 to the second side wall area 525*a*2 and forms a curved surface of connecting the first side wall area 525*a*1 with the second side wall area 525*a*2. The fourth side wall area 525*a*4 is extended from the second side wall area 525*a*2 to the opening side of the casing 520 and forms a curved surface of connecting the second side wall area 525*a*2 with the opening side of the casing 520. The second side wall area 525*a*2, the third side wall area 525*a*3 and the fourth side wall area 525*a*4 may have the same angle of inclination.

As shown in FIGS. 17 to 21 and 23, the second side wall part 525*b* includes a second side wall area 525*b*2 and a fourth side wall area 525*b*4. The second side wall area 525*b*2 is extended from the bottom wall 522 to be inclined with respect to the bottom wall 522 and is continuous with the fourth side wall area 525*b*4 on the opening side of the casing 520. The second side wall area 525*b*2 is adjacent to the first side wall area 525*a*1, the second side wall area 525*a*2 and the third side wall area 525*a*3 of the first side wall part 525*a*. The second side wall area 525*b* and the fourth side wall area 525*b*4 may have the same angle of inclination.

As shown in FIGS. 17 to 21 and FIG. 24, the third side wall part 525*c* includes a first side wall area 525*c*1 and a fourth side wall area 525*c*4. The first side wall area 525*c*1 is located on the bottom wall 522-side and is extended to be substantially perpendicular to the bottom wall 522. The fourth side wall area 525*c*4 is extended from the first side wall area 525*c*1 to the opening side of the casing 520 and is curved on this opening side. The fourth side wall area 525*c*4 is adjacent to the fourth side wall area 525*b*4 of the second side wall part 525*b* and is formed to have a large wall thickness for supporting the cover 501 at the upper edge on the opening side of the cover 501.

The second side wall 526 also includes a first side wall part 526*a*, a second side wall part 526*b* and a third side wall part 526*c* aligned in the first direction from the first end wall 523 toward the second end wall 524 (Y direction). As shown in FIGS. 22 and 23, the first side wall part 526*a* is opposed to the first side wall part 525*a* of the first side wall 525. The second side wall part 526*b* is opposed to the second side wall part 525*b* of the first side wall 525. The third side wall part 526*c* is opposed to the third side wall part 525*c* of the first side wall 525. As shown in FIG. 22, the first side wall part 526*a* includes a first side wall area 526*a*1, a second side wall area 526*a*2, a third side wall area 526*a*3 and a fourth side wall area 526*a*4. The first side wall area 526*a*1 is located on the bottom wall 522-side and is extended to be substantially perpendicular to the bottom wall 522. The first side wall area 526*a*1 and the first side wall area 525*a*1 of the first side wall 525 are positioned back to back across the bottom wall 522. The fourth side wall area 526*a*4 is formed to have a large wall thickness for supporting the cover 501 at the upper edge on the opening side of the cover 501.

As shown in FIG. 23, the second side wall part 526*b* includes a second side wall area 526*b*2 extended from the bottom wall 522 to be inclined with respect to the bottom wall 522, and a fourth side wall area 526*a*4 continuous with the second side wall area 526*b*2. As shown in FIG. 24, the third side wall part 526*c* includes a first side wall area 526*c*1 and a fourth side wall area 526*c*4. The first side wall area 526*c*1 is located on the bottom wall 522-side and is extended to be substantially perpendicular to the bottom wall 522. The first side wall area 526*c*1 and the first side wall area 525*a*1 of the first side wall 525 are positioned back to back across the bottom wall 522. The fourth side wall area 526*c*4 is curved at the upper edge on the opening side of the cover 501 and is formed to have a large wall thickness for supporting the cover 501.

A-5. Attachment of Cartridges

Figure 25:
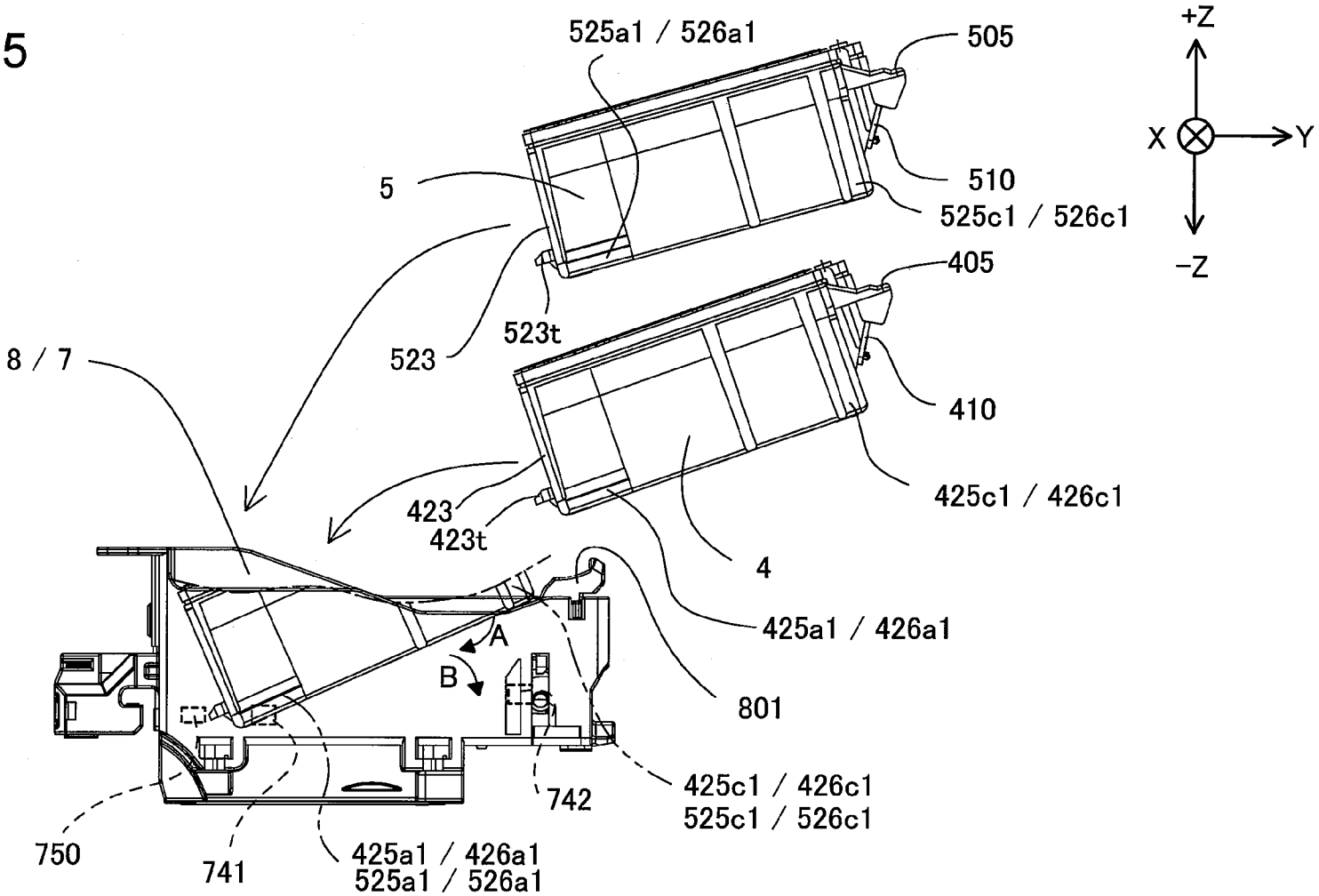
FIG. 25 is a diagram schematically illustrating attachment of the cartridges of FIGS. 8 and 17 to the carriage.

FIG. 25 is a diagram schematically illustrating attachment of the cartridges 4 and 5 to the carriage 8. As illustrated, in the course of attachment of the cartridges 4 and 5, both the cartridges 4 and 5 are inclined such that the outer wall surfaces of the first end walls 423 and 523 face in the −Z direction when being inserted into the cartridge attachment structure 7 of the carriage 8. The cartridges 4 and 5 are then pressed in the inclined attitude such that the engagement projections 423*t* and 523*t* of these cartridges 4 and 5 enter the engagement holes 750 (FIGS. 4 and 5) formed in the cartridge attachment structure 7 of the carriage 8 as shown by an arrow A.

Simultaneously with insertion of the engagement projections 423*t* and 523*t* into the engagement holes 750, the first side wall areas 425*a*1 and 525*a*1 of the first side wall parts 425*a* and 525*a* of the first side walls 425 and 525 and the first side wall areas 426*a*1 and 526*a*1 of the first side wall parts 426*a* and 526*a* of the second side walls 426 and 526 of the cartridges 4 and 5 are engaged with the opposing cartridge first engagement protrusions 741 (FIGS. 4 and 5) arranged on the engagement holes 750-side in the cartridge attachment structure 7 having the liquid introducing parts 710*b*, 710*c*, 710*m* and 710*y*. While the engagement projections 423*t* and 523*t* are kept in the engagement holes 750, the cartridges 4 and 5 are swung from the above inclined attitude as shown by an arrow B in FIG. 25. In the course of this swing, the first side wall areas 425*c*1 and 525*c*1 of the third side wall parts 425*c* and 525*c* of the first side walls 425 and 525 and the first side wall areas 426*c*1 and 526*c*1 of the third side wall parts 426*c* and 526*c* of the second side walls 426 and 526 of the cartridges 4 and 5 are engaged with the opposing cartridge second engagement protrusions 742 (FIGS. 4 and 5) arranged on the cartridge engagement arms 801-side of the carriage 8. The cartridges 4 and 5 are then pressed in the −Z direction toward the cartridge attachment structure 7 until the engagement elements 405 and 505 are engaged with the cartridge engagement arms 810 as shown in FIG. 7.

The cartridge 4 of the embodiment having the configuration described above has the bottom wall 422 located on the bottom when the cartridge 4 is attached to the carriage 8 of the printer 10, and the cover 401 opposed to the bottom wall 422. The bottom wall 422, the first end wall 423 and the other walls describe above define the casing 420 (FIG. 10). The supply hole-side liquid retaining member 406 and the liquid retaining member 460 are stacked and placed in the recess 421 of the casing 420. Additionally, in the cartridge 4 of the embodiment, the first side wall 425 has the first side wall part 425*a* and the second side wall part 425*b* aligned in the first direction from the first end wall 423 toward the second end wall 424 as shown in FIGS. 10 to 12. In the cartridge 4 of the embodiment, as shown in FIGS. 13 and 14, the first side wall part 425*a* includes the first side wall area 425*a*1 located on the bottom wall 422-side and arranged to be substantially perpendicular to the bottom wall 422 and the second side wall area 425*a*2 located on the cover 401-side and arranged to be inclined with respect to the bottom wall 422. The second side wall part 425*b* is arranged to be inclined with respect to the bottom wall 422.

As shown in FIG. 25, in the course of attachment of the cartridge 4 of the embodiment to the carriage 8 of the printer 10, the first side wall area 425*a*1 of the first side wall part 425*a* arranged to be substantially perpendicular to the bottom wall 422 is needed to come into contact with the cartridge first engagement protrusion 741 of the cartridge attachment structure 7, while the second side wall part 425*b* aligned with the first side wall part 425*a* in the first direction from the first end wall 423 toward the second end wall 424 is not needed to come into contact with the cartridge attachment structure 7. Accordingly, the entire first side wall 425 is not needed to come into contact with the cartridge attachment structure 7 of the carriage 8 in the printer 10. As a result, the configuration of the cartridge 4 of the embodiment increases the flexibility of the attitude of the cartridge 4 in the course of attachment to the printer 10 and improves the attachment of the cartridge 4. The first side wall area 425*a*1 of the first side wall 425 arranged to be substantially perpendicular to the bottom wall 422 comes into contact with the printer 10. This ensures the accurate positioning of the cartridge 4 of the embodiment. Additionally, both the second side wall area 425*a*2 of the first side wall part 425*a* located on the cover 401-side of the first side wall area 425*a*1, which comes into contact with the printer 10 or more specifically the cartridge first engagement protrusion 741 of the cartridge attachment structure 7, and the second side wall part 425*b* aligned with the first side wall part 425*a* in the above first direction are arranged to be inclined with respect to the bottom wall 422. Such configuration of the cartridge 4 of the embodiment enables the liquid retaining member 460 to be more compressed on the bottom wall 422-side. This description is also applicable to the cartridge 5 of the embodiment.

As described above, the first side wall area 425*a*1 of the first side wall part 425*a* of the first side wall 425 comes into contact with the cartridge first engagement protrusion 741 protruded from the sidewall-side projection 724 of the cartridge attachment structure 7. Even when a force is applied in the −X direction to the cartridge 4 in the attached state as shown in FIG. 3, this configuration suppresses a positional misalignment of the cartridge 4 in the −X direction. The first side wall part 425*a* and the protruding surface of the cartridge first engagement protrusion 741 are arranged to be substantially perpendicular to the bottom wall of the cartridge attachment structure 7 or the bottom wall 422 of the cartridge 4. In other words, the angle of the first side wall part 425*a* with respect to the bottom wall 422 is substantially perpendicular. When an external force is applied in the −X direction to the cartridge 4, the first side wall part 425*a* of the cartridge 4 applies the external force in the −X direction to the cartridge first engagement protrusion 741. A force against this external force is generated on the cartridge first engagement protrusion 741. Accordingly no vector is generated to press the cartridge 4 in the −X direction. This reduces a potential trouble that the cartridge 4 is lifted up from the bottom wall of the cartridge attachment structure 7. The first side wall part 425*a* should come into contact with the cartridge first engagement protrusion 741 in such an attitude that the cartridge 4 is not lifted up from the bottom wall of the cartridge attachment structure 7 even when an external force is applied in the −X direction to the cartridge 4. Strictly speaking, there is some manufacturing tolerance in surface formation of the first side wall part 425*a* and the cartridge first engagement protrusion 741. The angle of the first side wall part 425*a* with respect to the bottom wall 422 is accordingly not limited to 90 degrees but may be any angle in such a range that prevents the cartridge 4 from being lifted up from the bottom wall of the cartridge attachment structure 7 as described above. In the description herein, the angle in this range is expressed as "substantially perpendicular".

In the cartridge 4 of the embodiment having the first side wall part 425*a*, the third side wall area 425*a*3 is located between the first side wall area 425*a*1 and the second side wall area 425*a*2. The third side wall area 425*a*3 is formed to have the smaller wall thickness than the wall thicknesses of the first side wall area 425*a*1 and the second side wall area 425*a*2. In the cartridge 4 of the embodiment having the first side wall 425 surrounding part of the liquid retaining member 460, the first side wall area 425*a*1, the third side wall area 425*a*3 and the second side wall area 425*a*2 are sequentially connected from the bottom wall 422-side, and the third side wall area 425*a*3 is made to have the smaller wall thickness. This increases the capacity of the recess 421 in which the liquid retaining member 460 is placed. Even when the shape on the outer wall surface of the first side wall part 425*a* has some irregularity by the sequential connection of the first side wall area 425*a*1, the third side wall area 425*a*3 and the second side wall area 425*a*2, this configuration ensures the even or nearly even shape on the inner wall surface of the first side wall 425. This description is also applicable to the cartridge 5 of the embodiment.

In the cartridge 4 of the embodiment, the inner wall surface of the second side wall 426 opposed to the first side wall 425 (FIG. 10) is inclined at a constant angle to become wider on the opening side of the recess 421 as shown in FIGS. 13 to 15. The cartridge 4 of the embodiment thus enables the liquid retaining member 460 to be more compressed on the bottom wall 422-side, irrespective of the shape on the outer wall surface of the second side wall 426. The even shape on the inner wall surface of the second side wall 426 irrespective of the shape on the outer wall surface of the second side wall 426 simplifies the shape of the mold. This description is also applicable to the cartridge 5 of the embodiment.

In the cartridge 4 of the embodiment, the inner wall surface of the second side wall 426 opposed to the first side wall 425 (FIG. 10) is inclined and is made flat as shown in FIGS. 13 to 15. This also simplifies the shape of the mold.

In the cartridge 4 of the embodiment, as shown in FIGS. 10 and 16, in the plan view in the direction from the cover 401 toward the bottom wall 422, the supply hole-side liquid retaining member 406 is located between the second side wall part 425*b* of the first side wall 425 and the second side wall 426. Accordingly, in the cartridge 4 of the embodiment, the supply hole-side liquid retaining member 406 is located away from the first side wall part 425*a* of the first side wall 425 to be on the center or near the center of the liquid retaining member 460. As a result, the cartridge 4 of the embodiment enables black ink to be supplied from substantially the entire area of the liquid retaining member 460 and reach the supply hole-side liquid retaining member 406.

In the cartridge 4 of the embodiment, the second side wall part 425*b* has the larger width than the width of the first side wall part 425*a* in the first direction from the first end wall 423 toward the second end wall 424. This configuration has the following advantageous effects. The first side wall part 425*a* has the first side wall area 425*a*1 and the second side wall area 425*a*2 and accordingly has a relatively complicated shape. There is accordingly little space to take a measure for enhancing the strength of the cartridge 4. Unlike the first side wall part 425*a* having the first side wall area 425*a*1 and the second side wall area 425*a*2, the second side wall part 425*b* is simply needed to be inclined with respect to the bottom wall 422 and has a relatively simple shape. There is accordingly some space to take a measure for enhancing the strength of the cartridge 4. In the cartridge 4 of the embodiment, the larger width of the second side wall part 425*b* in the simple shape is advantageous to the enhanced strength. More specifically, in the cartridge 4 of the embodiment, the ribs 428 are provided on the second side wall part 425*b* to enhance the strength. This description is also applicable to the cartridge 5 of the embodiment.

In the cartridge 4 of the embodiment, as shown in FIGS. 13 and 14, the angle θ3 of the second side wall area 425*b*2 of the second side wall part 425*b* with respect to the bottom wall 422 is made greater than the angle θ2 of the second side wall area 425*a*2 of the first side wall part 425*a* with respect to the bottom wall 422. This configuration has the following advantageous effects. In the first side wall part 425*a*, the second side wall area 425*a*2 is continuous via the third side wall area 425*a*3 with the first side wall area 425*a*1 extended from the bottom wall 422 to be inclined with respect to the bottom wall 422. In the second side wall part 425*b*, the second side wall area 425*b*2 is aligned with the first side wall part 425 in the above first direction and is extended from the bottom wall 422 to be inclined with respect to the bottom wall 422. If the angle θ3 of the second side wall area 425*b*2 of the second side wall part 425*b* with respect to the bottom wall 422 (FIG. 14) is equal to the angle θ2 of the second side wall area 425*a*2 of the first side wall part 425*a* with respect to the bottom wall 422 (FIG. 13), the periphery of the first side wall part 425*a* and the periphery of the second side wall part 425*b* may be misaligned on the cover 401. In the cartridge 4 of the embodiment, however, the angle θ3 of the second side wall area 425*b*2 of the second side wall part 425*b* with respect to the bottom wall 422 is made greater than the angle θ2 of the second side wall area 425*a*2 of the first side wall part 425*a* with respect to the bottom wall 422. This reduces the misalignment of the periphery of the first side wall part 425*a* with the periphery of the second side wall part 425*b* on the cover 401. As a result, the cartridge 4 of the embodiment provides the simple shape of the second side wall part 425*b* on the cover 401-side, as well as the simple shape of the cover 401.

In the cartridge 4 of the embodiment, the angle of the second side wall part 425*b* on the cover 401-side with respect to the bottom wall 422 is made equal to the angle θ2 of the second side wall area 425*a*2 of the first side wall part 425*a* with respect to the bottom wall 422, and the second side wall part 425*b* is formed to be continuous with the second side wall area 425*a*2 in the above first direction. In the cartridge 4 of the embodiment, this configuration suppresses misalignment of the periphery of the second side wall part 425*b* with the periphery of the first side wall part 425*a* of the first side wall 425 on the cover 401-side. This accordingly provides the simple shape of the first side wall 425 on the cover 401-side, as well as the simple shape of the cover 401.

In the cartridge 4 of the embodiment, the first side wall 425 includes the first side wall part 425*a*, the second side wall part 425*b* and the third side wall part 425*c* aligned in the first direction from the first end wall 423 toward the second end wall 424. Additionally, in the cartridge 4 of the embodiment, the second side wall part 425*b* is located between the first side wall part 425*a* and the third side wall part 425*c* in the above first direction. The third side wall part 425*c* has the first side wall area 425*c*1 located on the bottom wall 422-side and arranged to be substantially perpendicular to the bottom wall 422 as shown in FIG. 15. In the cartridge 4 of the embodiment, as shown in FIG. 25, in the last stage of attachment of the cartridge 4 to the carriage 8, the first side wall area 425*c*1 arranged to be substantially perpendicular to the bottom wall 422 comes into contact with the cartridge second engagement protrusions 742 on the mounting base of the electrode assembly 810. Accordingly, the configuration of the cartridge 4 of the embodiment causes the first side wall area 425*a*1 to come into contact with the cartridge attachment structure 7, while causing the first side wall area 425*c*1 to come into contact with the mounting base of the electrode assembly 810. This configuration allows for accurate positioning of the cartridge 4 to the printer 10 and stabilizes the attitude of the cartridge 4 after attachment. This description is also applicable to the cartridge 5 of the embodiment.

In the cartridge 4 of the embodiment, the second side wall 426 opposed to the first side wall 425 has the first side wall part 426*a*, the second side wall part 426*b* and the third side wall part 426*c*. The first side wall part 426*a* and the third side wall part 426*c* respectively have the first side wall area 426*a*1 and the first side wall area 426*c*1 located on the bottom wall 422-side and arranged to be substantially perpendicular to the bottom wall 422. Additionally, the first side wall areas 426*a*1 and 426*c*1 of the second side wall 426 and the first side wall areas 425*a*1 and 425*c*1 of the first side wall 425 are positioned back to back across the bottom wall 422, while coming into contact with the cartridge first engagement protrusions 741 and the cartridge second engagement protrusions 742 of the carriage 8. Accordingly the configuration of the cartridge 4 of the embodiment allows for more accurate positioning of the cartridge 4 to the printer 10 and further stabilizes the attitude of the cartridge 4 after attachment. This description is also applicable to the cartridge 5 of the embodiment.

B. Another Embodiment

Structure of Cartridge 600

Figure 26:
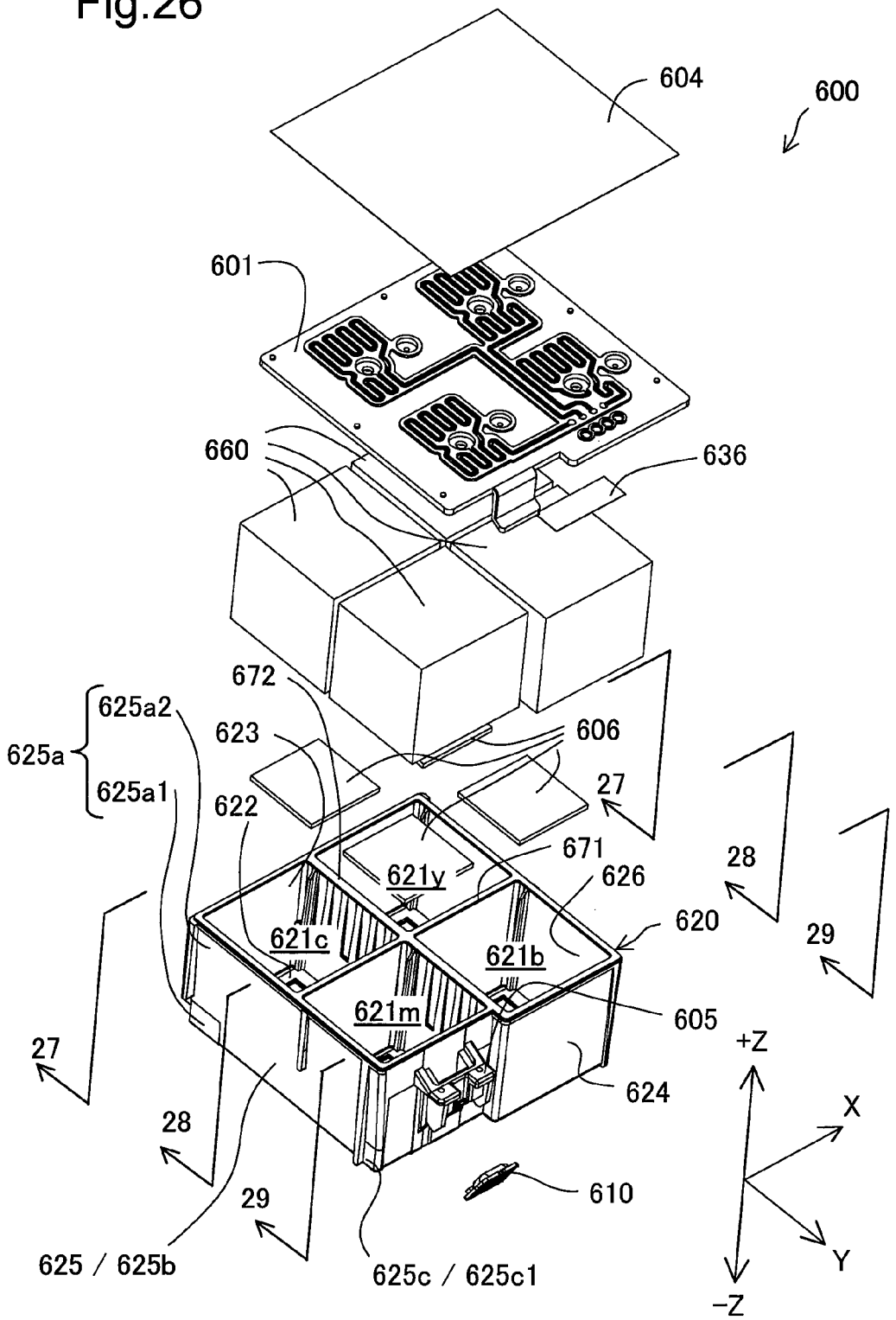
FIG. 26 is an exploded perspective view illustrating another cartridge.

Unlike the cartridges 4 and 5, a cartridge 600 is configured to contain four different color inks, black, yellow, magenta and cyan. In the description of the structure of the cartridge 600, the like components to those of the cartridges 4 and 5 are expressed by like numerical symbols with the digit at a highest place changed to 6, and only the main cartridge components are described. FIG. 26 is an exploded perspective view illustrating the cartridge 600. The cartridge 600 contains four different color inks, so that a carriage on which the cartridge 600 is mounted, has liquid introducing parts 710*b*, 710*m*, 710*c* and 710*y* for the respective color inks. The structure of the carriage is, however, not specifically described here.

As shown in FIG. 26, like the cartridges 4 and 5 described above, the cartridge 600 includes a casing 620, a cover 601 and a circuit substrate 610. In the casing 620, a partition wall 671 extended from a first side wall 625 to a second side wall 626 is arranged to intersect with a partition wall 672 extended from a first end wall 623 to a second end wall 624, so that recesses 621*b*, 621*m*, 621*c* and 621*y* are formed corresponding to the respective color inks, black, yellow, magenta and cyan. A supply hole-side liquid retaining member 606 and a liquid retaining member 660 are stacked and placed in each of these recesses 621*b*, 621*m*, 621*c* and 621*y*. A bottom wall 622, the first end wall 623, the second end wall 624, the first side wall 625 and the second side wall 626 of the casing 620 have the similar functions to those of the cartridge 5 described above. The circuit substrate 610 located on the second end wall 624-side of the casing 620, the terminal arrangement on the circuit substrate 610 and the cover 601 formed in a flat plate shape to cover the respective recesses 621*b*, 621*m*, 621*c* and 621*y* are similar to those of the cartridge 5 described above.

Figure 27:
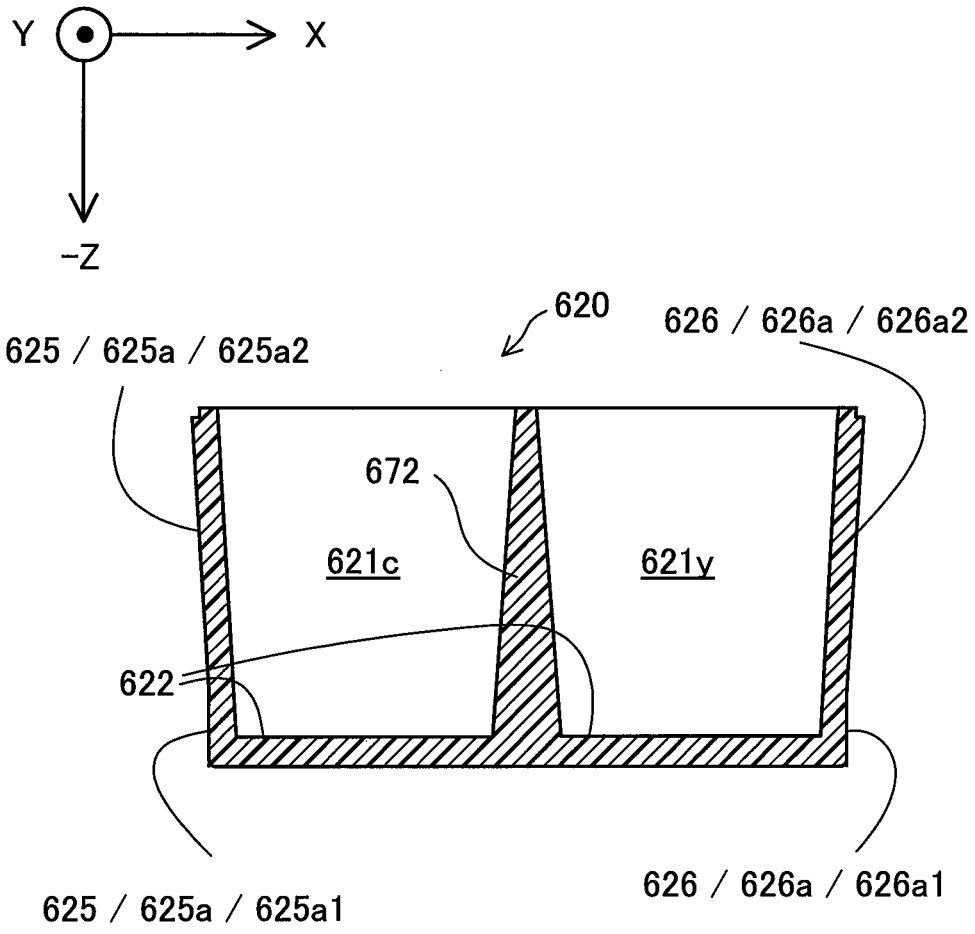
FIG. 27 is a schematic cross sectional view illustrating a first side wall part of a casing, taken on a line 27-27 in FIG. 26.
Figure 28:
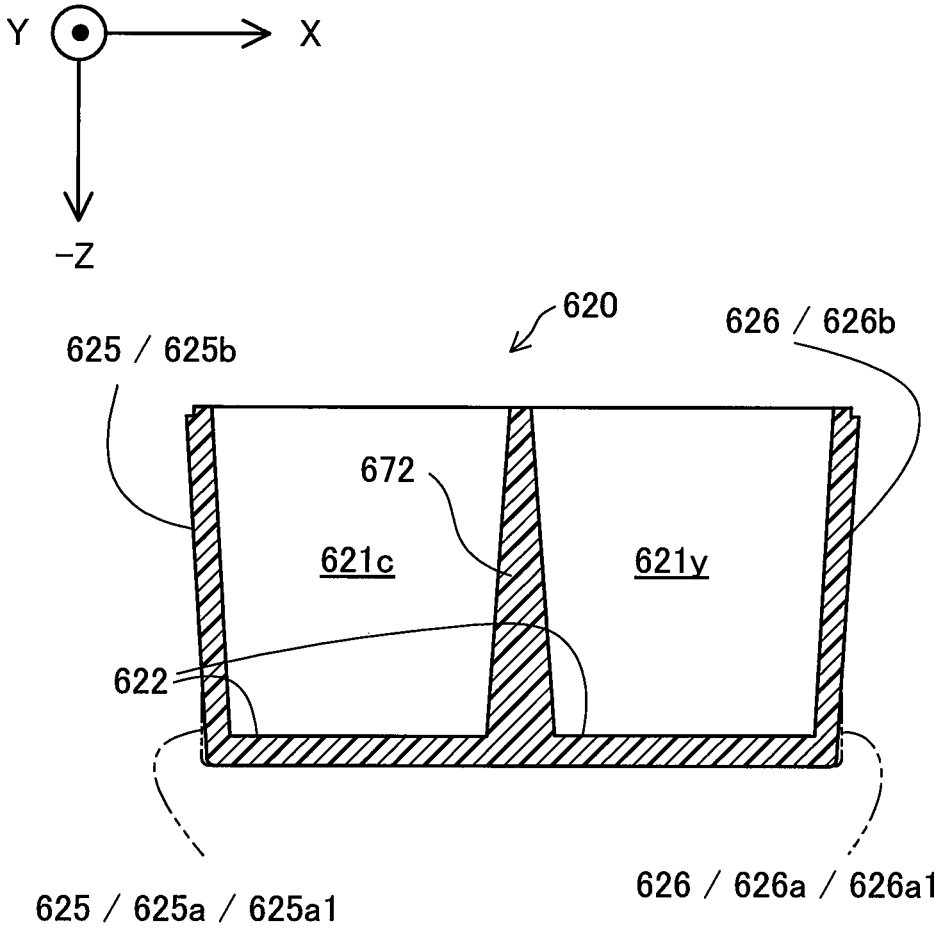
FIG. 28 is a schematic cross sectional view illustrating a second side wall part of the casing, taken on a line 28-28 in FIG. 26.
Figure 29:
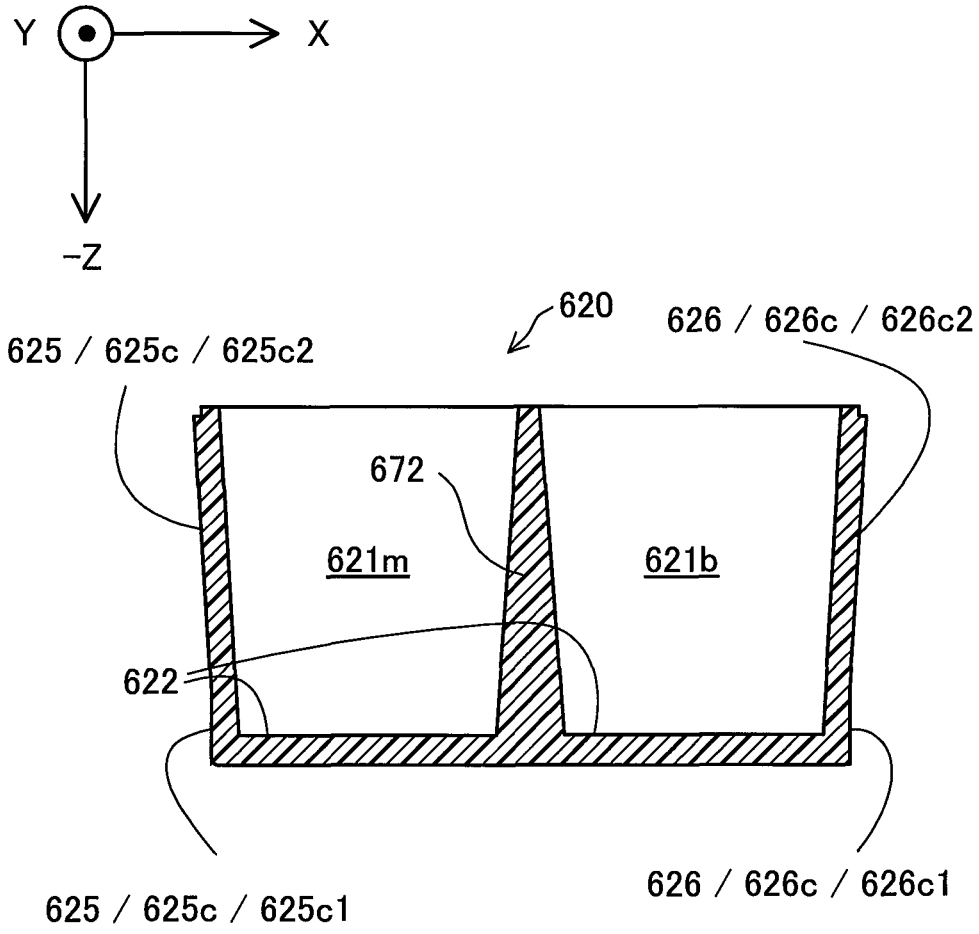
FIG. 29 is a schematic cross sectional view illustrating a third side wall part of the casing, taken on a line 29-29 in FIG. 26.

The casing configuration of the cartridge 600 involved in positioning of the cartridge is substantially similar to that of the cartridge 5 described above. As shown in FIG. 26, the first side wall 625 of the casing 620 includes a first side wall part 625*a*, a second side wall part 625*b* and a third side wall part 625*c* aligned in a first direction from the first end wall 623 toward the second end wall 624 (Y direction). These side wall parts have the widths in the first direction similar to those of the cartridges 4 and 5. FIG. 27 is a schematic cross sectional view illustrating the first side wall part 625*a* of the casing 620, taken on a line 27-27 in FIG. 26. FIG. 28 is a schematic cross sectional view illustrating the second side wall part 625*b* of the casing 620, taken on a line 28-28 in FIG. 26. FIG. 29 is a schematic cross sectional view illustrating the third side wall part 625*c* of the casing 620, taken on a line 29-29 in FIG. 26.

As shown in FIG. 27, the first side wall part 625*a* includes a first side wall area 625*a*1 and a second side wall area 625*a*2. The first side wall area 625*a*1 is located on the bottom wall 622-side and is extended to be substantially perpendicular to the bottom wall 622. The second side wall area 625*a*2 is extended from the first side wall area 625*a*1 to the cover 601-side, i.e., to the opening of the casing 620 to be inclined with respect to the bottom wall 622.

As shown in FIG. 28, the second side wall part 625*b* is extended to the opening of the casing 620 to be inclined at a constant angle with respect to the bottom wall 622. This second side wall part 625*b* is continuous with the second side wall area 625*a*2 of the first side wall part 625*a*.

As shown in FIG. 29, the third side wall part 625*c* includes a first side wall area 625*c*1 and a second side wall area 625*c*2. The first side wall area 625*c*1 is located on the bottom wall 622-side and is extended to be substantially perpendicular to the bottom wall 622. The second side wall area 625*c*2 is extended from the first side wall area 625*c*1 to the opening of the casing 620 to be inclined with respect to the bottom wall 622. This second side wall area 625*c*2 is continuous with the second side wall area 625*a*2 of the first side wall part 625*a* and the second side wall part 625*b*.

The second side wall 626 also includes a first side wall part 626*a*, a second side wall part 626*b* and a third side wall part 626*c* aligned in the first direction from the first end wall 62 toward the second end wall 624 (Y direction). As shown in FIGS. 27 to 29, the first side wall part 626*a* is opposed to the first side wall part 625*a* of the first side wall 625. The second side wall part 626*b* is opposed to the second side wall part 625*b* of the first side wall 625. The third side wall part 626*c* is opposed to the third side wall part 625*c* of the first side wall 625. As shown in FIG. 27, the first side wall part 626*a* includes a first side wall area 626*a*1 and a second side wall area 626*a*2. The first side wall area 626*a*1 is located on the bottom wall 622-side and is extended to be substantially perpendicular to the bottom wall 622. The first side wall area

626*a*1 and the first side wall area 625*a*1 of the first side wall 625 are positioned back to back across the bottom wall 622. The second side wall area 626*a*2 is extended from the first side wall area 626*a*1 to the opening of the casing 620 to be inclined at a constant angle with respect to the bottom wall 622.

As shown in FIG. 28, the second side wall part 626 is extended from the bottom wall 622 to be inclined with respect to the bottom wall 622 and is arranged to be continuous with the second side wall area 626*a*2 of the first side wall part 626*a*. As shown in FIG. 29, the third side wall part 626*c* includes a first side wall area 626*c*1 and a second side wall area 626*c*2. The first side wall area 626*c*1 is located on the bottom wall 622-side and is extended to be substantially perpendicular to the bottom wall 622. The first side wall area 626*c*1 and the first side wall area 625*c*1 of the first side wall 625 are positioned back to back across the bottom wall 622. The second side wall area 626*c*2 is arranged to be continuous with the second side wall area 626*a*2 of the first side wall part 626*a* and the second side wall part 626*b*.

The cartridge 600 of this embodiment has the similar advantageous effects to those of the cartridges 4 and 5 described above.

C. Modifications

The invention may be implemented by any of various aspects described below.

C-1. First Modification of Appearance of Cartridge

Figure 30:
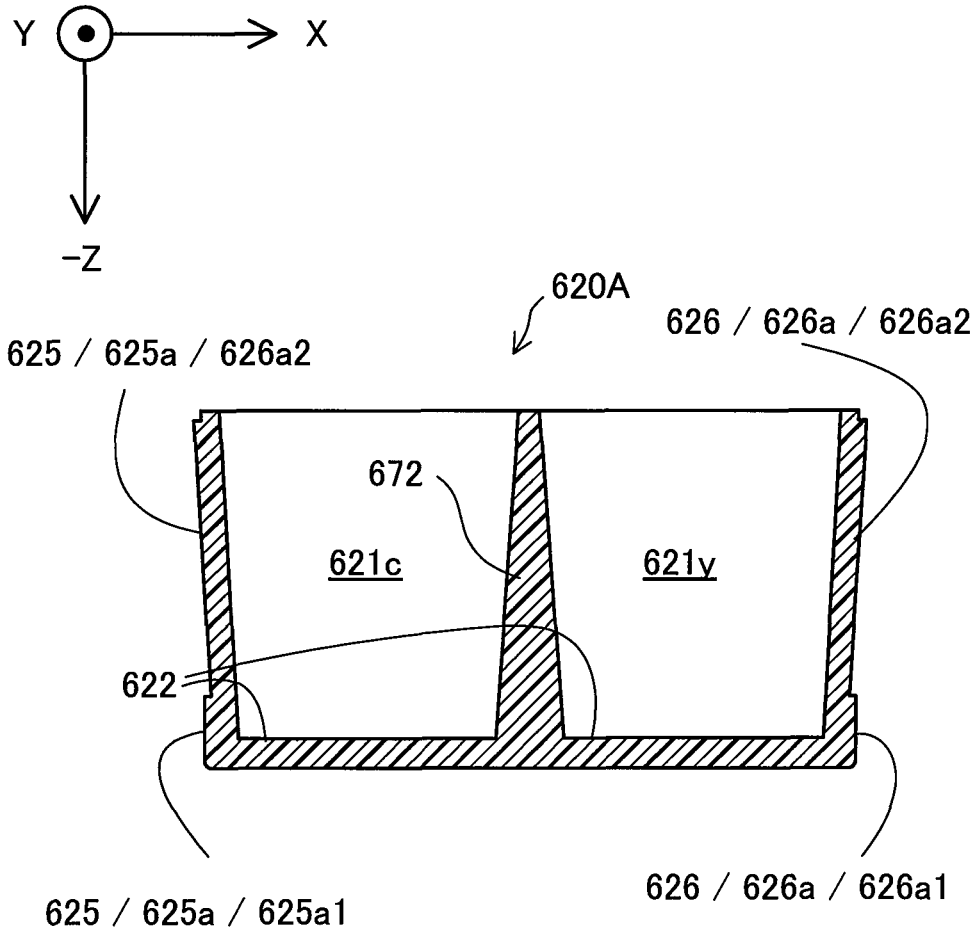
FIG. 30 is a schematic cross sectional view illustrating a first side wall part of a casing of a first modification, corresponding to FIG. 27.
Figure 31:
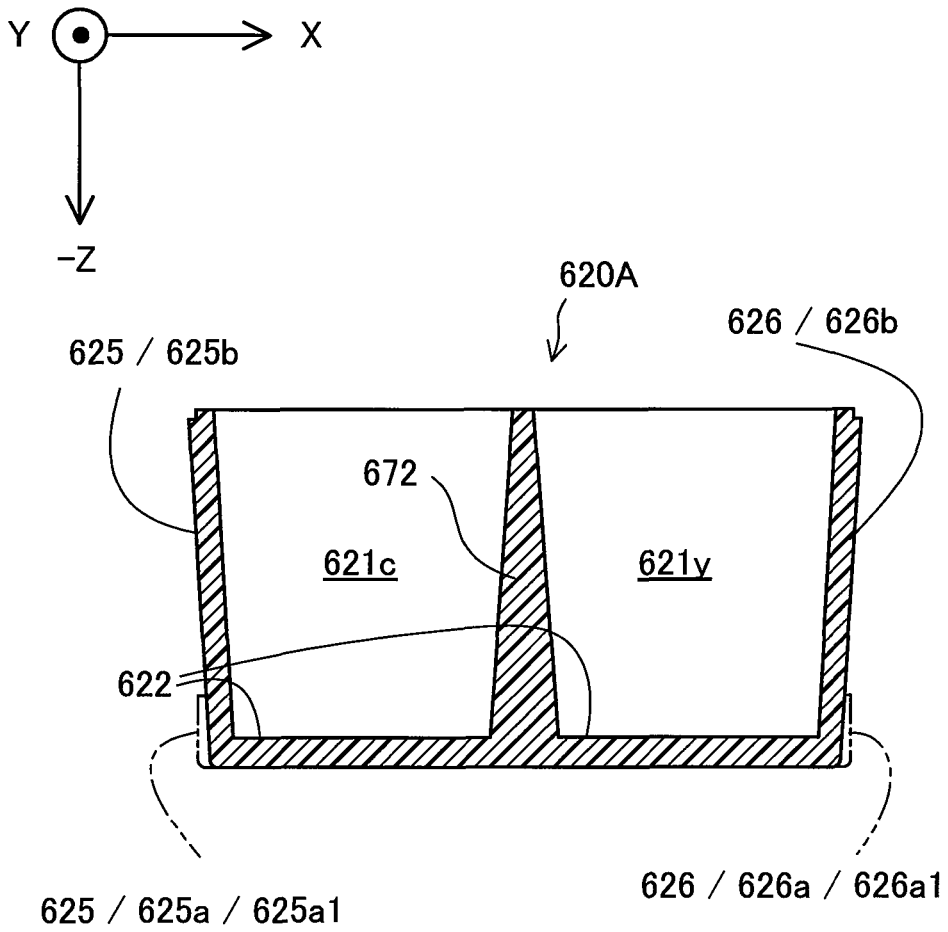
FIG. 31 is a schematic cross sectional view illustrating a second side wall part of the casing of the first modification, corresponding to FIG. 28.
Figure 32:
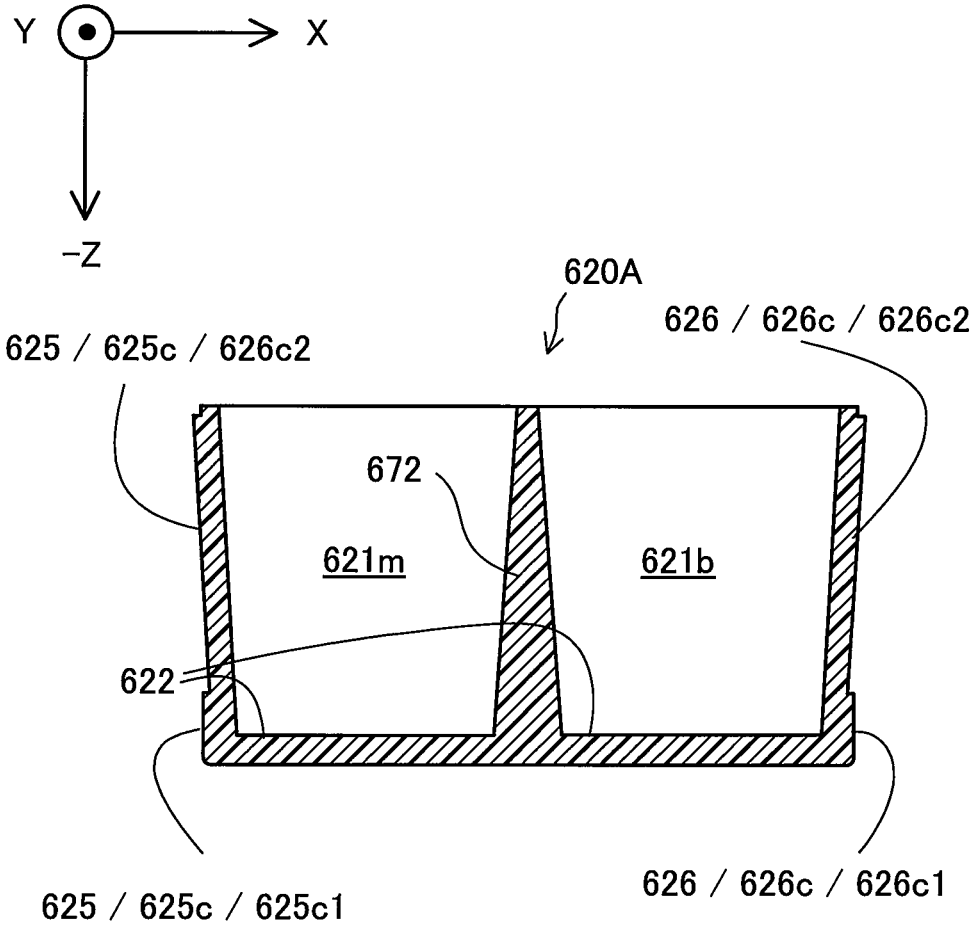
FIG. 32 is a schematic cross sectional view illustrating a third side wall part of the casing of the first modification, corresponding to FIG. 29.

A first modification is a modification of the cartridge 600 shown in FIGS. 26 to 29 and differs from the cartridge 600 by formation of first side wall areas 625*a*1 and 625*c*1. FIG. 30 is a schematic cross sectional view illustrating a first side wall part 625*a* of a casing 602A, corresponding to FIG. 27. FIG. 31 is a schematic cross sectional view illustrating a second side wall part 625*b* of the casing 620A, corresponding to FIG. 28. FIG. 32 is a schematic cross sectional view illustrating a third side wall part 625*c* of the casing 602A, corresponding to FIG. 29. The casing 620A of the first modification includes a first side wall part 625*a*, a second side wall part 625*b* and a third side wall part 625*c*, like the casing 620. The first side wall part 625*a*, the second side wall part 625*b* and the third side wall part 625*c* are sequentially aligned in the direction from the first end wall 623 toward the second end wall 624. As shown in FIG. 30, a first side wall area 625*a*1 of the first side wall part 625*a* is protruded from a second side wall area 625*a*2 and is extended to be substantially perpendicular to the bottom wall 622. The third side wall part 625*c* similarly has a first side wall area 625*c*1 as shown in FIG. 32. The modification of the cartridge 600 including the casing 620A also has the similar advantageous effects to those of the cartridges 4 and 5 described above.

C-2. Second Modification of Appearance of Cartridge

Figure 33:
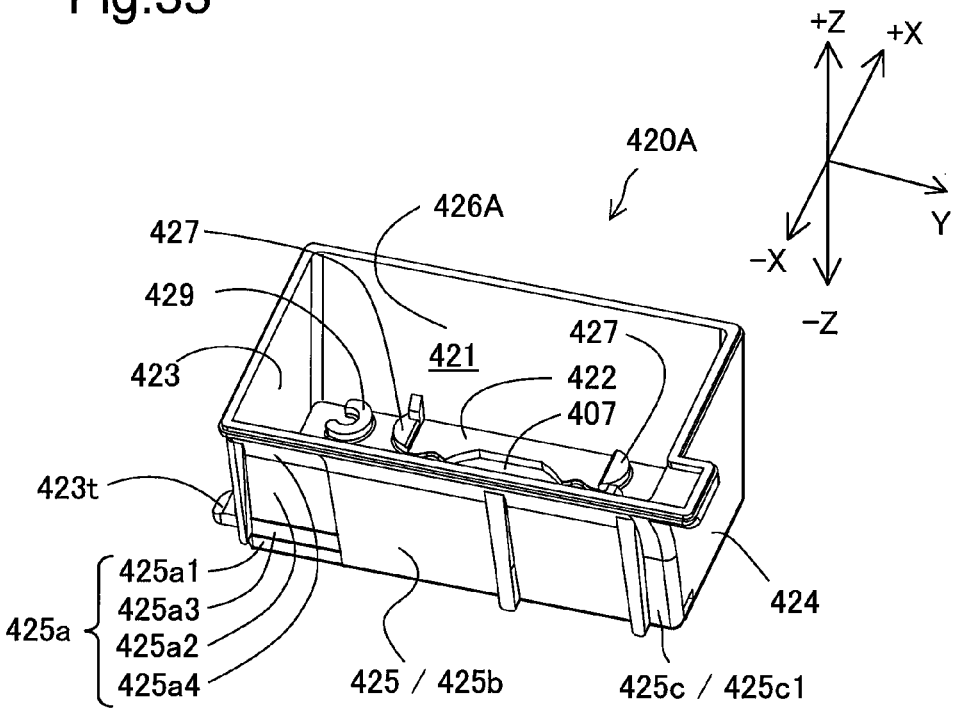
FIG. 33 is an appearance perspective view illustrating a main part of a casing of a second modification.
Figure 34:
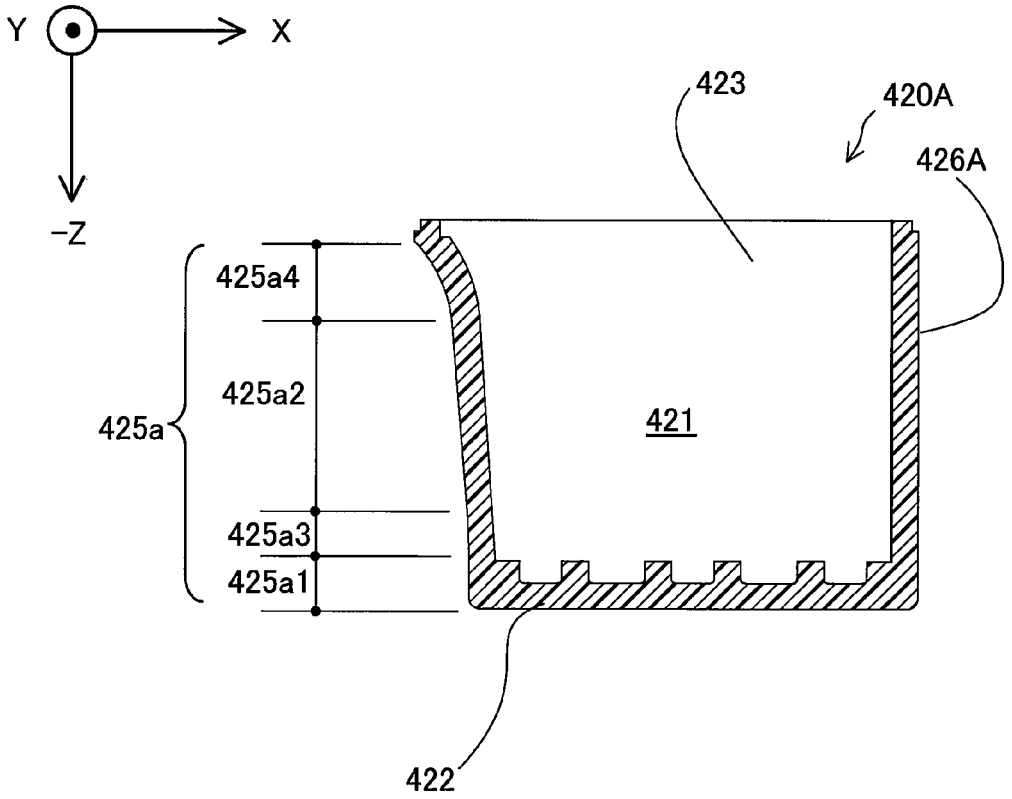
FIG. 34 is a schematic cross sectional view illustrating a first side wall part of the casing of the second modification, corresponding to FIG. 13.
Figure 35:
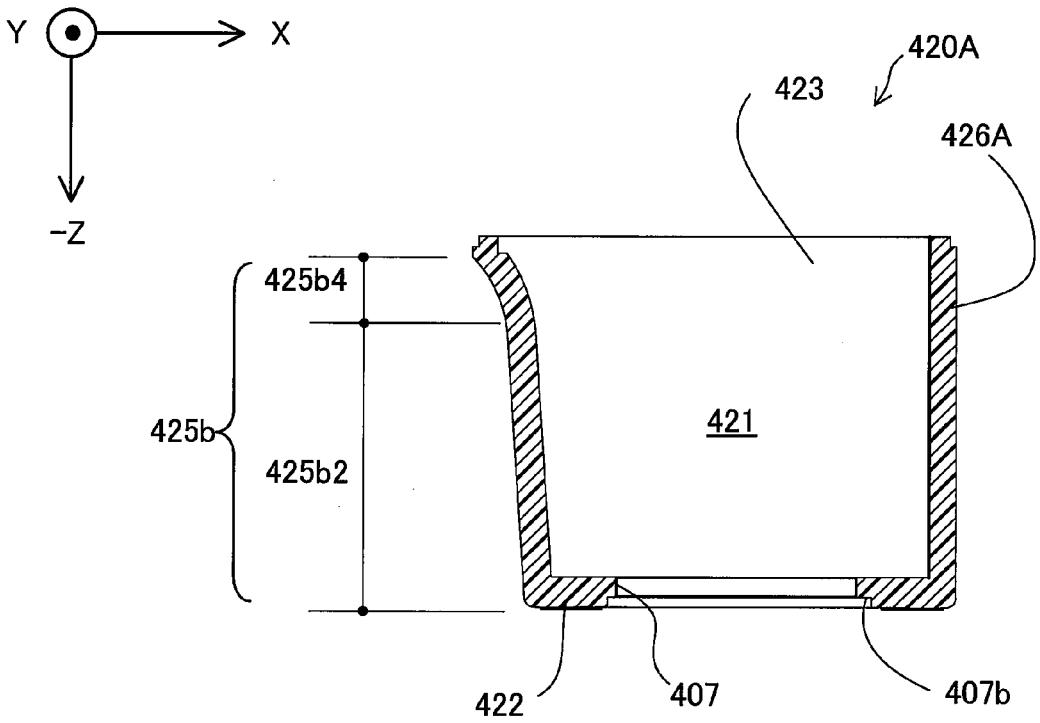
FIG. 35 is a schematic cross sectional view illustrating a second side wall part of the casing of the second modification, corresponding to FIG. 14.
Figure 36:
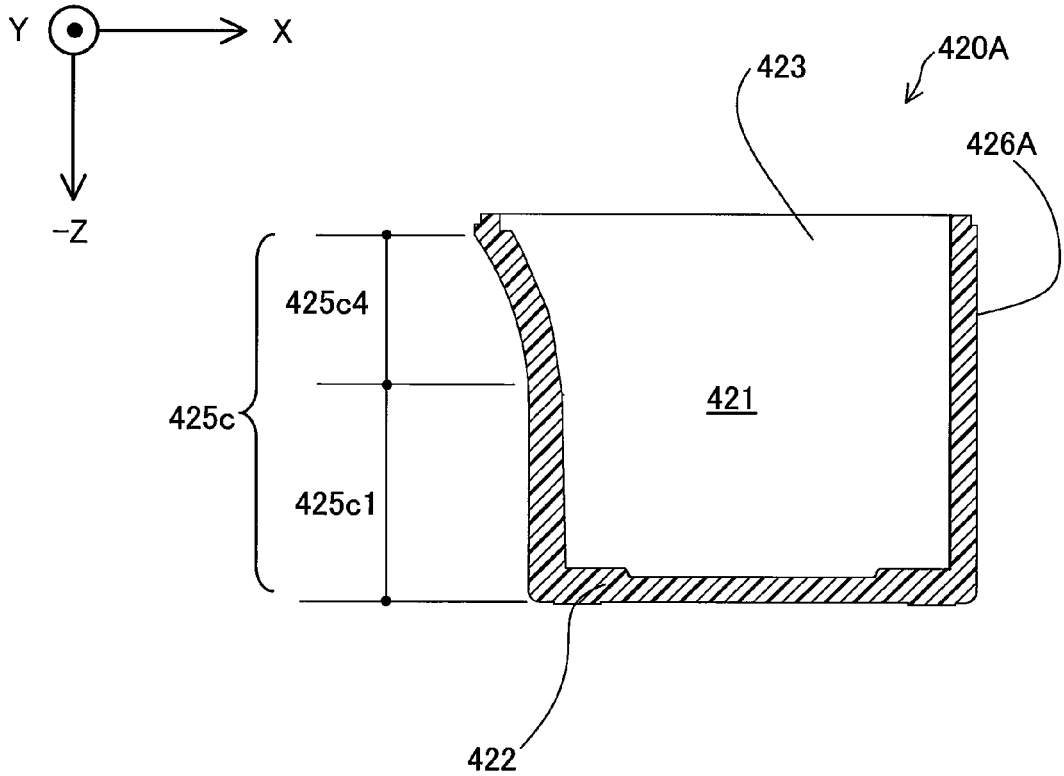
FIG. 36 is a schematic cross sectional view illustrating a third side wall part of the casing of the second modification, corresponding to FIG. 15.

A second modification is a modification of the cartridge 4 shown in FIGS. 8 to 16 and differs from the cartridge 4 by formation of a second side wall 426A constituting a casing 420A. FIG. 33 is an appearance perspective view illustrating a main part of the casing 420A of the second modification. FIG. 34 is a schematic cross sectional view illustrating a first side wall part 425*a* of the casing 420A, corresponding to FIG. 13. FIG. 35 is a schematic cross sectional view illustrating a second side wall part 425*b* of the casing 420A, corresponding to FIG. 14. FIG. 36 is a schematic cross sectional view illustrating a third side wall part 425*c* of the casing 420A, corresponding to FIG. 15. The casing 420A of the second modification has a first side wall 425 including a first side wall part 425*a*, a second side wall part 425*b* and a third side wall part 425*c*, like the casing 420. The first side wall part 425*a*, the second side wall part 425*b* and the third side wall part 425*c* are sequentially aligned in the direction from the first end wall 423 toward the second end wall 424. These first to the third side wall parts 425*a* to 425*c* are the same as those of the casing 420 of the cartridge 4 described above. As shown in FIGS. 34 to 36, the second side wall 426A opposed to the first side wall 425 is extended from the bottom wall 422 to the opening of the casing 420A to be substantially perpendicular to the bottom wall 422. The modification of the cartridge 4 including the casing 420A also has the similar advantageous effects to those of the cartridges 4 and 5 described above.

C-3. Third Modification of Appearance of Cartridge

Figure 37:
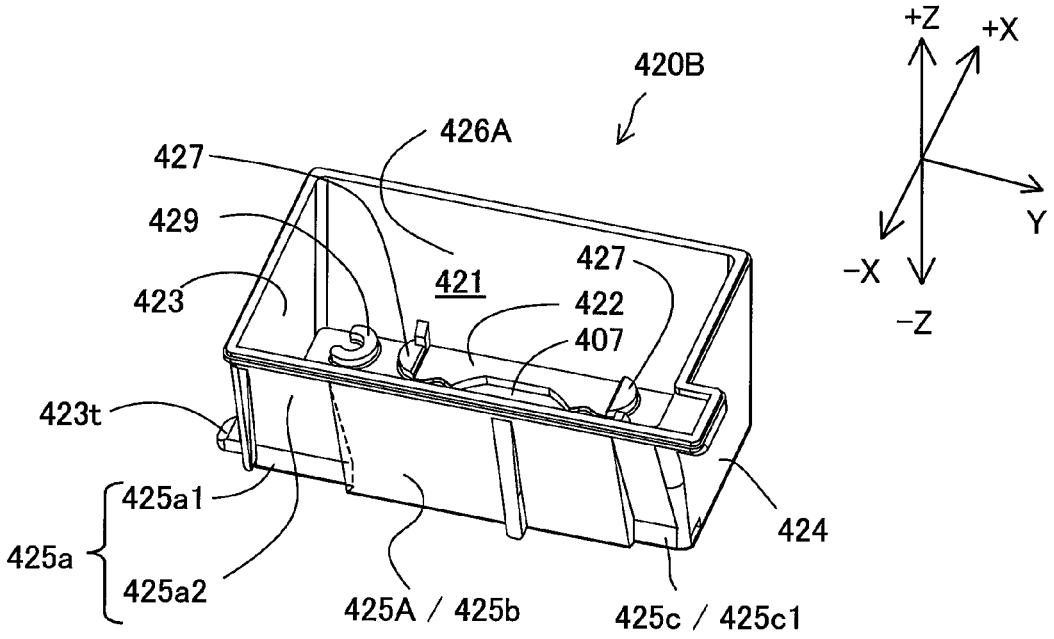
FIG. 37 is an appearance perspective view illustrating a main part of a casing of a third modification.
Figure 38:
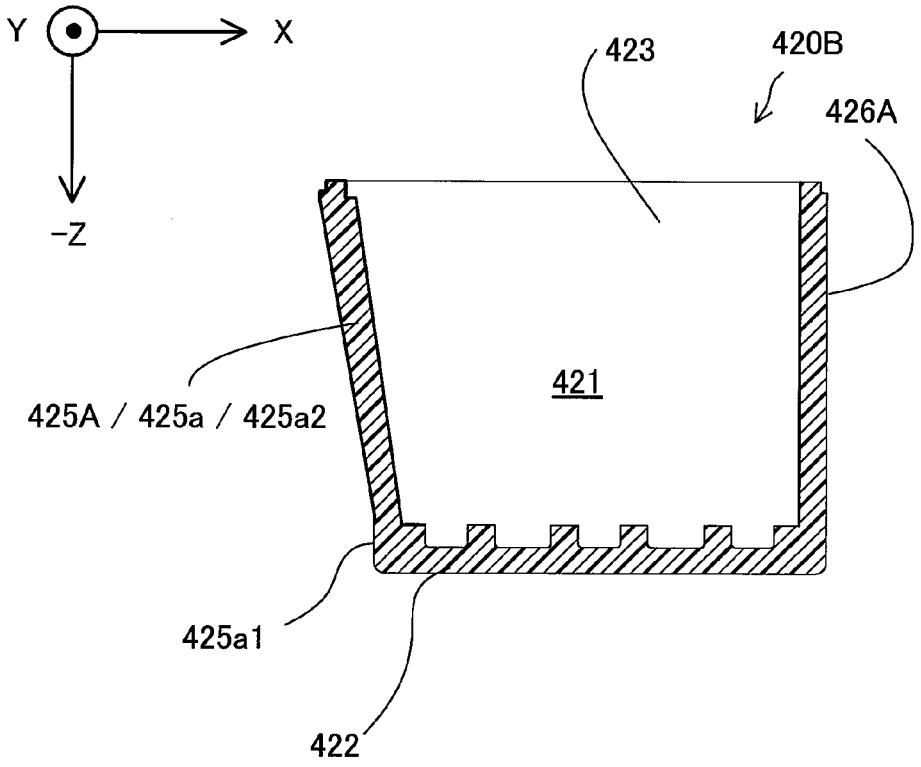
FIG. 38 is a schematic cross sectional view illustrating a first side wall part of the casing of the third modification, corresponding to FIG. 13.
Figure 39:
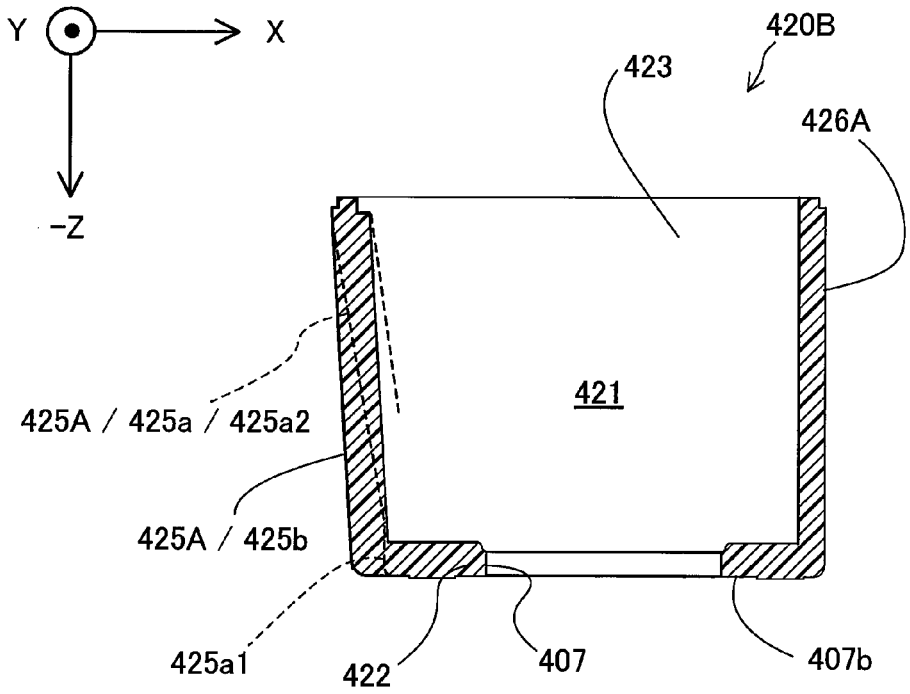
FIG. 39 is a schematic cross sectional view illustrating a second side wall part of the casing of the third modification, corresponding to FIG. 14.
Figure 40:
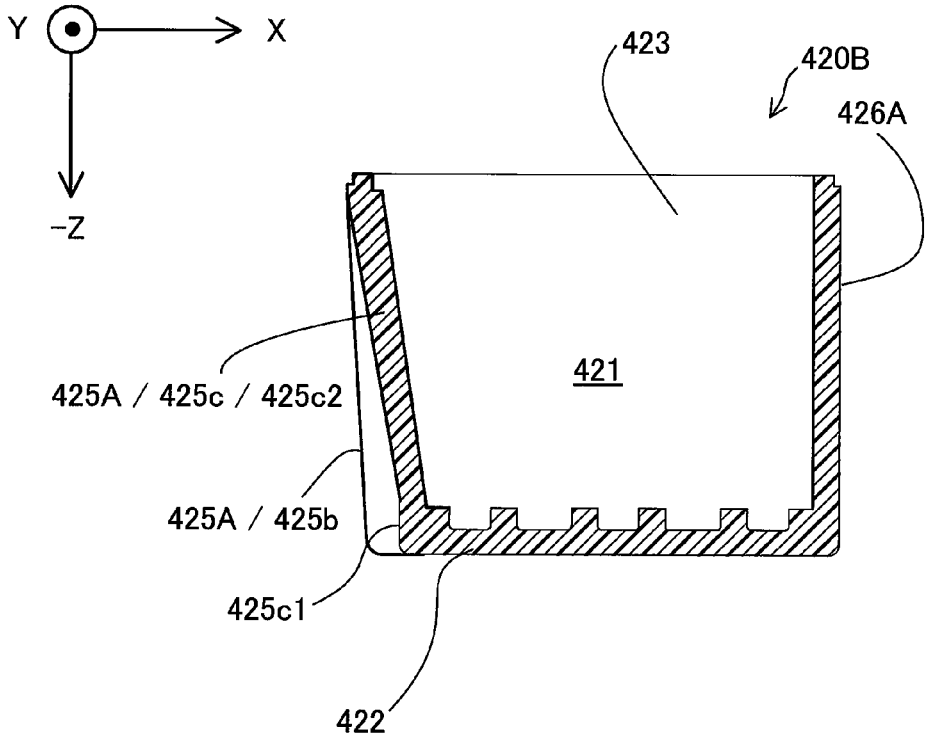
FIG. 40 is a schematic cross sectional view illustrating a third side wall part of the casing of the third modification, corresponding to FIG. 15.

A third modification is a modification of the cartridge 4 shown in FIGS. 8 to 16 and differs from the above second modification by formation of a first side wall 425A constituting a casing 420B. FIG. 37 is an appearance perspective view illustrating a main part of the casing 420B of the third modification. FIG. 38 is a schematic cross sectional view illustrating a first side wall part 425*a* of the casing 420B, corresponding to FIG. 13. FIG. 39 is a schematic cross sectional view illustrating a second side wall part 425*b* of the casing 420B, corresponding to FIG. 14. FIG. 40 is a schematic cross sectional view illustrating a third side wall part 425*c* of the casing 420B, corresponding to FIG. 15. Like the casing 420A, the casing 420B of the third modification has the first side wall 425A including a first side wall part 425*a*, a second side wall part 425*b* and a third side wall part 425*c* sequentially aligned in the direction from the first end wall 423 toward the second end wall 424. A second side wall 426A opposed to the first side wall 425A is extended from the bottom wall 422 to the opening of the casing 420B to be substantially perpendicular to the bottom wall 422. As shown in FIGS. 38 to 40, the second side wall part 425*b* of the first side wall 425A is extended from the bottom wall 422 to the opening of the casing 420B to be inclined with respect to the bottom wall 422. The angle of the second side wall part 425*b* with respect to the bottom wall 422 is made greater than the angles of second side wall areas 425*a*2 and 425*c*2 of the first and the third side wall parts 425*a* and 425*c* with respect to the bottom wall 422, while being made smaller than the angles of first side wall areas 425*a*1 and 425*c*1 of the first and the third side wall parts 425*a* and 425*c* with respect to the bottom wall 422. The modification of the cartridge 4 including the casing 420B also has the similar advantageous effects to those of the cartridges 4 and 5 described above.

C-4. Fourth Modification of Appearance of Cartridge

Figure 41:
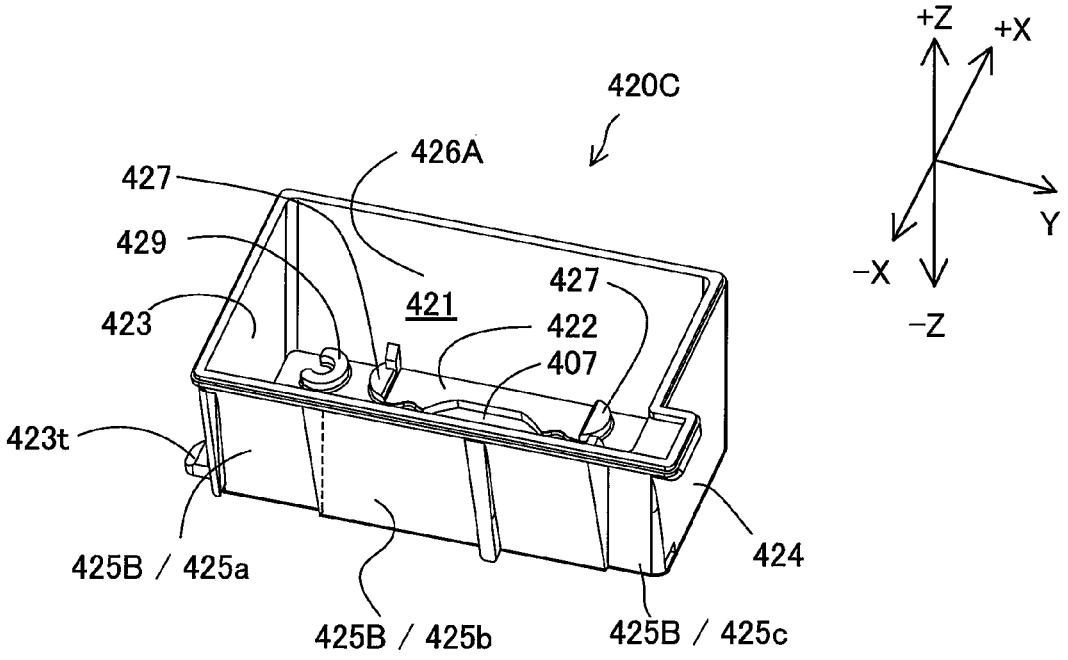
FIG. 41 is an appearance perspective view illustrating a main part of a casing of a fourth modification.
Figure 42:
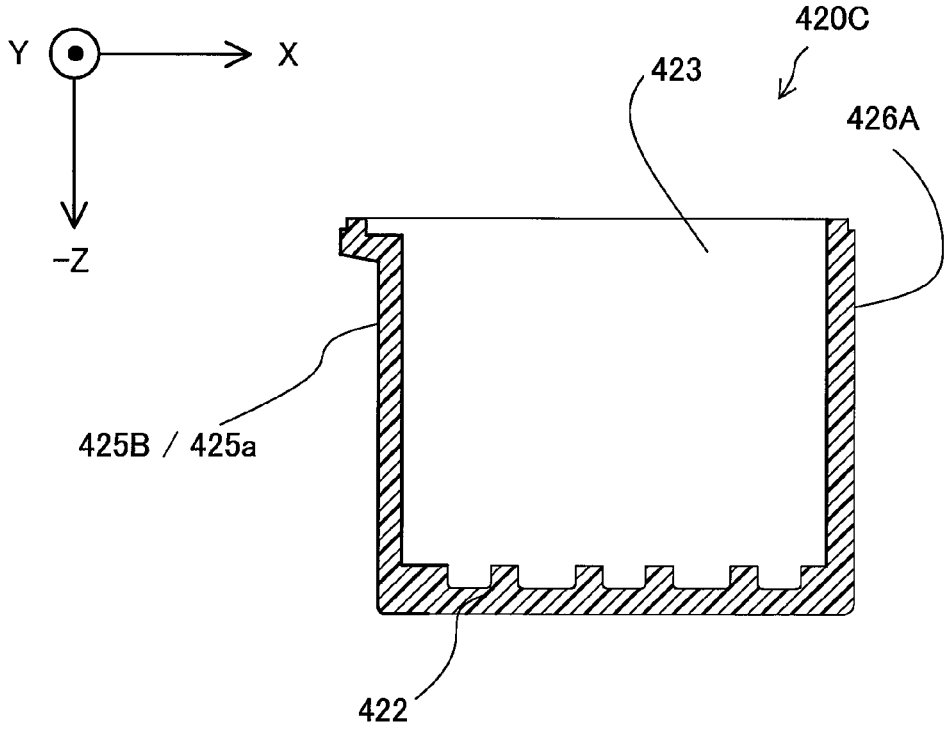
FIG. 42 is a schematic cross sectional view illustrating a first side wall part of the casing of the fourth modification, corresponding to FIG. 13.
Figure 43:
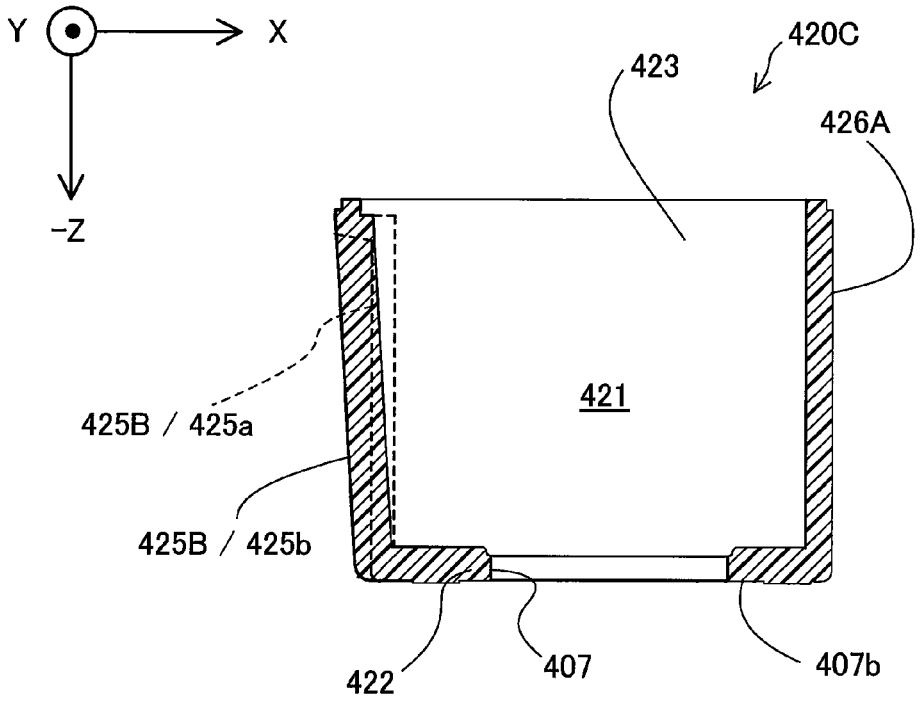
FIG. 43 is a schematic cross sectional view illustrating a second side wall part of the casing of the fourth modification, corresponding to FIG. 14.
Figure 44:
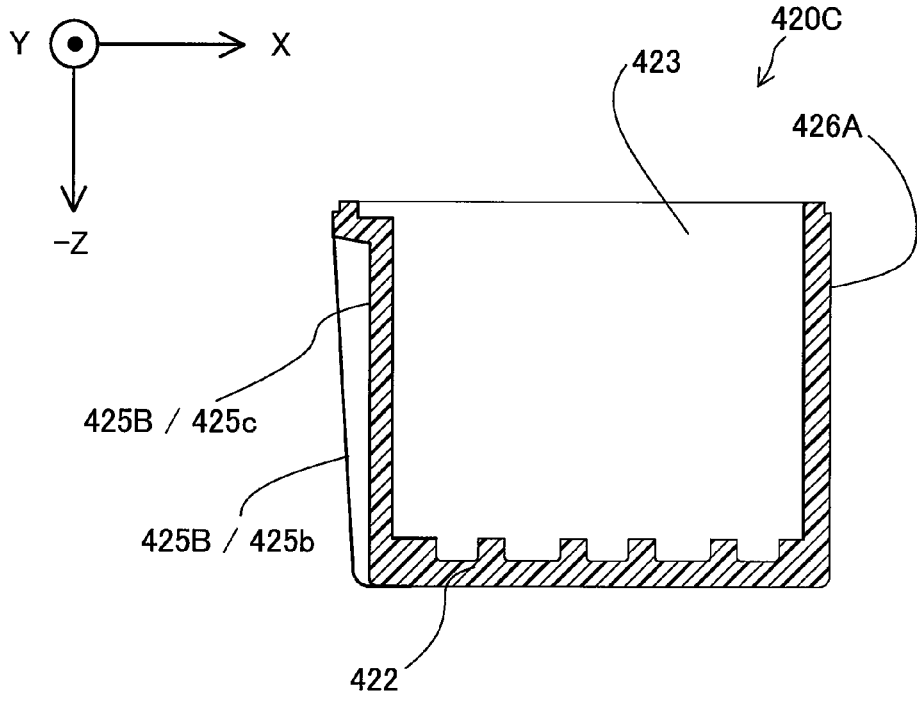
FIG. 44 is a schematic cross sectional view illustrating a third side wall part of the casing of the fourth modification, corresponding to FIG. 15.

A fourth modification differs from the above third modification by formation of a first side wall 425B constituting a casing 420C. FIG. 41 is an appearance perspective view illustrating a main part of the casing 420C of the fourth modification. FIG. 42 is a schematic cross sectional view illustrating a first side wall part 425*a* of the casing 420C, corresponding to FIG. 13. FIG. 43 is a schematic cross sectional view illustrating a second side wall part 425*b* of the casing 420C, corresponding to FIG. 14. FIG. 44 is a schematic cross sectional view illustrating a third side wall part 425*c* of the casing 420C, corresponding to FIG. 15. Like the casings 420A and 420B, the casing 420C of the fourth modification has the first side wall 425B including a first side wall part 425*a*, a second side wall part 426*b* and a third side wall part 426*c* sequentially aligned in the direction from the first end wall 423 to the second end wall 424. A second side wall 426A opposed to the first side wall 425B is extended from the bottom wall 422 to the opening of the casing 420C to be substantially perpendicular to the bottom wall 422. As shown in FIGS. 42 to 44, unlike the embodiments and the modifications described above, the first side wall part 425*a* and the second side wall part 425*c* of the first side wall 425B are extended from the bottom wall 422 to the neighborhood of the opening of the casing 420C to be substantially perpendicular to the bottom wall 422. More specifically, in the cartridge 4 having this casing 420C, the first side wall 425B includes the first side wall part 425*a* and the second side wall part 425*b* aligned in the first direction from the first end wall 423 toward the second end wall 424 (Y direction). The first side wall part 425*a* is extended from the bottom wall 422 in the +Z direction to be substantially perpendicular to the bottom wall 422 over almost the entire area of the first side wall part 425*a*. Additionally, in the cartridge 4 having this casing 420C, the first side wall 425B also has the third side wall part 425*c* aligned with the first side wall part 425*a* and the second side wall part 425*b* in the above first direction. The second side wall part 425*b* is located between the first side wall part 425*a* and the third side wall part 425*c* in the above first direction. The modification of the cartridge 4 including the casing 420C also has the similar advantageous effects to those of the cartridges 4 and 5 described above.

C-5. Other Modifications

The present invention is not limited to the inkjet printer or its ink cartridges but is also applicable to any liquid ejection device configured to eject another liquid but ink and a cartridge (liquid container) configured to contain another liquid. For example, the invention may be applied to any of various liquid ejection devices and their liquid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) liquid ejection device configured to eject a bioorganic material-containing liquid used for manufacturing biochips;

(5) sample ejection device used as a precision pipette;

(6) ejection device of lubricating oil;

(7) ejection device of a resin solution;

(8) liquid ejection device for pinpoint ejection of lubricating oil on precision machines such as watches or cameras;

(9) liquid ejection device configured to eject a transparent resin solution, such as an ultraviolet curable resin solution, onto a substrate in order to manufacture a hemispherical microlens (optical lens) used for, for example, optical communication elements;

(10) liquid ejection device configured to eject an acidic or alkaline etching solution in order to etch a substrate or the like; and

(11) liquid ejection device equipped with a liquid ejection head for ejecting a very small volume of droplets of any other liquid.

The "droplet" herein means the state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, liquid materials in sol-gel process and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

In the casing 420B of the third modification or the casing 420C of the fourth modification shown in FIGS. 37 to 44, the second side wall part 426A or 426B and the first side wall part 425A or 425B may be positioned back to back. More specifically, the second side wall 426A or 426B may be configured to include a first side wall part 426*a*, a second side wall part 426*b* and a third side wall part 426*c* corresponding to the first side wall part 425*a*, the second side wall part 425*b* and the third side wall part 425*c*.

What is claimed is:

1. A liquid supply unit configured to be mounted to a liquid ejection device, the liquid ejection device including a head unit and a carriage unit, the head unit including a liquid introducing part and two first engagement protrusions for positioning the liquid supply unit, the carriage unit including an electrode and two second engagement protrusions for positioning the liquid supply unit, the liquid supply unit configured to be placed between the two first engagement protrusions and between the two second engagement protrusions, the liquid supply unit comprising:

a bottom wall located on a bottom when the liquid supply unit is mounted to the liquid ejection device;

an upper wall opposed to the bottom wall;

a first side wall arranged to intersect with the bottom wall and the upper wall;

a second side wall arranged to intersect with the bottom wall and the upper wall and opposed to the first side wall;

a first end wall arranged to intersect with the bottom wall, the upper wall, the first side wall and the second side wall;

a second end wall arranged to intersect with the bottom wall, the upper wall, the first side wall and the second side wall and opposed to the first end wall;

a contact portion provided on the second end wall and configured to be electrically connected with the electrode; and a liquid retaining member placed in a space surrounded by the bottom wall, the upper wall, the first side wall, the second side wall, the first end wall and the second end wall, wherein the first side wall includes a first part and a second part aligned in a first direction from the first end wall toward the second end wall, the first part of the first side wall has an outer surface comprising:

a first area located closer to the bottom wall than the upper wall and arranged to be substantially perpendicular to the bottom wall; the first area configured to contact one of the two first engagement protrusions in a second direction from the second side wall toward the first side wall, the two first engagement protrusions being protruded along the second direction in a state where the liquid supply unit is mounted to the liquid ejection device; and a second area located closer to the upper wall than the bottom wall and arranged to be inclined with respect to the bottom wall, and the second part of the first side wall is arranged to be inclined with respect to the bottom wall.

2. The liquid supply unit according to claim 1, wherein the first part of the first side wall has the outer surface further comprising:

a third area located between the first area and the second area, wherein the third area has a smaller wall thickness than wall thicknesses of the first area and the second area.

3. The liquid supply unit according to claim 1, wherein the second side wall has an inner wall surface opposed to the first side wall and obliquely formed to compress the liquid retaining member at a constant angle.

4. The liquid supply unit according to claim 1, wherein the second side wall has a flat inner wall surface opposed to the first side wall.

5. The liquid supply unit according to claim 1, wherein the bottom wall is provided with a liquid supply port, wherein in a plan view in a direction from the upper wall toward the bottom wall, the liquid supply port is located between the second part of the first side wall and the second side wall.

6. The liquid supply unit according to claim 1, wherein the second part is wider than the first part of the first side wall in the first direction.

7. The liquid supply unit according to claim 1, wherein an angle of the second part of the first side wall with respect to the bottom wall is greater than an angle of the second area of the first part of the first side wall with respect to the bottom wall.

8. The liquid supply unit according to claim 1, wherein the second part of the first side wall is arranged to have an angle on an upper wall side with respect to the bottom wall equal to an angle of the second area of the first part of the first side wall with respect to the bottom wall and is formed to be continuous with the second area in the first direction.

9. The liquid supply unit according to claim 1, wherein the first side wall further has a third part aligned with the first part and the second part in the first direction, the second part is located between the first part and the third part in the first direction, the third part is located closer to the second end wall than the first end wall, and the third part of the first side wall has an outer surface comprising a fourth area located closer to the bottom wall than the upper wall and arranged to be substantially perpendicular to the bottom wall, the fourth area configured to contact to one of the two second engagement protrusions in the second direction, the two second engagement protrusions being protruded along the second direction in the state where the liquid supply unit is mounted to the liquid ejection device.

10. A liquid supply unit configured to be mounted to a liquid ejection device the liquid ejection device including a head unit and a carriage unit, the head unit including a liquid introducing part and two first engagement protrusions for positioning the liquid supply unit, the carriage unit including an electrode and two second engagement protrusions for positioning the liquid supply unit, the liquid supply unit configured to be placed between the two first engagement protrusions and between the two second engagement protrusions, the liquid supply unit, comprising:

a bottom wall located on a bottom when the liquid supply unit is mounted to the liquid ejection device;

an upper wall opposed to the bottom wall;

a first side wall arranged to intersect with the bottom wall and the upper wall;

a second side wall arranged to intersect with the bottom wall and the upper wall and opposed to the first side wall;

a first end wall arranged to intersect with the bottom wall, the upper wall, the first side wall and the second side wall;

a second end wall arranged to intersect with the bottom wall, the upper wall, the first side wall and the second side wall and opposed to the first end wall;

a contact portion provided on the second end wall and configured to be electrically connected with the electrode; and a liquid retaining member placed in a space surrounded by the bottom wall, the upper wall, the first side wall, the second side wall, the first end wall and the second end wall, wherein the first side wall includes a first part and a second part aligned in a first direction from the first end wall toward the second end wall, the first part is arranged to be substantially perpendicular to the bottom wall, the first part configured to contact one of the two first engagement protrusions in a second direction from the second side wall toward the first side wall, the two first engagement protrusions being protruded along the second direction in a state where the liquid supply unit is mounted to the liquid ejection device, and the second part is arranged to be inclined with respect to the bottom wall.

11. The liquid supply unit according to claim 10, wherein the first side wall further has a third part aligned with the first part and the second part in the first direction, the second part is located between the first part and the third part in the first direction, the third part located closer to the second end wall than the first end wall, and the third part is arranged to be substantially perpendicular to the bottom wall, the third part configured to contact to one of the two second engagement protrusions in the second direction, the two second engagement protrusions being protruded along the second direction in the state where the liquid supply unit is mounted to the liquid ejection device.

* * * * *